US008101844B2

(12) United States Patent
Silbert et al.

(10) Patent No.: US 8,101,844 B2
(45) Date of Patent: Jan. 24, 2012

(54) AUTOMATIC ANALYSIS AND PERFORMANCE OF MUSIC

(75) Inventors: Gershon Silbert, Herzlia (IL); Andres Hakim, Kfar-Saba (IL)

(73) Assignee: Silpor Music Ltd., Tel-Aviv (IL)

( * ) Notice: Subject to any disclaimer, the term of this patent is extended or adjusted under 35 U.S.C. 154(b) by 188 days.

(21) Appl. No.: 12/376,438

(22) PCT Filed: Jul. 31, 2007

(86) PCT No.: PCT/IL2007/000961

§ 371 (c)(1), (2), (4) Date: Feb. 5, 2009

(87) PCT Pub. No.: WO2008/018056

PCT Pub. Date: Feb. 14, 2008

(65) Prior Publication Data

US 2010/0175539 A1 Jul. 15, 2010

Related U.S. Application Data

(60) Provisional application No. 60/821,602, filed on Aug. 7, 2006, provisional application No. 60/821,744, filed on Aug. 8, 2006, provisional application No. 60/884,447, filed on Jan. 11, 2007.

(51) Int. Cl.
*G10H 3/00* (2006.01)

(52) U.S. Cl. ..... 84/613; 84/637; 84/669; 84/715

(58) Field of Classification Search ..... 84/613, 84/637, 650, 669, 715
See application file for complete search history.

(56) References Cited

U.S. PATENT DOCUMENTS

| | | | | | |
|---|---|---|---|---|---|
| 3,916,754 | A | * | 11/1975 | Thiel | 84/402 |
| 4,002,097 | A | * | 1/1977 | Leonard | 84/471 SR |
| 4,295,402 | A | * | 10/1981 | Deutsch et al. | 84/715 |
| 4,539,882 | A | * | 9/1985 | Yuzawa | 84/610 |
| 4,864,907 | A | * | 9/1989 | Oguri | 84/637 |
| 4,941,387 | A | * | 7/1990 | Williams et al. | 84/609 |
| 4,951,544 | A | * | 8/1990 | Minamitaka | 84/613 |
| 5,085,118 | A | * | 2/1992 | Sekizuka | 84/635 |
| 5,218,153 | A | * | 6/1993 | Minamitaka | 84/613 |
| 5,218,157 | A | * | 6/1993 | Akagawa et al. | 84/637 |

(Continued)

FOREIGN PATENT DOCUMENTS

EP 1533786 5/2005

(Continued)

OTHER PUBLICATIONS

Communication Relating to the Results of the Partial International Search Dated Nov. 26, 2007 From the International Searching Authority Re.: Application No. PCT/IL2007/000961.

International Preliminary Report on Patentability Dated Feb. 19, 2009 From the International Bureau of WIPO Re.: Application No. PCT/IL2007/000961.

(Continued)

*Primary Examiner* — David S. Warren

(57) ABSTRACT

Methods for automatically analyzing and/or performing music are described. One embodiment concerns a method for assigning chords to a musical score indicative of a sequence of time segments, each time segment comprising at least one note, the method comprising assigning a chord to each time segment responsive to consonance/dissonance relationships between the assigned chord and the notes of at least two of the time segments. Optionally, consonance/dissonance relationships include existence of a dissonant between a chord assigned to a time segment and a note of the time segment and existence of resolution to said dissonant.

26 Claims, 32 Drawing Sheets

U.S. PATENT DOCUMENTS

| | | | | | |
|---|---|---|---|---|---|
| 5,220,122 | A | * | 6/1993 | Shibukawa | 84/669 |
| 5,260,510 | A | * | 11/1993 | Shibukawa | 84/637 |
| 5,302,776 | A | * | 4/1994 | Jeon et al. | 84/613 |
| 5,418,325 | A | * | 5/1995 | Aoki et al. | 84/613 |
| 5,424,486 | A | * | 6/1995 | Aoki | 84/613 |
| 5,455,379 | A | * | 10/1995 | Kim et al. | 84/637 |
| 5,491,298 | A | * | 2/1996 | Eiichiro | 84/656 |
| 5,510,572 | A | * | 4/1996 | Hayashi et al. | 84/609 |
| 5,736,666 | A | * | 4/1998 | Goodman et al. | 84/669 |
| 5,753,843 | A | * | 5/1998 | Fay | 84/609 |
| 5,760,325 | A | * | 6/1998 | Aoki | 84/613 |
| 5,942,710 | A | * | 8/1999 | Hayakawa et al. | 84/637 |
| 6,060,655 | A | * | 5/2000 | Minamitaka | 84/650 |
| 6,791,021 | B2 | * | 9/2004 | Aoki | 84/613 |

FOREIGN PATENT DOCUMENTS

WO WO 2008/018056 2/2008

OTHER PUBLICATIONS

Barthélemy et al. "Figured Bass and Tonality Recognition", 2nd Annual International Symposium on Music Information Retrieval, ISMIR, Indiana University, Bloomington, IN, USA, 8 P., 2001. Retrieved From the Internet: <URL:http://ismir2001.ismir.net/pdf/barthelemy.pdf>. Abstract, Figs.1-7, Introduction, 4. Description of Harmonic Reduction.

Pardo et al. "Algorithms for Chordal Analysis", Computer Music Journal MIT Press, 26(2): 27-49, 2002. Abstract, Figs.1-4, Tables i-3, p. 27-32, p. 35, r-h Col.-p. 37, r-h Col.

Pardo et al. "Algorithms for Chordal Analysis", Database INSPEC [Online], Database Accession No. 7376008, 2002.

Pardo et al. "Automated Partitioning of Tonal Music", Database INSPEC [Online], Database Accession No. 7372830, 2000. Abstract.

Pardo et al. "Automated Partitioning of Tonal Music", Proceedings of the 13th International Florida Artificial Intelligence Research Society Conference, FLAIRS, Orlando, FL, USA, p. 23-27, 2000.

* cited by examiner

| NOTES | C | D | E | F | G | A | B |
|---|---|---|---|---|---|---|---|
| CMAJ | NATURAL | NATURAL | NATURAL | NATURAL | NATURAL | NATURAL | NATURAL |
| GMAJ | NATURAL | NATURAL | NATURAL | SHARP | NATURAL | NATURAL | NATURAL |
| DMAJ | SHARP | NATURAL | NATURAL | SHARP | NATURAL | NATURAL | NATURAL |
| AMAJ | SHARP | NATURAL | NATURAL | SHARP | SHARP | NATURAL | NATURAL |
| EMAJ | SHARP | SHARP | NATURAL | SHARP | SHARP | NATURAL | NATURAL |
| BMAJ | SHARP | SHARP | NATURAL | SHARP | SHARP | SHARP | NATURAL |
| F#MAJ | SHARP | SHARP | DOUBLE SHARP | SHARP | SHARP | SHARP | NATURAL |
| C#MAJ | SHARP | SHARP | DOUBLE SHARP | SHARP | SHARP | SHARP | DOUBLE SHARP |
| FMAJ | NATURAL | NATURAL | NATURAL | NATURAL | NATURAL | NATURAL | FLAT |
| BbMAJ | NATURAL | NATURAL | FLAT | NATURAL | NATURAL | NATURAL | FLAT |
| EbMAJ | NATURAL | NATURAL | FLAT | NATURAL | NATURAL | FLAT | FLAT |
| AbMAJ | NATURAL | FLAT | FLAT | NATURAL | NATURAL | FLAT | FLAT |
| DbMAJ | NATURAL | FLAT | FLAT | NATURAL | FLAT | FLAT | FLAT |
| GbMAJ | FLAT | FLAT | FLAT | NATURAL | FLAT | FLAT | FLAT |
| CbMAJ | FLAT | FLAT | FLAT | FLAT | FLAT | FLAT | FLAT |
| AMIN | NATURAL | NATURAL | NATURAL | NATURAL | SHARP | NATURAL | NATURAL |
| EMIN | NATURAL | SHARP | NATURAL | SHARP | NATURAL | NATURAL | NATURAL |
| BMIN | SHARP | NATURAL | NATURAL | SHARP | NATURAL | SHARP | NATURAL |
| F#MIN | SHARP | NATURAL | SHARP | SHARP | SHARP | NATURAL | NATURAL |
| C#MIN | SHARP | SHARP | NATURAL | SHARP | SHARP | NATURAL | SHARP |
| G#MIN | SHARP | SHARP | NATURAL | DOUBLE SHARP | SHARP | SHARP | NATURAL |
| D#MIN | DOUBLE SHARP | SHARP | SHARP | SHARP | SHARP | SHARP | NATURAL |
| A#MIN | SHARP | SHARP | SHARP | SHARP | DOUBLE SHARP | SHARP | SHARP |
| DMIN | SHARP | NATURAL | NATURAL | NATURAL | NATURAL | NATURAL | FLAT |
| GMIN | NATURAL | NATURAL | FLAT | SHARP | NATURAL | NATURAL | FLAT |
| CMIN | NATURAL | NATURAL | FLAT | NATURAL | NATURAL | FLAT | NATURAL |
| FMIN | NATURAL | FLAT | NATURAL | NATURAL | NATURAL | FLAT | FLAT |
| BbMIN | NATURAL | FLAT | FLAT | NATURAL | FLAT | NATURAL | FLAT |
| EbMIN | FLAT | NATURAL | FLAT | NATURAL | FLAT | FLAT | FLAT |
| AbMIN | FLAT | FLAT | FLAT | FLAT | NATURAL | FLAT | FLAT |

FIG.10

AUTOMATIC ANALYSIS AND PERFORMANCE OF MUSIC

RELATED APPLICATIONS

This application is a National Phase of PCT Patent Application No. PCT/IL2007/000961 having International filing date of Jul. 31, 2007, which claims the benefit under Section 119(e) of U.S. Provisional patent applications Nos. 60/821,602 filed on Aug. 7, 2006, 60/821,744 filed on Aug. 8, 2006, and 60/884,447 filed on Jan. 11, 2007, all of which are incorporated herein by reference.

FIELD OF THE INVENTION

The invention relates to automatic analysis and performance of music.

BACKGROUND OF THE INVENTION

There is a recognized need to automatically perform music. Oftentimes music composers wish to hear their newly composed music performed without gathering an ensemble of musicians for playing the music. For someone who is not a professional musician, it is difficult, and in many cases impossible, to appreciate a musical score until it is performed, and engaging well-trained players is cost prohibitive, since extensive preparation, practice and rehearsals are required to achieve a reasonably expressive performance. There is therefore a need for automatic performance of music.

Conventional music notation was developed to allow human performers to perform the music in many cases according to their musical interpretation, rather than to indicate the exact expression of each note regarding parameters such as tempo and/or intensity. Human performers take into account, consciously or not, many parameters that are not explicit in musical scores. For instance, human performers usually play a first note in a measure louder than the other notes in the measure even in the absence of any explicit indications in the score for doing so. Similarly, human performers intuitively change the length and intensity of notes in accordance with the role these notes play in the harmonic flow of the music.

State of the art systems for automatic music performance perform music from notes by playing the notes as indicated in the score, yet fail to take into account many implicit factors considered by human performers, as data describing these factors, is absent from conventional scores. As a result, automatic performance of music is characteristically monotonic and devoid of musical expression. Most notation applications allow to input music in standard music notation and translate the notation file information to MIDI format, allowing users to change manually MIDI parameters such as Tempo, Duration and Velocity (the MIDI parameter that together with Volume determines the sound intensity) of each note at the user's will. This allows in principle creating a music notation file that is not different from human performance; but in practice, the task of assigning MIDI parameters to each note is too tedious, and requires exceptional skills.

Another option provided in the art is playing music by a human performer into a music notation file (for instance, in a piano with MIDI capabilities, such as the Yamaha Disklavier™), and then "correcting" the performance by manipulating tempo and/or velocity values of some of the notes played. However, this solution does not free the user from actually performing the music in the first place.

SUMMARY OF THE INVENTION

In accordance with an aspect of some embodiments of the present invention, notes are automatically played with deviations from exact execution of the way they are written in the score; notes also are automatically assigned parameter values that are not explicit in the score; and these deviations and/or assignments are determined by the musical context in which the notes appear.

In the context of the present invention, "musical context" relates to at least one of the two following positions of a note:

(1) the position of a note in the harmonic flow of music; and (2) the position of a note in the rhythmic flow of music.

It is generally known in the art of human music performance that notes of different positions in a harmonic flow are played differently. For instance, it is a common practice (at least in some musical cultures and styles) to slow down when a cadence begins and speed up after a cadence ends. It is also a common practice to play the resolution note more softly than the dissonant note, which precedes it.

Thus, a broad aspect of some embodiments of the present invention relates to automatically analyzing the flow of harmonic changes in music. Such automatic analysis may be very beneficial in automatic music performance, as well as in other fields. For instance, determining flow of harmonic changes in musical scores is a task that music students and teachers are involved with, in the process of understanding the structure of music. Having an automatic tool that provides a reliable analysis of such flow will help in teaching and/or learning music. Automatic determination of flow of harmonic changes is also important for automatic composition of original musical scores based on input scores. Such original scores may be variations of the original score, improvisations thereon, continuation thereof, or the like.

In accordance with an embodiment of the invention, an automatic music performer plays notes with deviations from their exact annotation, and assignments of values to note parameters that are not explicit in the annotation and these deviations and assignments depend on the position of these notes in a harmonic flow of the music.

It is also generally known in the art of music performance that notes of different position in a rhythmic flow are played differently. In accordance with an aspect of some embodiments of the present invention, an automatic music performer plays notes with performance parameters that deviate from the exact way indicated in the score, and/or assign to notes performance parameters that are not explicit in the score and these deviations and/or assignments depend on the position of these notes in a rhythmic flow of the music.

In a preferred embodiment of the invention, both the position in the harmonic flow and the position in the rhythmic flow are taken into account in automatically performing a musical score. For instance, in an exemplary embodiment, if a note is to be slowed down by 10% due to its position in the harmonic flow, and speeded up by 5% due to its position in the rhythmic flow, this note is slowed down by 5%.

In an embodiment of the invention, a user of the automatic performer may associate performance deviations and/or assignments with one or more of the above-mentioned positions of the note, and the automatic music performer identifies automatically when each deviation and/or assignments are to be applied, in accordance with harmonic and/or rhythmic analysis of the music.

One broad aspect of some embodiments of the present invention relates to assigning chords to a musical score, such that the chords will be recognized by a musician to reflect the flow of harmonic changes of the score. The musical score may be, for example, a score of monophonic music with accompaniment, or polyphonic music.

An aspect of some embodiments of the invention relates to optimizing a cost function over possible chord assignments. Optionally, the chord assignment is done by applying an optimization method.

FIG. 1 describes a method (10) according to this aspect. The method (10) comprises three parts: providing musical fitness function (12); running an optimization procedure as if to optimize the musical fitness function over chord assignments (14) and assigning to the score the chord assignment found in the optimization process (16).

Musical fitness is a function of the notes of the score and the assigned chords, and it has a maximal (or minimal) value when the chord assignment is such, that a musician finds that it most satisfactorily reflects the flow of harmonic changes in the score. The satisfaction level of a musician with a suggested chord assignment is referred herein as "musical correctness".

In an exemplary embodiment, the musical fitness function is used as a cost (or value) function, where assigning each chord to a segment of the score has a cost (or value), and the assignment of minimal cost (or maximal value) is searched for. In the following description and claims we refer to cost function and value function interchangeably and refer to a minimum and a maximum by the general term "optimum".

An aspect of some embodiments of the invention relates to providing as a musical fitness function a cost function that has a minimum at relatively high musical correctness.

According to an exemplary embodiment of the invention, the musical fitness function has at least two components: a local component and a contextual component.

The local component depends on a relation between a chord assigned to a particular segment of the score and the notes of the same segment. For example, a local component of the musical fitness function may depend on the number of notes that are common to a chord assigned to a score segment, and to the notes actually present in the same score segment.

The contextual component depends on a relation between a chord assigned to a particular segment of the score and notes of neighboring segments. For example, if there is a dissonant between a note in a score segment and the chord assigned to the same score segment, the contextual component of the musical fitness function optionally depends on the existence of resolutions of the dissonant.

Optionally, the function also has a global component that depends on the overall chord assignment. For instance, the musical fitness function may have higher value if longer sequences of time segments are assigned the same chord.

In exemplary embodiments of the invention, the score is considered to be made of time segments, each of which begins with the appearing of a first note and ends with the appearing of another note. Such a time segment is termed herein a moment.

In exemplary embodiments of the invention, chords are assigned to moments responsive to the key environment of the moments. The key environment is defined by the accidentals (sharps, flats, naturals, etc.) the notes that appear in the moment have, and the accidentals that the notes that do not appear in the moment were expected to have, considering the accidentals that appeared in the score before.

Another broad aspect of some embodiments of the invention relates to automatically perforating music scores in a 'more rhythmically musical' manner, by providing rules, by which tempo parameters, and optionally also velocity parameters are assigned to moments and/or notes. The parameters assigned by these rules define deviations from the values explicitly indicated in the score. As a result, the timing of the moments is different from that explicitly defined in the score, and the music performance is more rhythmically correct and sounds more 'musical'.

The rules are generally score-independent, although some users may prefer using one set of rules for one piece of music and another set of rules for another piece of music. The set of rules are referred herein as 'pre-sets'.

The terms moment and tempo are explained below.

Tempo parameter is a parameter that defines a deviation between the tempo with which a moment is to be played according to the rule and the tempo with which the same moment is to be played without the rule (hereinafter 'the nominal value'), for instance, the tempo assigned to it explicitly in the score, or a default Tempo (usually: a quarter-tone=120).

Optionally, the tempo parameter is expressed in multiples of the nominal tempo, for instance, if a nominal tempo is 100, a parameter of 1.1 indicates a tempo of 110. In this option, a parameter of 1.0 indicates no deviation from the nominal value.

In another option, the tempo parameter is expressed in MIDI tempo units to be added to the nominal tempo value. For instance, if the nominal tempo is 100, a parameter of −5 indicates a tempo of 95. In this option, a parameter of 0 indicates no deviation from the nominal value.

Optionally, the tempo parameter is expressed in the final tempo value, for instance, a tempo parameter of 110 indicates a tempo of 110. In this option, there is no parameter value that indicates 0 deviation from the nominal value. The invention may be worked with any kind of parameter that defines deviations from the nominal tempo values.

In an embodiment of the invention, if no tempo is assigned explicitly to the score, it is possible to assign a tempo to the score by the user (or by default). In this case, the tempo parameter defines a deviation (for instance, a ratio) between the tempo with which a note is to be played according to the rule and the user-defined (or default) tempo.

In an embodiment of the invention, tempo parameters are assigned to a moment responsive to rhythmic characteristics of the moment. These rhythmic characteristics may include, for instance, the time signature, the subdivision of the moment and the position of the moment in the measure (that is, if the moment begins at the beginning of the measure, some subdivision away from the beginning, at the end of the measure, etc.).

In an embodiment of the invention, the performance is automatic in the sense that tempo and/or velocity parameters that result in high 'rhythmical correctness' may be assigned without requiring any input from a user. However, the user may be allowed to input preferences for the automatic performance, optionally by choosing between several optional pre-sets or by changing pre-sets or creating pre-sets, optionally within some predetermined guidelines. Optionally, the user may define one set of preferences for the entire score. Alternatively, a user may define different performance preferences to different portions of the score.

Velocity parameter is a parameter that defines a deviation between the velocity with which a moment is to be played according to the rule and the velocity with which the same moment is to be played without the rule (hereinafter 'the nominal velocity), for instance, the velocity assigned to the moment explicitly in the score, or a default velocity (usually 64).

Optionally, the velocity parameter is expressed in multiples of the nominal velocity, for instance, if a nominal velocity is 100, a parameter of 1.1 indicates a velocity of 110. In this option, a parameter of 1.0 indicates no deviation from the nominal value.

In another option, the velocity parameter is expressed in MIDI velocity units to be added to the nominal velocity. For instance, if the nominal velocity is 100, a parameter of −5 indicates a velocity of 95. In this option, a parameter of 0 indicates no deviation from the nominal value.

Optionally, the velocity parameter is expressed in the final velocity value, for instance, a parameter of 110 indicates a velocity of 110. In this option, there is no fixed value to a parameter that indicates no deviation.

The invention may be worked with any kind of parameter that defines deviations from the nominal velocity value.

In an embodiment of the invention, if no velocity is assigned explicitly, it is possible to assign a general velocity to the score by the user (or by default). In this case, the velocity parameter defines the deviation (for instance, the ratio) between the velocity with which a note is to be played according to the rule and the user-defined (or default) velocity.

An aspect of the invention relates to automatically performing musical scores, and allowing manual control over deviations of the automatic performance from tempi and/or velocities explicitly indicated in the score. Optionally, the manual control is by applying rules, by which tempo and/or velocity parameters are automatically assigned to notes and moments.

An aspect of some embodiments of the invention relates to an apparatus for receiving a first music notation file, and creating based on the received file, a second music notation file, the realization of which sounds more rhythmically correct, than that of the first. The second file includes at least tempi that are different from the tempi as marked in the score.

Optionally, the apparatus plays the music from the second music notation file. Optionally, instead of creating a second music notation file, the apparatus plays the first music notation file in a non-standard manner. For instance, the apparatus may play music from the first music notation file according to data stored in a performance instructions file, comprising instructions to play music in a manner different than is explicitly written in the first music notation file.

Thus, according to some embodiments of the present invention, there is provided a method for assigning chords to a musical score indicative of a sequence of time segments, each time segment comprising at least one note, the method comprising assigning a chord to each time segment responsive to consonance/dissonance relationships between the assigned chord and the notes of at least two of the time segments.

Preferably, each of the time segments is a moment that begins with the appearing of a note and ends with the appearing of another note.

Preferably, the consonance/dissonance relationships include existence or absence of a dissonant between a chord assigned to a time segment and a note of the time segment, and/or existence of resolution to said dissonant.

Optionally, the score comprises monophonic music with accompaniment, alternatively or additionally, the score comprises monophonic music without accompaniment, alternatively or additionally, the score comprises polyphonic music.

In an embodiment of the invention, the method comprising considering each note of the score, in determining the assigned chords.

Preferably, the assigned chords reflect the flow of harmonic changes in the score.

In an exemplary embodiment of the invention, the method comprising:

(a) determining at least one trial chord for each time segment;

(b) selecting one of the trial chords for each of the time segments, responsive to consonance/dissonance relationships between the trial chord(s) and the note(s) of the time segment; and (c) assigning chords to the time segments responsive to the selection made in (b).

Preferably, (b) comprises selecting one of the trial chords for a first time segment, responsive to consonance/dissonance relationships between the trial chord and notes of one or more time segments neighboring the first time segment. Optionally, at least one of the neighboring time segments appears in the score later than the first time segment.

In an exemplary embodiment, selecting and/or assigning comprises evaluating a function, the value of which is responsive to dissonance/consonance relationships between chords assigned to time segments and notes of time segments in the score, the function being a cost function or a value function.

In an exemplary embodiment of the invention, the method includes a chord determination procedure, wherein a trial chord is determined to each moment, responsive to consonance/dissonance relationships between the determined chord and the notes present in the moment. Optionally, the method further comprises a chord combination procedure, wherein at least one of the trial chords determined in the chord determination procedure is changed responsive to notes of an adjacent moment, thereby increasing the value function. Additionally or alternatively, the method includes a chord reduction procedure, wherein at least one of the chords assigned in a preceding procedure is changed to reduce the number of chord changes along the score and increase the value function.

Optionally, each suggested trial chord has a root note in the time segment to which it is suggested. Optionally an accidental of a note in a trial chord is the same as the accidental of the same note in its last appearance in the score. Alternatively, the accidental assigned to a virtual note, not appearing in the moment to which the trial chord is assigned, is the accidental the virtual note had in a list of scales assigned to the nearest previous moment where there was no accidental conflict for this note. Optionally, the list of scales includes scales wherein the accidentals of the notes that exist in the moment, to which the list is assigned, are the same as those that appear in said moment.

In an embodiment of the invention, the value of the function used for evaluating musical correctness of a certain chord assignment is responsive to the number of notes common to the trial chord and to the moment. Optionally, the value of the function is responsive to existence in the moment of a note that is a dissonant $7^{th}$ of the trial chord. Optionally, existence in a moment of a dissonant $7^{th}$ of a chord brings the function closer to its optimum. Optionally, the value of the function is responsive to a resolution of a dissonant. Optionally, the dissonant is a $7^{th}$. Optionally, the value of the function is responsive to a quality of the resolution.

In an embodiment of the invention, the value of the function is responsive to a distance between a dissonant and its resolution. In an embodiment of the invention, the value of the function is responsive to the number of times that the chord's root note appears in the moment. In an embodiment of the invention value of the function is responsive to the presence of a bass dissonant over the $7^{th}$, optionally, the value of the function is also responsive to a resolution of a bass dissonant over the $7^{th}$.

In an embodiment of the invention, the function is responsive to the quality of the chord, the position of the chord, presence of sustained notes in the bass, and/or presence of sustained notes in parts other than the bass.

An aspect of some embodiments of the invention provides a method for assigning chords to a musical score indicative of a sequence of moments, each moment beginning with an appearance of a note and ending with the appearance of another note, the method comprising assigning a chord to each moment; and amending the chord assignment to reduce the number of changes of chords along the score. Preferably, amending the chord assignment is to improve musical correctness of the chord assignment.

In an embodiment of the invention, the method includes assigning to each moment a chord responsive to the notes of the moment and moments following it and amending the chord assignment responsive to the notes of the moment, notes of moments following it and notes of moments preceding it.

In an embodiment of the invention, the assigning of a chord to a moment is responsive to predefined dissonance/consonance relationships between the chord assigned to the moment and notes of the moment and of following moments.

Optionally, amending the chord assignment comprises combining moments containing only single notes with a preceding moment responsive to a predefined set of parameters for each moment in a series of moments.

Optionally, the reduction of the number of chords in a sequence is responsive to a predefined set of parameters characterizing each chord in a series of chords.

Optionally, chords are reduced based on their position in a series of chords. There is also provided, in accordance with an exemplary embodiment of the invention, a method of assigning tempo parameters to moments in a musical score, the method comprising:

providing a first set of rules for assigning the tempo parameters to moments, a rule of said first set of rules being responsive to at least one rhythmical characteristic of said moments, extracting from the musical score at least one rhythmical characteristic of at least one moment of said moments; and assigning to each of said at least one moment a tempo parameter according to said first set of rules.

In an embodiment of the invention, at least one rule of said first set of rules is responsive to a time signature of the musical score.

Optionally, the at least one rhythmical characteristic comprises a position of a moment in a measure which comprises said moment.

Optionally, said at least one rhythmical characteristic comprises a smallest subdivision in a measure comprising said moment.

Optionally, according to the rules, a moment appearing last in a measure is always assigned a tempo slower than the nominal tempo.

Optionally, according to said rules of said first set of rules, a first moment, appearing last in a measure is never assigned a faster tempo than that assigned to a second moment, appearing first in the following measure, unless said first moment is assigned a tempo that is slower than a moment preceding it, in which case said second moment may be slower.

Optionally, according to said rules of said first set of rules a moment of a weaker beat is never assigned a tempo faster than that of a stronger beat following said weaker beat, unless said weaker beat is also slower than a stronger beat that precedes said weaker beat.

Optionally, according to said rules of said first set of rules a weighted average over tempo assigned to moments in a measure of the score, is essentially the same for all measures, the average being weighted by a nominal length of each moment.

Optionally, the method further comprising:

providing a second set of rules for assigning a velocity parameter to a note, a rule of said second set of rules being responsive to at least one rhythmical characteristic of said note, extracting from the musical score said at least one rhythmical characteristic of at least one note; and assigning to said at least one note a velocity parameter according to said second set of rules.

There is also provided in accordance with an exemplary embodiment of the invention a method of assigning velocity parameters to moments in a musical score, the method comprising:

providing a second set of rules for assigning a velocity parameter to a note, a rule of said second set of rules being responsive to at least one rhythmical characteristic of said note, extracting from the musical score said at least one rhythmical characteristic of at least one note; and assigning to said at least one note a velocity parameter according to said second set of rules.

Optionally, at least one rule of said second set of rules is responsive to a time signature of the musical score.

Optionally, said at least one rhythmical characteristic, to which rules of said second set of rules are responsive, comprises a position of the note in a measure comprising the note.

Optionally, said at least one rhythmical characteristic, to which rules of said second set of rules are responsive, comprises a smallest subdivision in a measure comprising the note.

Optionally, according to said second set of rules a note of a weaker beat is never assigned a velocity value higher than that of a stronger beat following it.

There is also provided in accordance with an exemplary embodiment of the invention, an apparatus for automatically performing music from a music notation file, the apparatus comprising an input for receiving a music notation file, a processor for processing the input music notation file, and an output for playing the processed music notation file; wherein the processor is configured to assign to moments tempo parameters according to at least one embodiment of the invention.

Optionally, the processor is configured to assign to notes velocity parameters according to an embodiment of the invention.

In accordance with an exemplary embodiment of the invention, there is provided an apparatus for automatically writing a computer readable music file, the apparatus comprising an input for receiving a music notation file, a processor for processing the input music notation file into a computer readable music file, and an output for writing the computer readable music notation file; wherein the processor is configured to assign to moments tempo parameters according to an embodiment of the invention.

Optionally, a processor according to an embodiment of the invention is configured to assign to notes velocity parameters according to embodiments of the invention.

There is also provided in accordance with an exemplary embodiment of the invention, an apparatus for automatically performing music or writing a computer readable music file, the apparatus comprising:

an input for receiving a music notation file, a processor for processing the input music notation file, an output for writing the computer readable music file or for playing the music, and a user interface;

wherein the processor is configured to assign tempo parameters to moments, in a method comprising extracting from the score at least one rhythmical characteristic of at least one moment, and assigning to the at least one moment tempo parameter according to a rule of a first set of rules, said rule being responsive to the at least one rhythmical characteristic, and the user interface allows affecting the rule by a user.

Optionally, the processor is configured to assign velocity parameters to notes, in a method comprising extracting from the score at least one rhythmical characteristic of at least one note, and assigning to the at least one note a velocity parameter according to a rule of a second set of rules, said rule being responsive to the at least one rhythmical characteristic, and the user interface allows affecting the second set of rules by a user.

Optionally, affecting a set of rules comprises selecting a set of rules out of at least two sets of rules.

Optionally, at least one rule of said first set of rules is provided to the processor dependent on at least one variable, and affecting said at least one rule comprises determining the value of said at least one variable.

Optionally, said variable has a continuous value.

Optionally, the apparatus comprises an editor for editing said set of rules.

BRIEF DESCRIPTION OF FIGURES

Non-limiting examples of embodiments of the present invention are described below with reference to figures attached hereto and listed below. The figures use standard music score notation; however, the invention may be implemented whatever notation is used for indicating the appearance and disappearance of sounds along the music time-line, for example MIDI notation, or frequency notation.

(FIG. 5B also illustrates beat grades)

FIG. 10 is a LUT of allowed scales;

TERMS AND NOTATIONS

Under this heading, several terms that are used in the descriptions that follow are explained. Some of these terms are generally used in the field, and some were coined to communicate embodiments of the present invention.

Notations for Notes

Figure 1:
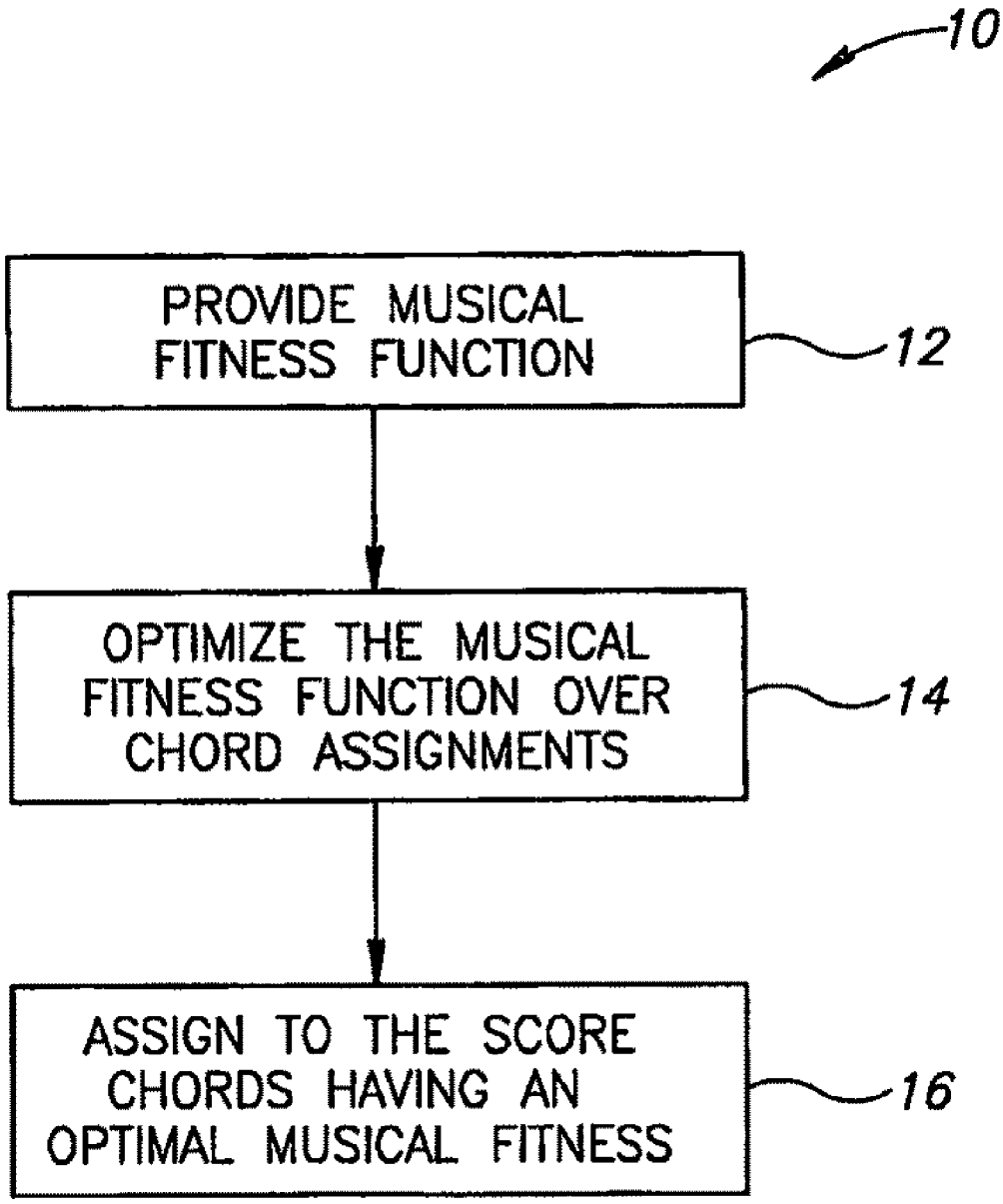
FIG. 1 (described above) is a flowchart of a harmony flow analysis method according to an embodiment of the invention.
Figure 2:
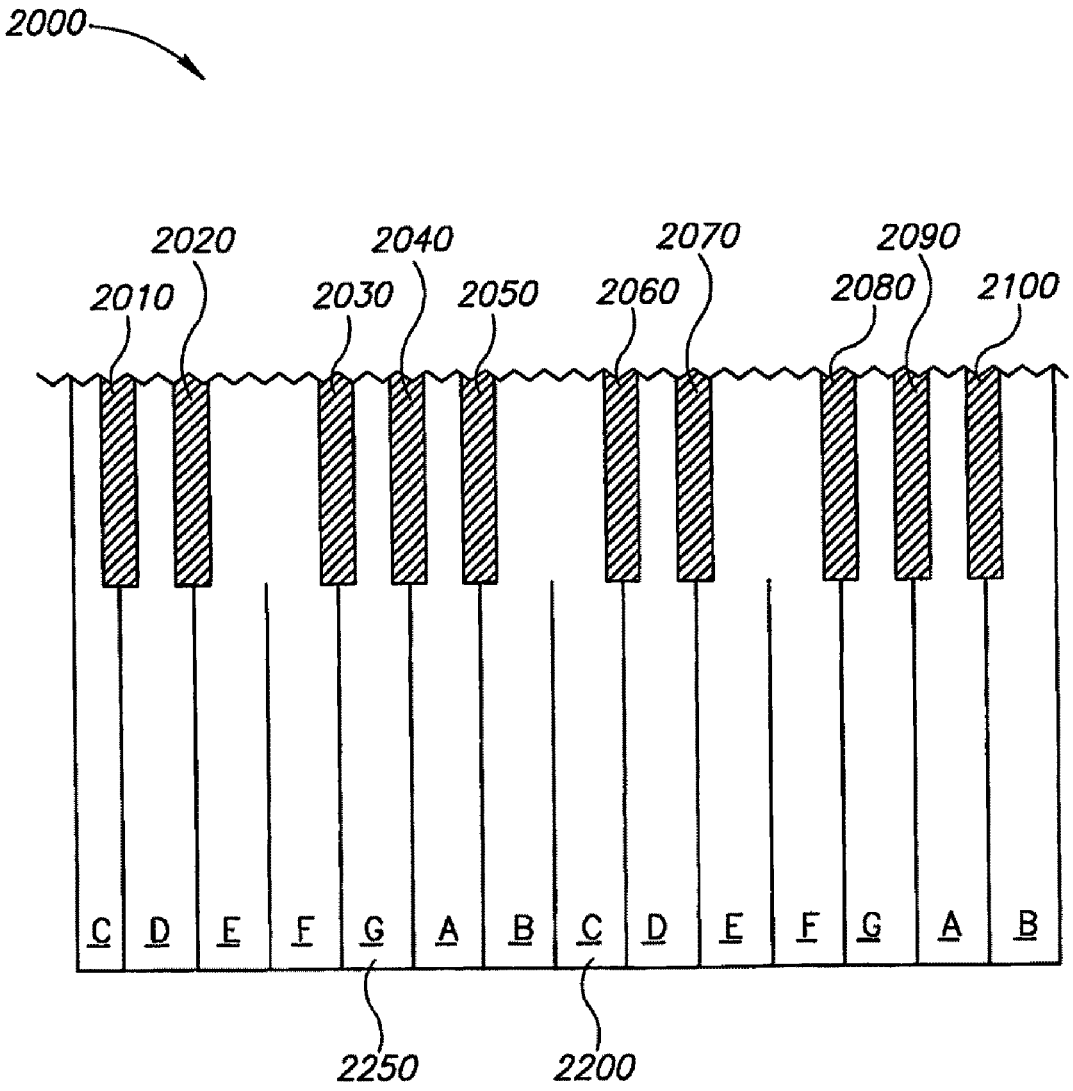
FIG. 2 is an illustration of a keyboard portion.

In the following, we relate to notes using two notation systems, namely the common notation and the TCD-HT notation. These two notations are explained herein in relation to FIG. 2, which shows a portion (2000) of a keyboard.

The keyboard portion (2000) includes 14 white keys, marked with letters A-G (starting with C), which are common names for the notes played by pressing these keys.

The keyboard portion (2000) also includes 10 black keys, marked 2010, 2020 . . . 2100. Each of these keys may have two common names, and an explanation as to which name is used in each case is not required for understanding the present application. Each of the black keys 2010-2100 is commonly named by a white key adjacent to it, and an "accidental", denoting if the black key is lower or higher than the adjacent white key. For instance, the black key 2010 may be denoted as C sharp or as D flat (with "sharp" and "flat" being the accidentals). The key 2020 may be denoted as D sharp or as E flat, etc. For completeness it should be noted that the note F may also be denoted as E sharp or G double-flat, etc.

In the TCD-HT notation, each key is denoted by two numbers: its displacement from a tone center (TCD stands for Tone Center Displacement) and its distance from the tone center, expressed in half-tones (HT stands for Half Tone). For example, if the tone center is at the C denoted as 2200, this C is denoted {0, 0}, and the key 2060 is denoted either {0, 1}, in equivalence to C sharp, or {1, 1} in equivalence to D flat. Another example: if the tone center is on the G key denoted as 2150, the key 2200 is denoted as {3, 5}.

In a score written in common notation default accidentals are defined by the key signature, which includes the sharps or flats placed after a clef to indicate the key. However, this indication is not perfect, as each major key has a corresponding minor key with the same flats and sharps, (for instance, when no sharps or flats are present, the key may be C major or A minor). In most notation software there is a requirement to mention a key, not only sharps and flats, and in the present description, a key signature refers to the strict mention of key, which implies the default flats and sharps. Accidentals that differ from the default are written in common notation next to the note, to which they refer.

Chord Notation

Generally, a chord is any combination of two or more notes, played at the same time. In the following, we shall concentrate on chords that have exactly three or four notes, referred to as triads and tetras, respectively. A triad has a root, which is the lowest note in the triad, a third, displaced two notes from the root, and a fifth, displaced four notes from the root. A tetra has a root, third, fifth, and seventh. Accordingly, in the TCD-HT notation a triad may be denoted as {0, 0}, {2, X}, {4, Y}, and a tetra as {0, 0}, {2, X}, {4, Y}, {6, Z}. Hence, if the root is at C natural, the third is E and the fifth is G and the tetra also includes B. Each of the E, G, and B that appear in the triad and tetra having the root in C natural may have five different accidentals, (natural, sharp, flat, double sharp and double flat). Out of the 25 triad combinations, the 9 triads summarized in Table I below are most useful. The right column in the table is the common name of the triads, which has two parts: the root note (C in the example) and the quality of the chord.

TABLE I

| Root | | Third | | Fifth | | |
|---|---|---|---|---|---|---|
| Common | TCD-HT | Common | TCD-HT | Common | TCD-HT | Chord |
| C natural | {0, 0} | E natural | {2, 4} | G natural | {4, 7} | C Major |
| C natural | {0, 0} | E flat | {2, 3} | G natural | {4, 7} | C minor |
| C natural | {0, 0} | E natural | {2, 4) | G sharp | {4, 8} | C Augmented |
| C natural | {0, 0} | E flat | {2, 3} | G flat | {4, 6} | C diminished |
| C natural | {0, 0} | E double flat | {2, 2} | G flat | {4, 6} | C dim-dim |
| C natural | {0, 0} | E sharp | {2, 5) | G sharp | {4, 6} | C Aug-Aug |
| C natural | {0, 0} | E flat | {2, 3} | G sharp | {4, 8} | C min-Aug |
| C natural | {0, 0} | E double flat | {2, 2} | G natural | {4, 7} | C dim-Maj |
| C natural | {0, 0} | E double flat | {2, 2) | G sharp | {4, 8} | C dim-Aug |

(Maj = major; min = minor; dim = diminished; Aug = augmented)

Chord Stability

In the present description and claims, a chord is considered stable if it passes the threshold of stability test, [or: stability threshold test] which happens in three cases:

(a) when the time segment to which it is assigned includes at least the chord's root and the chord's fifth;

(b) when the time segment to which it is assigned includes at least the chord's root, third and seventh; and (c) when the time segment to which the chord is assigned includes at least the chord's root and the chord's seventh, and the seventh has a high quality resolution, as this is defined below.

Dissonance/Consonance Relationships

When two notes are played together they may be considered to be dissonant or consonant. Consonants are frequently described by a wide variety of terms, such as: pleasant, euphonious, beautiful, smooth, fused, pure, diffuse, and relaxed. Dissonants, on the other hand, are frequently described as unpleasant, ugly, rough or tense. The question if a specific note combination is to be considered as a consonant or a dissonant may change with generations, culture, or musical style. For instance, many note combinations that were considered dissonants in the past are considered consonants in contemporary music.

In the description below, a note that is not part of the triad is said to be dissonant to that triad, and a note that is part of the triad is said to be consonant to the triad. Nevertheless, the invention is not limited to this definition of dissonance/consonance relationship.

According to an embodiment of the invention, it is preferred to assign chords that have minimal number of dissonants with the notes of the time segments of a score, and if there is no single chord with minimal number of dissonants, to assign chords, the dissonants of which find the quickest and/or best resolution.

The dissonant combinations of notes and their "resolutions", as these terms are in ordinary use in Western music are listed in table II below, using the TCD-HT notation. The term "resolution" of a dissonant is used herein in the regular sense it has in the art, and this is sometimes explained as a note that eases the uneasy feeling that the dissonant caused.

TABLE II

| Root Note | Dissonant Note | Dissonant Note Resolution |
|---|---|---|
| 0,0 | 1,1 | 0,1 |
| 0,0 | 1,1 | 0,0 |
| 0,0 | 1,1 | 2,3 |
| 0,0 | 1,2 | 0,0 |
| 0,0 | 1,2 | 0,1 |
| 0,0 | 1,2 | 2,3 |
| 0,0 | 1,2 | 2,4 |

TABLE II-continued

| Root Note | Dissonant Note | Dissonant Note Resolution |
|---|---|---|
| 0,0 | 1,3 | 2,4 |
| 0,0 | 2,2 | 1,1 |
| 0,0 | 2,5 | 3,6 |
| 0,0 | 3,4 | 2,3 |
| 0,0 | 3,5* | 2,3 |
| 0,0 | 3,5* | 2,4 |
| 0,0 | 3,5* | 4,6 |
| 0,0 | 3,5* | 4,7 |
| 0,0 | 3,6 | 2,4 |
| 0,0 | 3,6 | 4,7 |
| 0,0 | 4,6 | 3,4 |
| 0,0 | 4,6 | 3,5 |
| 0,0 | 4,8 | 5,9 |
| 0,0 | 5,10 | 6,11 |
| 0,0 | 6,9 | 5,8 |
| 0,0 | 6,10 | 5,8 |
| 0,0 | 6,10 | 5,9 |
| 0,0 | 6,10 | 7,11 |
| 0,0 | 6,10 | 7,12 |
| 0,0 | 6,11 | 5,9 |
| 0,0 | 6,11 | 5,10 |
| 0,0 | 6,11 | 7,12 |

*These are dissonants only if the {0,0} is in the bass

However, other definitions are also possible, and may be useful with the present invention. For instance, it is possible to define minor seconds (0, 0), (1,1) as dissonants and major seconds (0, 0), (1, 2) as their resolution.

Quality of Dissonant Seventh Resolution

In some embodiments of the invention, resolutions of $7^{th}$ dissonant are defined as being of high or low quality as follows:

If the dissonant is a major seventh, which in TCD-HT notation format is ({0,0}, {6,11}), and the {6,11} is replaced with either a {7,12} or a {5,9}, the resolution is of high quality.

If the dissonant is a minor seventh ({0,0}, {6,10}) and the {6,10} is replaced with a {5,9} or with a {5,8}, the resolution if of high quality.

If the dissonant is a minor seventh ({0,0}, {6,10}) and the {6,10} is replaced with a {7,12}, the resolution is of low quality.

If the dissonant is a diminished seventh ({0,0}, {6,9}), there is only one (high quality) resolution, which is {5,8}.

All other possibilities are not considered a resolution.

Chord Relationships

In music theory it is common to define Dominant-Tonic relationships (and Tonic-Dominant relationships) between chords. Herein, we refer to these relationships as strict, and define broader relationships, referred herein as quasi Dominant-Tonic and quasi Tonic-Dominant. All these relationships are defined below:

A strict Dominant-Tonic relationship exists between two chords in each one of the following two cases:

a) there is a root relationship of {0,0}, {3,5} between the chords, the chord built on {0,0} is major and the chord built on {3,5} is either major on minor (for instance: C major-F major or C major-F minor);

b) there is a root relationship of {6,11}, {0,0}between the chords, the chord built on {6,11} is diminished and the chord built on {0,0} is either major on minor (for instance, B diminished-C major or B diminished-C minor).

A quasi Dominant-Tonic relationship exists between two chords in each one of the following cases:

a) there is a root TCD relationship of 0, 3 (the quality of the two chords doesn't matter);

b) there is a root TCD relationship of {0,0}, {1,1} in which the chord built on {0,0} is diminished or diminished-diminished, and the quality of the other chord doesn't matter.

A strict Tonic-Dominant relationship exists if there is a root relationship of {0,0}, {4,7} between the chords, the chord built on {0,0} is either major or minor and the chord built on {4,7} is major.

A Quasi Tonic-Dominant relationship exists only between chords in which the root TCD relationship is 0, 4, regardless of the quality of either chord.

Virtual Notes

To assign chords according to some embodiments of the invention, it is sometimes required to consider notes that are not present in the time segment to which a chord is being assigned. These notes are referred to herein as virtual notes. For instance, according to an exemplary embodiment of the invention, each time segment of the score is assigned a triad having a root in one of the notes that appear in the same time-segment. The triad notes that appear in the time segment are referred to as existing notes, and these that do not appear in the time-segment (if any) are referred to as virtual notes.

As described above, each root note may be associated with 9 different triads, depending on the accidentals of the third and the fifth. In one exemplary method, the accidentals of existing notes are those that appear in the moment, and the virtual notes are assigned accidentals based on accidentals that appeared in earlier time segments in the score, as described below.

It should be noted, that unless otherwise indicated in the score, accidentals of existing notes are determined in accordance with the key signature of the score.

Timing Markings

Timing markings are all the marks used to indicate when each note begins and when it ends. Some examples to such markings are subdivision (1/4, 1/8, etc.), tempo, and articulation markings such as 'staccato' 'tenuto', etc.

Subdivisons

Subdivisions indicate nominal ratios between the lengths of notes, for instance, a note written in a subdivision of 1/8 occupies half the time segment of a note written in a subdivision of 1/4. Human performers use subdivisions as general guidelines rather than as indications for mathematical relations between the lengths of different notes. Playing notes precisely according to their mathematical subdivision sounds musically 'erroneous'. The invention concerns automatically deviating from the nominal ratios indicated by the subdivision in a way that makes the performance sound more rhythmically correct.

Tempo

Tempo (plural: tempi) is a measure of the swiftness by which a musical score or portion thereof is to be performed. The tempo is sometimes indicated in scores by means of general instructions, such as "fast", "slow", "lively", etc. and sometimes by precise metronome indication, for instance: ♪=60, which means that 60 1/8 s notes are to be played per minute, or that each ♪note occupies a time segment of 1 second. In conventional music notation a single tempo is usually indicated for an entire score or a large portion thereof. In the context of the present application tempo is assigned to each moment, and thus, together with the general tempo indication and the note-length, determines the period of time from the beginning of the moment to the beginning of the next moment. For instance, if the score includes an explicit tempo indication of ♪=60 and a certain 1/8 note in the score is assigned according to the invention a tempo parameter of 120%, this 1/8 will be played for 1/(60*120%) minutes =1/72 minutes.

Time Signature

Time signature is the number of times the listed subdivision appears in the measure, for example, in 4/4, there are 4 quarter-notes in each measure.

Time signature unit—a subdivision of a length 1/X, with X being the denominator in the time signature.

Beat

Beat is used in the present application to indicate the degree to which a moment is accented in relation to another moment within a measure. Optionally, moments are grouped only in pairs or triplets. For example, if 4 quarter-notes are present in a measure in 4/4, the $1^{st}$ and $3^{rd}$ beats are more accented than the $2^{nd}$ and $4^{th}$, thus the relation between the $1^{st}$ and $2^{nd}$ beat is referred to as strong/weak and the relationship between the $2^{nd}$ and $3^{rd}$ beats is weak/strong. Likewise, the $1^{st}$ beat is stronger than the $3^{rd}$, and the $2^{nd}$ stronger than the $4^{th}$. In a triple meter, (3/4, for example), the $1^{st}$ beat is the strongest, the $2^{nd}$ is weaker than the $1^{st}$ and the $3^{rd}$ is weaker than the $2^{nd}$. Thus, beats may be graded 'higher' or 'lower'.

DETAILED DESCRIPTION OF SPECIFIC EMBODIMENT

Automatic Analysis of Harmonic Changes

Overview

A musical score is a representation of appearing (and disappearing) of sounds along a time-line.

Figure 3:
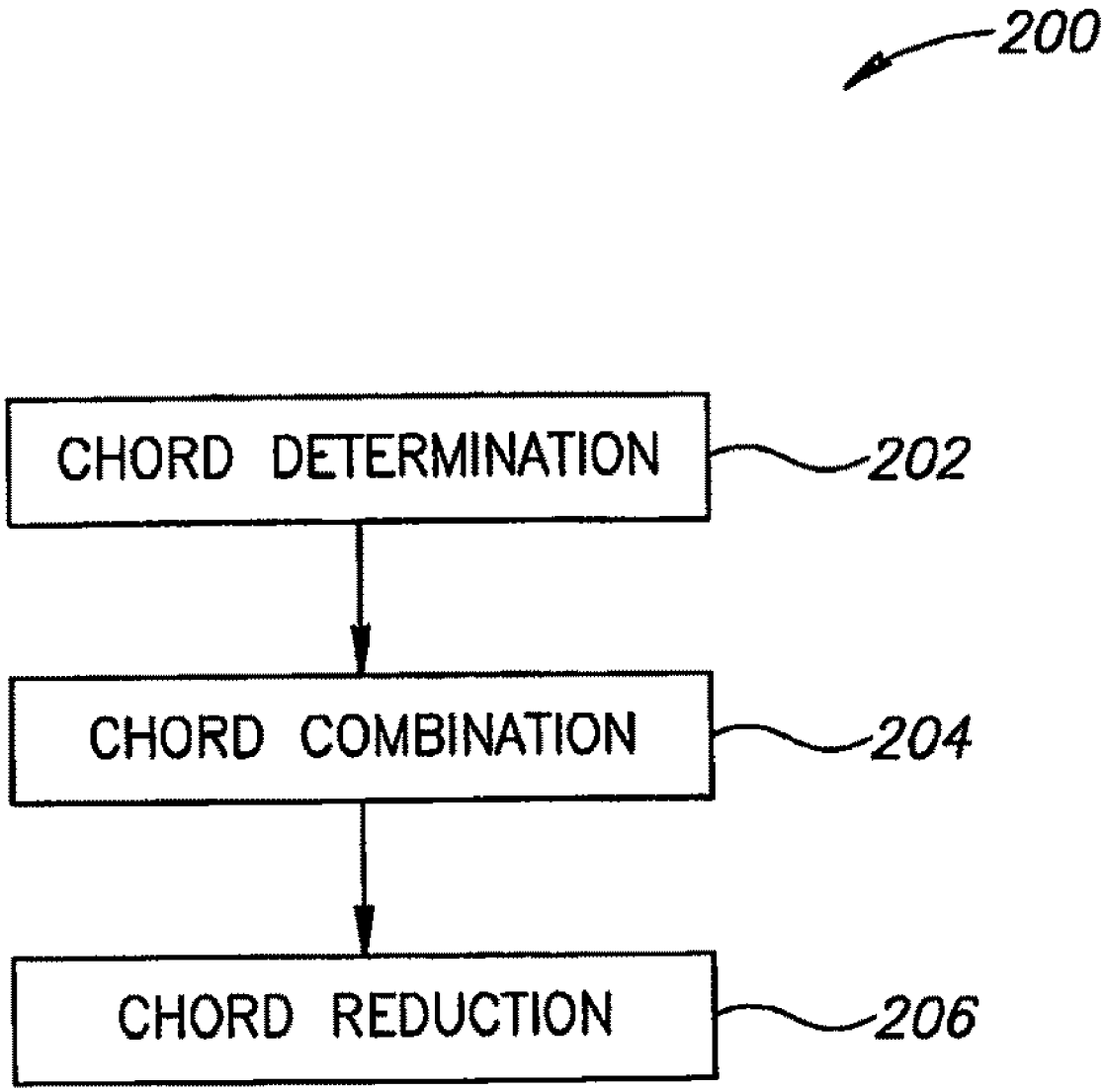
FIG. 3 is a flow chart of a method for assigning chords to a musical score according to one embodiment of the invention, including three procedures.

In an exemplary embodiment of the invention, the music timeline is first segmented into moments, infrastructure for finding accidentals of virtual notes is prepared, and then, chords are assigned to segments as described in FIG. 3, which is a flowchart of a method (200) according to this embodiment. In the chord determination stage (202), a chord is assigned to each time segment. This stage may stand on its own, and provides satisfactory results for certain simple musical scores. However, when applied to more complex musical scores, this procedure results in too frequent chord changes and relatively low musical correctness. To allow optimal number of chord changes the procedures "chord combination" (204) and/or "chord reduction" (206) are optionally used.

The procedure "chord combination" (204) is made to reduce the number of chord changes along the music timeline. It relates to two consecutive time segments, and optionally defines a common chord to both (referred to as a 'merged chord'). Optionally, the common chord is determined using the chord determination procedure.

Optionally, in the chord combination stage (204) time segments are not combined if the chords assigned to them have strict or quasi Tonic-Dominant or Dominant-Tonic relationship. The detailed rules applied in the "chord combination" procedure according to a preferred embodiment are detailed below.

Optionally, the results of the "chord combination" procedure (204) are the final results of the method, as they are satisfactory for many musical scores. Alternatively, a reduction stage takes place.

In the reduction stage (206), the possibility to combine groups of time segments under a common chord is considered. The possibility to combine is usually turned off if it results in the elimination of a chord that has a strict Tonic-Dominant or Dominant-Tonic relationship with the chord of the following time segment. The detailed rules for chord reduction according to a preferred embodiment are shown in the look-up-table annexed to U.S. provisional patent application No. 60/821,744, incorporated herein by reference, as annex II.

Optionally, the chord reduction procedure is run more than once. In an exemplary embodiment it is run once and again until it does not change the chord assignment any more.

Figure 4:
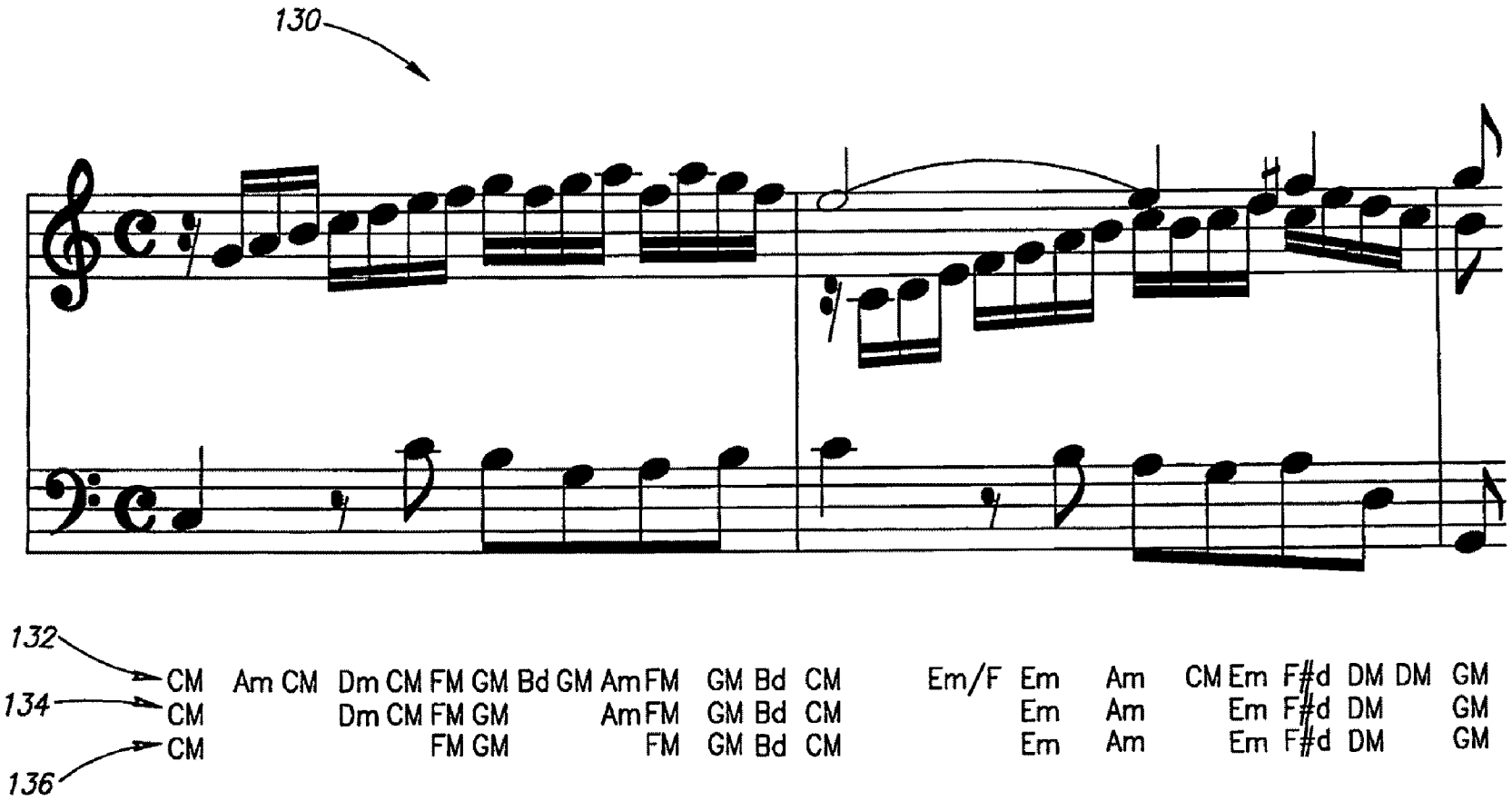
FIG. 4 shows two measures from a "Three-part Invention" by J. S. Bach, together with the chords assigned to it according to an exemplary embodiment of the invention.

Results of chord combination and reduction are presented in FIG. 4, which shows two measures from a "Three-part Invention" by J. S. Bach, together with the chords assigned to it in these stages.

The method used for the analysis shown in FIG. 4 is described in detail below.

Timeline Segmentation

Figure 5A:
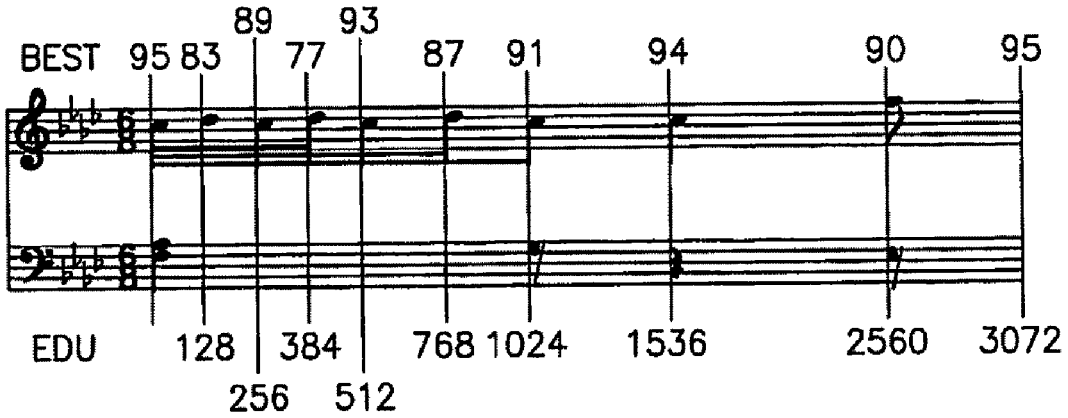
FIG. 5A is a musical score, in a conventional notes notation, showing the concept of moments and beat grades as used in the description of the other figures.

In an exemplary embodiment, the musical score is treated as being made of time segments, each of which begins with the appearing of a first note and ends with the appearing of another note, whether or not the first note disappeared. This kind of segment is referred herein as a moment. Some examples to the use of this term are provided in FIGS. 5A-5D. FIG. 5A shows a portion of the score of Mozart piano sonata K. 282 where borders between adjacent moments are shown by thin vertical lines. As may be seen in the figure, different moments in a score may have different time lengths. For instance, in FIG. 5A the first moment has a length of 128 EDU's (Elapsed Duration Units), and the last moment has a length of 512 EDU's. The last three moments in FIG. 5A have one note each, and all the other moments have three notes each: two (F and A flat) played by the left hand, and the third (C or D flat) played by the right hand.

Figure 5B:
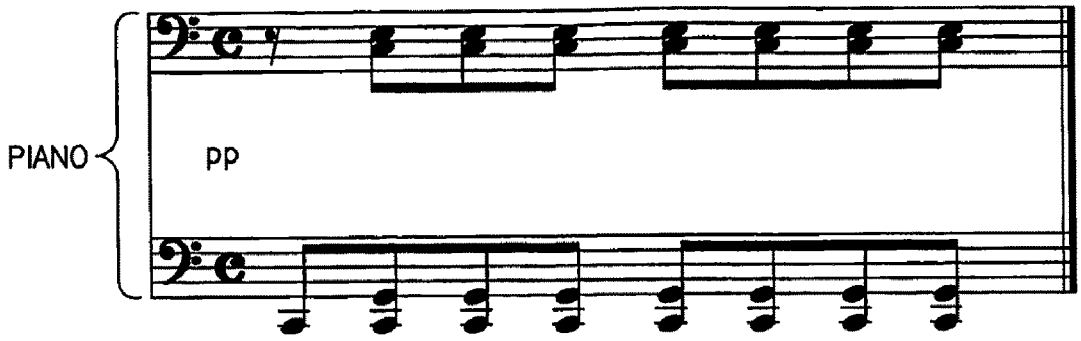
FIGS. 5B, 5C, and 5D show three short scores with various numbers of moments.
Figure 5C:
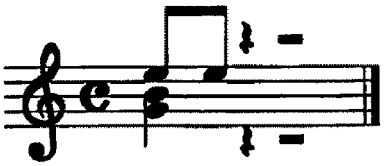

As a result of the analysis, it may be found that several sequential moments are assigned a common chord, and a time segment consisting of such a sequence of moments is referred herein as a "super moment". Two such examples are provided in FIGS. 5B and 5C. In FIG. 5B, showing the first measure of Beethoven's "Waldstein" sonata, there are shown 8 moments. According to the rules described below, they form a super-moment that includes all 8 moments, and assigned a C Major chord. Similarly, FIG. 5C shows two moments that can be merged into one super moment.

Figure 5D:
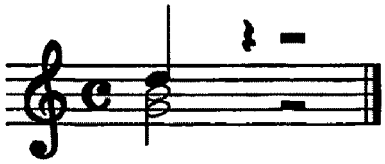

FIG. 5D shows a score with one note that disappears while another continues. The score in FIG. 5D is considered to consist of 1 moment.

Determining Accidentals of Virtual Notes

Figure 6:
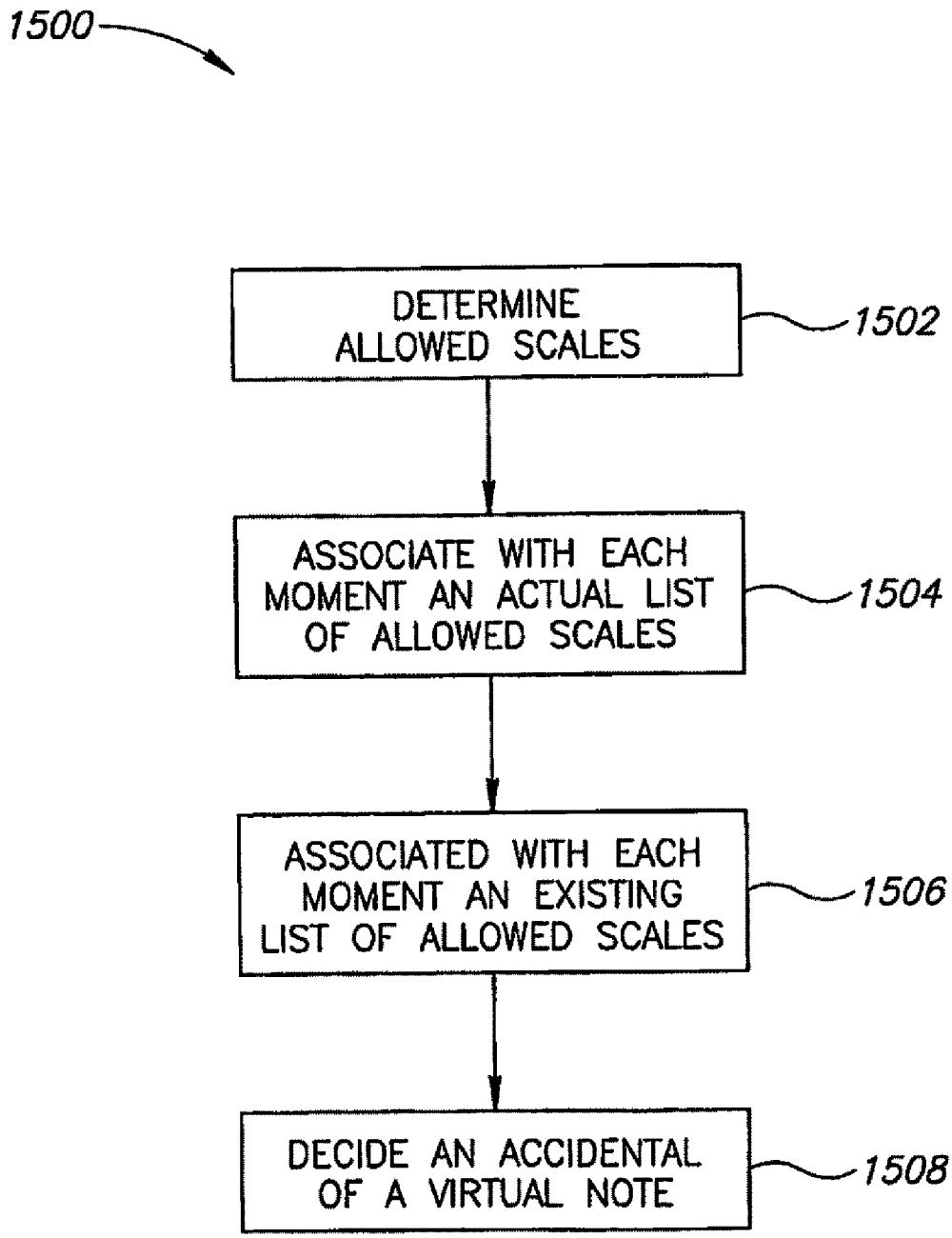
FIG. 6 is a flow chart of a method for assigning scales to moments, as to provide infrastructure to assign accidentals to virtual notes according to an exemplary embodiment of the invention.
Figure 7:
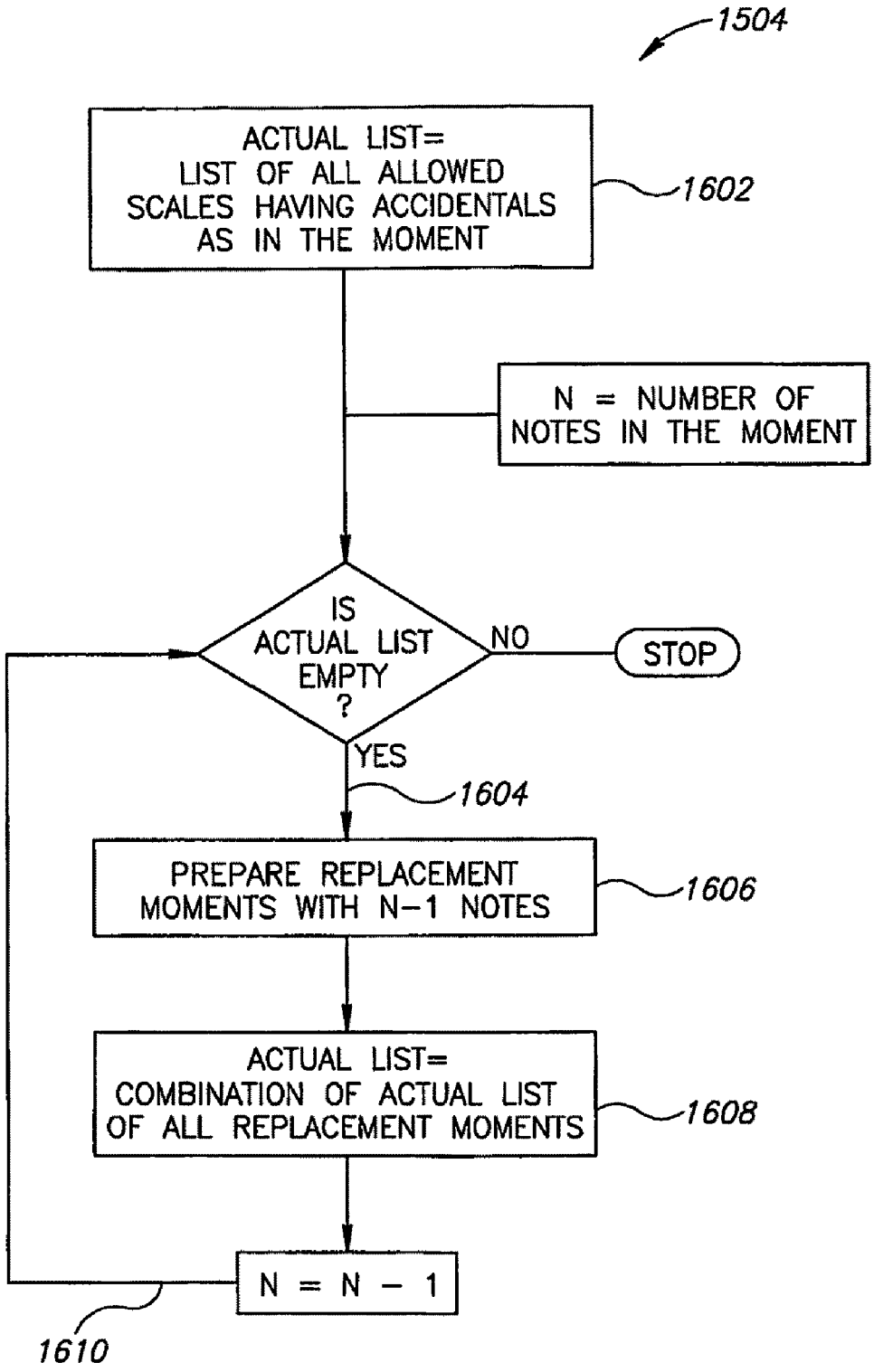
FIG. 7 is a flow chart of a method for carrying out the first step in the method described in FIG. 6.
Figure 8:
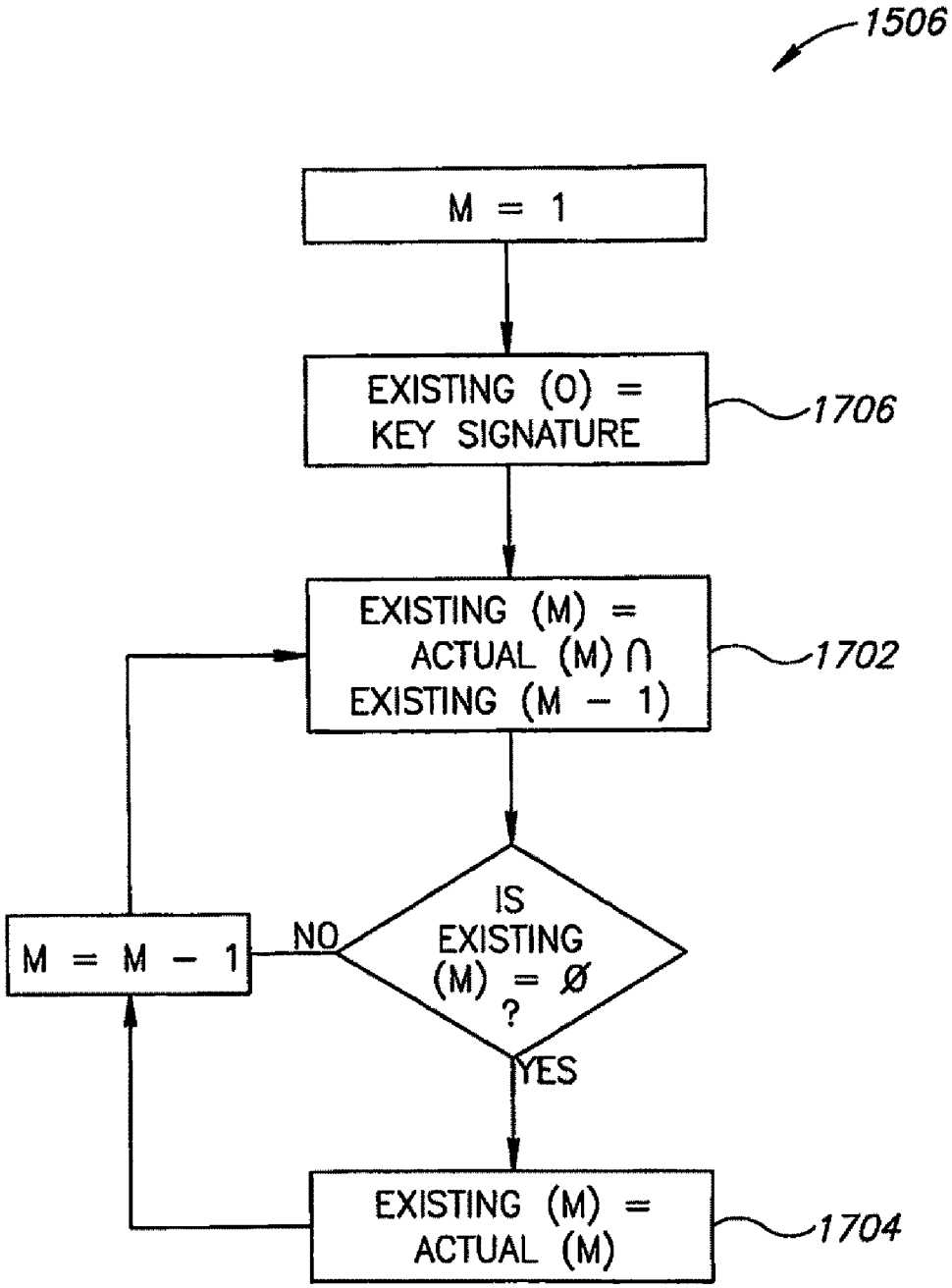
FIG. 8 is a flow chart of a method for carrying out the second step in the method described in FIG. 6
Figure 9:
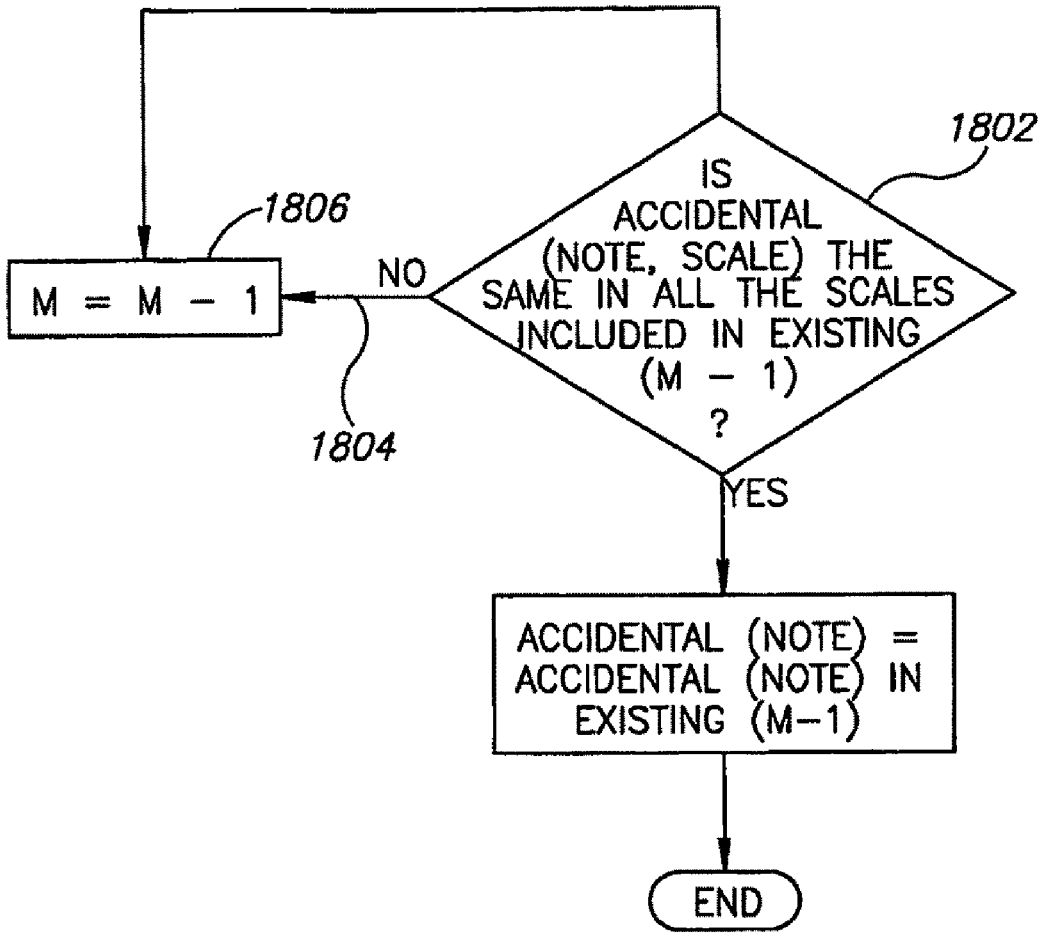
FIG. 9 is a flow chart of a method for assigning accidentals to virtual notes according to an exemplary embodiment of the invention, based on infrastructure, which is optionally prepared in accordance with the method of FIG. 6

According to a preferred embodiment of the present invention, to decide on an accidental of a virtual note, infrastructure for making the decision is prepared as shown in FIGS. 6-8. Based on this infrastructure, an accidental is determined as shown in FIG. 9.

FIG. 6 is a flow chart (1500) of a process having three acts: first (1502), allowed scales are determined; second (1504), an actual list of scales is associated with each moment; and third (1506), an existing list of scales is associated with each moment, based on its actual list and on the existing list of the preceding moment. In a final fourth act (1508) the accidental of a virtual note is decided in accordance with the accidentals appearing in the existing list of preceding moments. The first three actions may be carried out before any virtual note is identified, as preparing the infrastructure for determining accidentals of virtual notes, once required. The four actins are described in detail below.

Determining the Allowed Scales

There are many ways to decide on which scales are allowable, and each may be valid for a certain kind of music. For tonal music, it is a good option to include all the major and minor scales in the allowed scales, and in the minor scales to use the so-called "harmonic" scale, which contains a "raised"

$7^{th}$ note (or "leading tone") instead of the "natural" $7^{th}$ note. A complete list of the allowed scales in this case is provided in FIG. 10.

Compiling the Actual Lists of Scales

An actual list of scales is associated with each moment as shown in the flow chart of FIG. 7. The list (1602) includes all the allowed scales that include the notes with their accidentals that exist in the moment. For instance, if a moment has only G sharp in it, the actual list of this moment includes all the allowed scales wherein G appears with a sharp. As may be deduced from the table of FIG. 10, these are A minor, A major, G sharp major, G sharp minor, E major, B major, F sharp major, F sharp minor, C sharp major and C sharp minor.

If none of the allowed scales match all the notes with their accidentals present in the moment (1604), actual lists are prepared for replacement moments, each having all the notes of the moment absent one (1606), and the actual list of the moment is the combination of the actual list of the replacement moments (1608). If all the replacement moments don't have a matching scale, the process is repeated (1610), this time omitting two of the notes in each of the replacement moment. Further repetitions may be carried out as required. A matching scale cannot be found when a moment includes the same note twice, each time with a different accidental (conflicting notes) or, more generally, when the moment includes notes that do not appear together in any of the allowed scales, for instance D sharp and F natural. Determining the existing lists of scales To determine an existing list of scales, the actual list associated with a particular moment (number M in the score, see FIG. 8) is compared with the existing list associated with the preceding moment. If the two lists have common scales, the existing list of the particular moment includes all these common scales, and only them (1702). Otherwise, the existing list of the particular moment is identical to the actual list of the same particular moment (1704).

For the first moment, the key signature is considered to be the existing list of the moment preceding it (1706).

Determining an Accidental to a Virtual Note

As described in FIG. 9, the accidental of a particular virtual note in a particular moment is the accidental of the same note in the conflict-free existing list of the nearest preceding moment. An existing list is conflict-free for a note, if all the scales appearing in the list have for this note the same accidental (1802).

Thus, if the existing list of the $(M-1)^{th}$ moment has an accidental conflict for a Virtual Note (N) of the $M^{th}$ moment (1804), the accidental of that note will be the one it has in the existing list of the $(M-2)^{th}$ moment (1806), unless this list also has a conflict for the note N, in which case the existing list of moment M−3 is checked, and so on.

Chord Determination (202 in the Flowchart of FIG. 3)

In this procedure, a chord is assigned to each moment. The assigned chord is referred below as a moment's chord.

Figure 11:
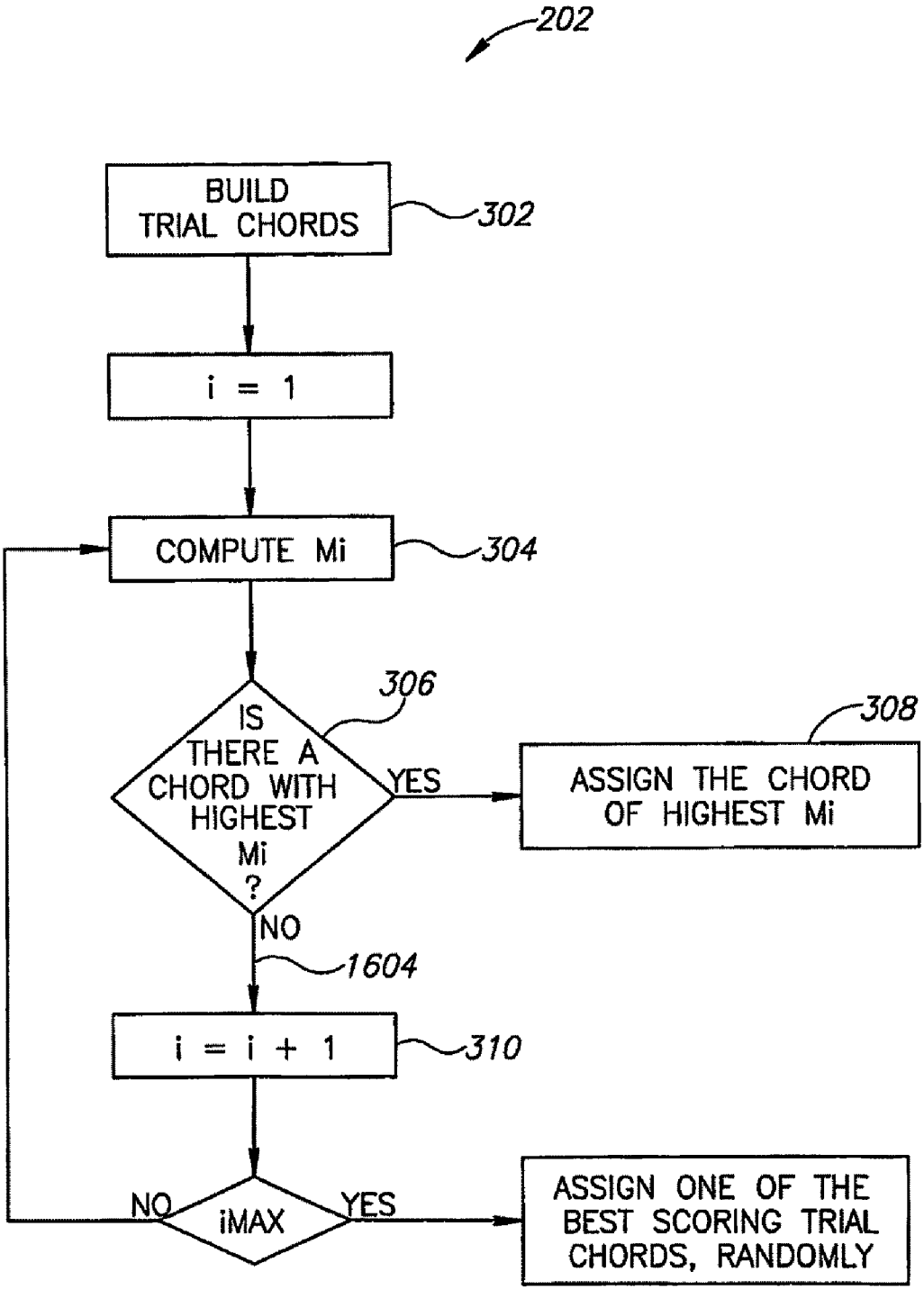
FIG. 11 is a flow chart of one procedure, titled chord determination, optionally used in the embodiment of FIG. 3.

FIG. 11 is a flow chart describing the chord determination procedure 202.

In the embodiment shown in FIG. 11, a triad having a root in one of the moment's notes is the chord assigned to the moment. If the moment has more than one note, trial triads are built on each note present in the moment and the different trial triads are scored in accordance with up to 9 different factors, and the highest scoring triad is assigned. Optionally, the factors considered in deciding which triad is assigned to the moment are provided in a hierarchical order, such that if a chord is best fitting a moment according to one factor, all factors under it in the hierarchy become irrelevant to the chord determination. Accordingly, the chord determination procedure optionally includes determining trial chords (302), computing one term $M_i$ of the musical fitness function (304) based on the trial chord and checking (306) if one of the trial chords has $M_i$ value greater than all other trial chords. If in the affirmative: this chord is assigned to the moment (308). Otherwise, i is increase by 1 (310), and step 304 is re-executed, but this time, disregarding the chords that scored lower in the previous step.

If all the factors were considered and no chord had a highest score, one of the higher scoring chords is assigned randomly. If the different terms are computed as described below, it is doubtful if such a case is possible theoretically, and if it is, it is extremely rare in practice.

The hierarchical arrangement of factors of the embodiment of FIG. 11 provides ease of computation, and allows concentrating the attention (and the computational efforts) only at factors of crucial practical importance.

Other embodiments of the invention may take into consideration only some of the factors considered below. Alternatively or additionally, other factors may be considered. Optionally, the factors considered below may be weighted in a different manner.

Optionally, after a chord is assigned to a moment in the chord determination procedure, a chord is assigned to the next moment by the same procedure. Alternatively, after a chord is assigned to a moment in the chord determination procedure, the chord combination procedure is applied on the newly assigned chord and the chord of the preceding moment, and only then a chord is assigned to the next moment by a chord determination procedure.

Computing the Various Terms $M_i$

Optionally, the terms $M_i$ are computed for all the allowed chords. Preferably, they are computed only for a limited number of trial chords. It is useful to compute it only for chords having their root in the moment. Thus, in a preferred embodiment of the invention, a 'perfect' triad (or tetra) is built on each one of the notes in the moment to provide trial chords. A 'perfect' triad or tetra is one that its virtual notes have accidentals that fit the key environment, for instance, in accordance with the procedure described above.

Computing $M_1$

The term $M_1$, named "note count", is based on the number of notes the trial triad has in common with the notes of the moment, and in some cases is also responsive to the existence of seventh dissonants, and the existence and quality of their resolutions.

The note count term is optionally computed in two stages:

(1) first, $M_1$ value of each trial chord is set to the number of notes common to the moment and to the trial chord. If one of the trial chords has a higher $M_1$ value than all the other trial chords, this chord is assigned to the moment and the chord determination procedure is concluded for this moment.

(2) If further computation stages are needed, the value of $M_1$ is increased according to the following rules:

- $M_1$ increased by 1, if a seventh dissonant exists and has a high quality resolution;
- $M_1$ is increased by 0.67 if the third and/or the fifth exist in the moment and a seventh dissonant exists and has a low quality resolution;
- $M_1$ is increased by 0.34 if the third and/or the fifth exist in the moment and a seventh dissonant exists and does not have a resolution;
- otherwise $M_1$ is left unchanged.

As an example of a case in which the first stage suffices: if a moment appears in a key environment with no sharps or flats, and the notes of the moment are C, E, and G, the trial chords are C-E-G, E-G-B, and G-B-D, and their note count values (as computed in stage 1) are 3, 2, and 1 respectively. Therefore, the trial chord C-E-G is assigned to the moment.

As an example of a case in which the second stage is required: if a moment appears in an environment with no sharps or flats, and the notes of the moment are C, E, B and D, at the end of stage 1 the note count value is 2 for the chords built on C, E and B and the final note count values are decided by considering the dissonant 7th. Since the seventh is found for two chords: the one built on C and the one built on E, and both contain 2 triad members, the note-count values of the chords built on C and E are raised according to the quality of the resolution of the seventh, which determines the final value of the note count term. If either seventh has a higher-quality resolution, the chord with that higher-quality resolution is assigned to the moment. If neither seventh has a resolution quality advantage, or if both sevenths have no resolution at all, the method continues to step 310 and evaluation of the next term.

Computing $M_2$

The term $M_2$ is named "dissonant score", and is higher as the number of unresolved dissonants decreases.

Optionally, in computing dissonant score, only dissonant notes other than the $7^{th}$ are considered.

Optionally, the value of $M_2$ is as follows:

$M_2$=4, in absence of dissonant notes;

$M_2$=3, in the presence of dissonant notes, all of which having resolutions;

$M_2$=2, in the presence of one dissonant note without resolution;

$M_2$=1, in the presence of two dissonant notes without resolution; and $M_2$=0, in the presence of three or more dissonant notes without resolution.

Resolutions are looked for within the following few moments so long as the dissonant note is present in these following moments and/or the following moments do not contain more than one additional dissonant note.

Figure 12:
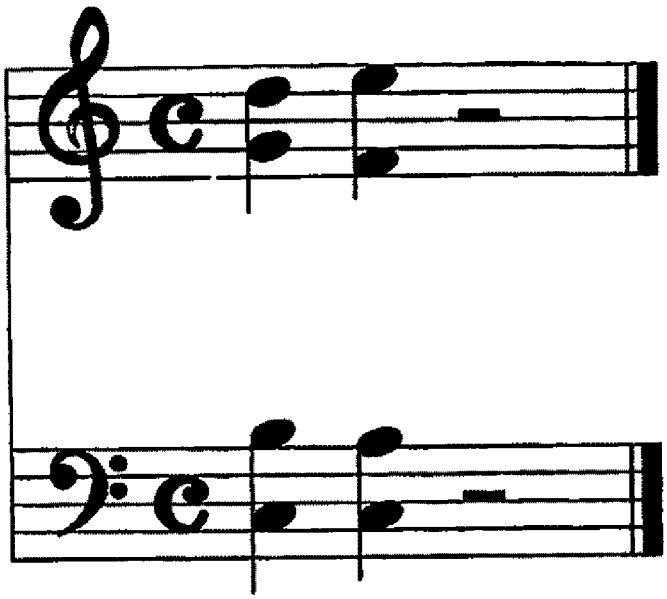
FIGS. 12, 13, 14, 15, 16A, 16B and 17 show exemplary scores and score portions, the chord assigned to the first (or only) moment of which are decided using different terms of a musical fitness function.

FIG. 12 shows a short score, wherein the chord of the first moment is determined by the dissonant score term. In the first moment of FIG. 12, both the trial chord built on C and the trial chord built on G have $M_1$ value of 3, but the trial chord built on C has $M_2$ value of 3 since the dissonant $7^{th}$ (the note B) has a high quality resolution (the note A) in the next moment and the trial chord built on G has $M_2$ value of 2, since the note C (in the bass) is dissonant to the chord and has no resolution in the next moment. Therefore the chord built on C is assigned to this moment.

Computing $M_3$

The term $M_3$ is named "dissonant resolution distance", and it is increases as the distance (in moments) between a dissonant note (including the $7^{th}$) and its resolution is reduced.

Figure 13:
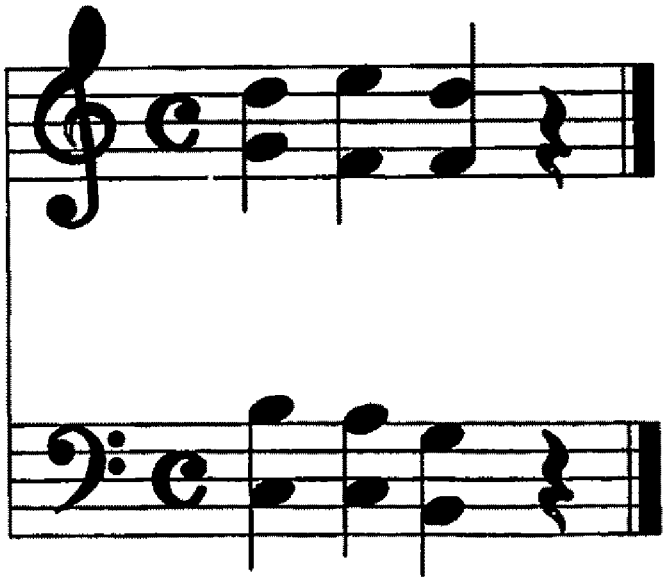

FIG. 13 illustrates a short score, wherein the term $M_3$ is required in order to determine the chord assigned to the first moment, since both the trial chord built on C and the trial chord built on G have $M_1$ value of 3 (as the note B is a seventh dissonant of the chord built on C, and it has a high quality resolution, as this term is defined above, in the second chord) and $M_2$ value of 3, that is, both chords have dissonants other than the $7^{th}$, and all dissonants are resolved. In computing $M_3$ it is taken into consideration that the trial chord built on C has a dissonant (the note B) that is resolved in the second moment (the note A), while in the trial chord built on G the dissonant note C (in the bass) is resolved to the note B only in the third moment. Therefore the chord assigned to this moment is decided by $M_3$ and will be the chord built on C.

Computing $M_4$

The term $M_4$ is named "root in bass", and is the number of repetitions of the root note in the moment. If the root is not in the bass, $M_4$=0.

Figure 14:
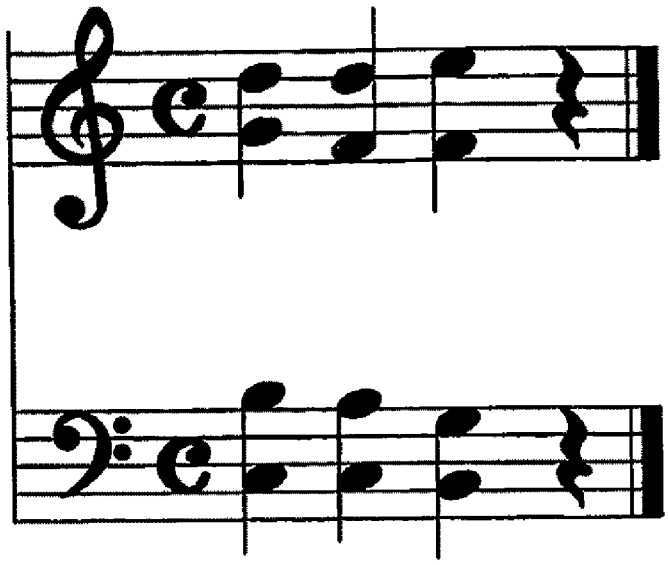

FIG. 14 shows a short score, wherein both the trial chord built on C and the trial chord built on G (in the first moment) have $M_1$ value of 3, $M_2$ value of 3, and equal $M_3$ value, but the trial chord built on C has $M_4$ value of 1 (because C is the lowest note in the moment) and the trial chord built on G has $M_4$ value of 0. Hence, the decision regarding the chord assigned to the first moment in this score is based on the "root in bass" term and the chord built on C is assigned to the first moment.

Computing $M_5$

The term $M_5$ is named "bass dissonant over the 7th" and optionally has the following values:

$M_5$=2, if the moment has no bass over the trial chord's 7th;

$M_5$=1, if the moment has a bass over the trial chord 7th that has a resolution; and $M_5$=0, if the moment has a bass over the trial chord 7th, and this bass has no resolution.

A moment is considered to have a bass over the 7th of a trial chord if the lowest note in the moment is not a member of the perfect tetra of the trial chord.

Figure 15:
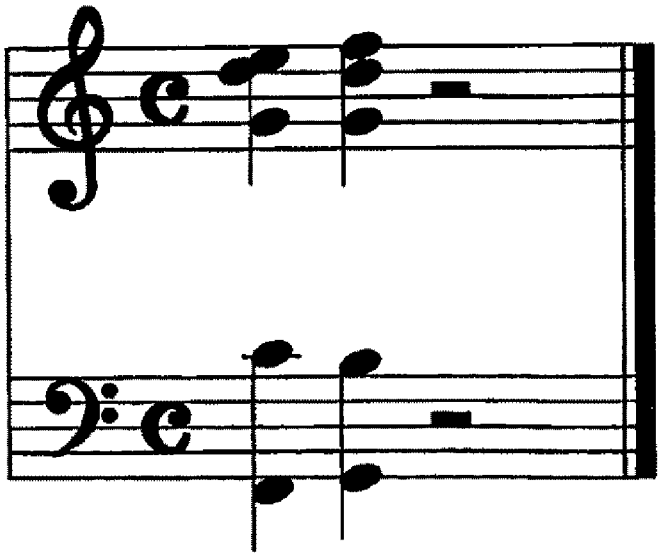

FIG. 15 shows an example of a score portion where the first moment in the portion is assigned a chord according to $M_5$. In this moment both the trial chord built on C and the trial chord built on D have $M_1$ value of 3, $M_2$ value of 2, $M_3$ value of 0 and $M_4$ value of 0, but the trial chord built on D has $M_5$ value of 2 and the trial chord built on C has a $M_5$ value of 0 (note that F, which is the bass in the first moment, is not a member of the tetra built on C but is the $3^{rd}$ of the chord built on D). Accordingly, the chord built on D is assigned to the first moment.

Computing $M_6$

The term $M_6$ is named "chord quality" and its value is as follows:

$M_6$=0 if the third and/or the fifth are not present in the moment; otherwise:

$M_6$=2, if the chord is a major chord;

$M_6$=1, if the chord is a minor chord; and $M_6$=0, in all other cases.

Figure 16A:
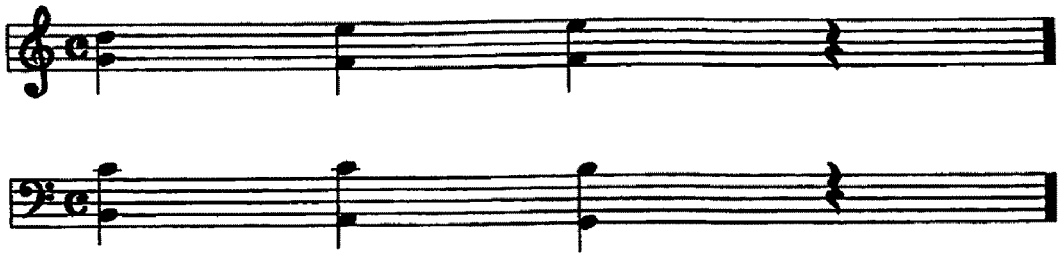
Figure 16B:
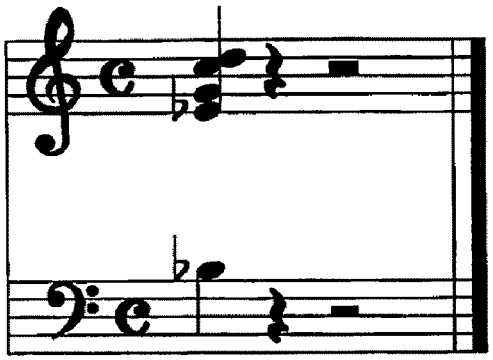

Examples where the assigned score of the first moment is decided according to $M_6$ are shown in FIGS. 16A and 16B. In the first moment depicted in FIG. 16A both the trial chord built on C and the trial chord built on G have the same value for all the terms from $M_1$ to $M_5$, but the trial chord built on G is major and both third and fifth are present and therefore has $M_6$ value of 2; the trial chord built on C has $M_6$ value of 0 since the third (E) is not present in the moment. Therefore the chord built on G is assigned to the first moment.

In the moment shown in FIG. 16B both the trial chord built on C and the trial chord built on E flat have $M_1$ value of 3.34, $M_2$ value of 1, $M_3$ value of 0, $M_4$ value of 0 and $M_5$ value of 2, but the trial chord built on C has $M_6$ value of 1, and the trial chord built on E flat has a $M_6$ value of 2 (note that the chords are C minor and E flat Major). Therefore the chord built on E flat is assigned to the first moment.

Computing $M_7$

The term $M_7$ is named "chord position" and it optionally has the following values:

$M_7$=3, if the root is in the bass (that is, the lowest note in the moment is the root of the trial chord);

$M_7$=2, if the third is in the bass;

$M_7$=1, if the fifth is in the bass; and $M_7$=0, in all other cases.

Figure 17:
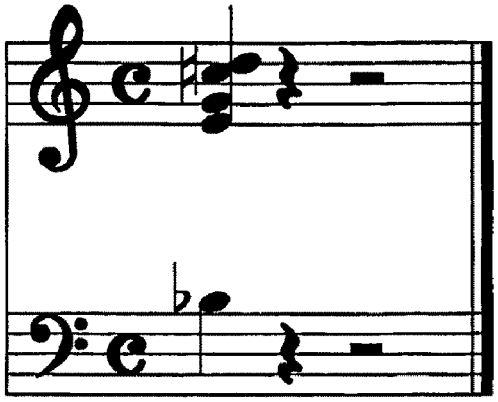

FIG. 17 shows an example of a score having one moment, to which a chord is assigned according to the value of $M_7$.

Here, both the trial chord built on C sharp and the trial chord built on E have $M_1$ value of 3.34, $M_2$ value of 1, $M_3$ value of 0, $M_4$ value of 0, $M_5$ value of 2 and $M_6$ value of 0, but the trial chord built on C sharp has $M_7$ value of 0 and the trial chord built on E has $M_7$ value of 1. Therefore the chord built on E is assigned to the first moment.

Terms $M_1$ to $M_7$ are sufficient to decide a chord in almost any given situation. In some very rare cases, not yet encountered by the inventors, the following terms may be used.

Computing $M_8$

The term $M_8$, named "sustained notes in the bass" may be computed to prefer chords having sustained notes in the bass in at least three consecutive moments in which there is at least one new note in each moment. Optionally, the values of $M_8$ are as follows:

$M_8$=1, if there is a sustained note in the bass; and $M_8$=0, otherwise.

Computing $M_9$

The term $M_9$, called "sustained notes in parts other than the bass" may be computed to prefer chords having sustained notes over those that don't have them at all. Optionally, $M_9$ is equal to the number of sustained notes that exist.

The above-described chord determination procedure finds a best-fitting chord for each moment; however, the chord assignment of highest musical correctness usually has less frequent chord changes. Therefore, musical correctness may be improved by merging moments into super-moments, to which a single chord is assigned. In an exemplary embodiment, this is done in two stages: first, it is checked whether each moment may be properly merged with the preceding one; then, it is checked if groups of moments (some of them already merged) may be further merged to further increase the musical correctness. The first stage is termed herein "chord combination" and the second "chord reduction". In a preferred embodiment, the chord combination procedure is executed only once (between adjacent moments), and the chord reduction is executed once and again until the chord assignment doesn't change with additional rounds of reduction.

The chord determination and the chord reduction procedures are described in detail below.

Chord Combination

In the above-described chord determination procedure, each moment is assigned a chord responsive to the notes of the moment and optionally responsive to notes of following moments. In the chord combination procedure, the chord assigned to a moment is optionally changed to better fit to the chord(s) assigned to the preceding moment. There are two possible results for this procedure:

(1) The chord assignment is left unchanged (2) The moments are combined to provide a super-moment, and a single chord is assigned to the super moment.

As there is no significance to the question whether a particular moment is a super-moment or not, all 'moments' and 'super-moments' will be referred to below as 'moments', unless a super-moment characteristic or single-moment characteristic needs to be emphasized.

Figure 18A:
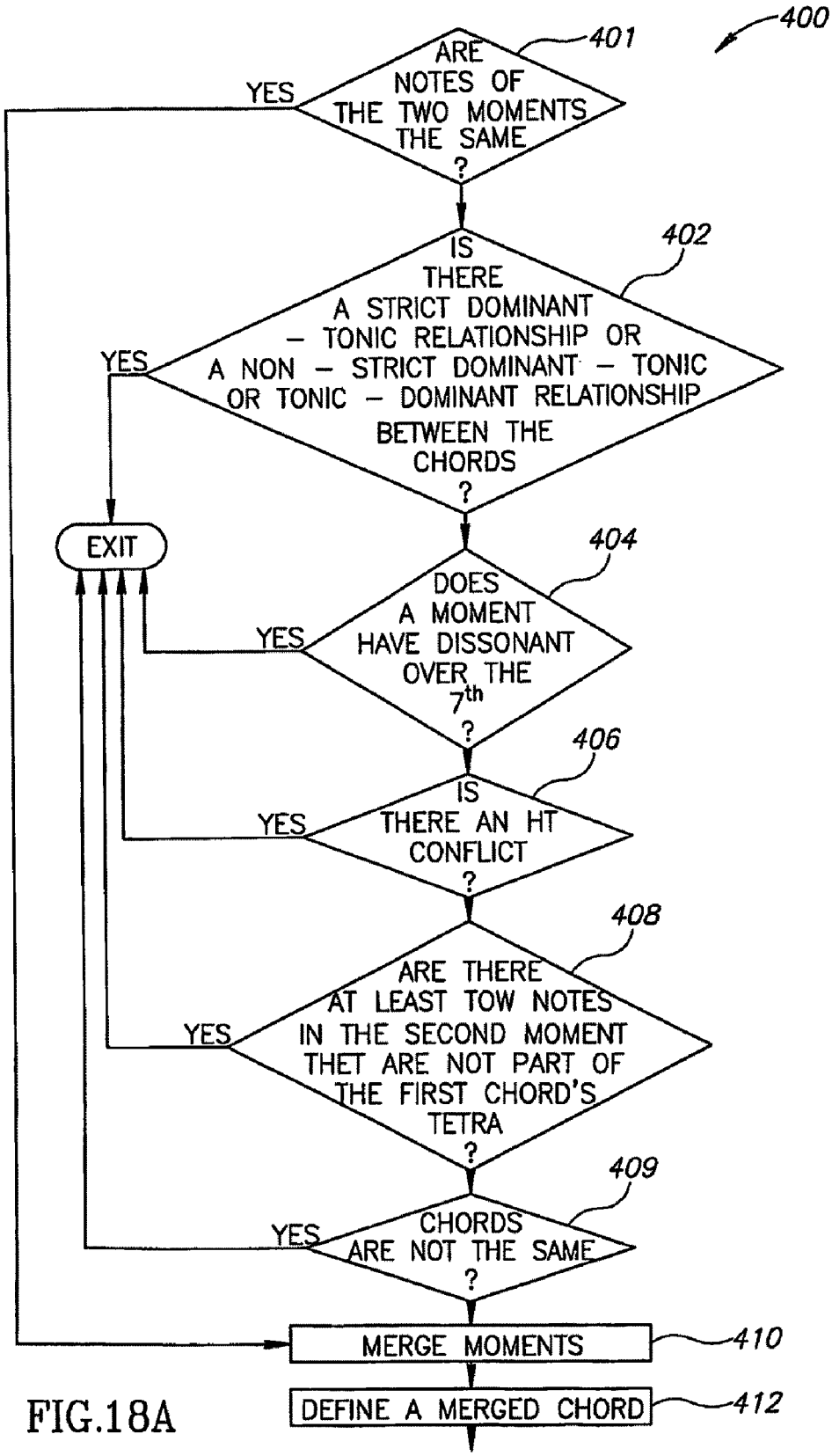
FIGS. 18A and 18B together form a flow chart of another procedure, titled chord combination, optionally used in the embodiment of FIG. 3
Figure 18B:
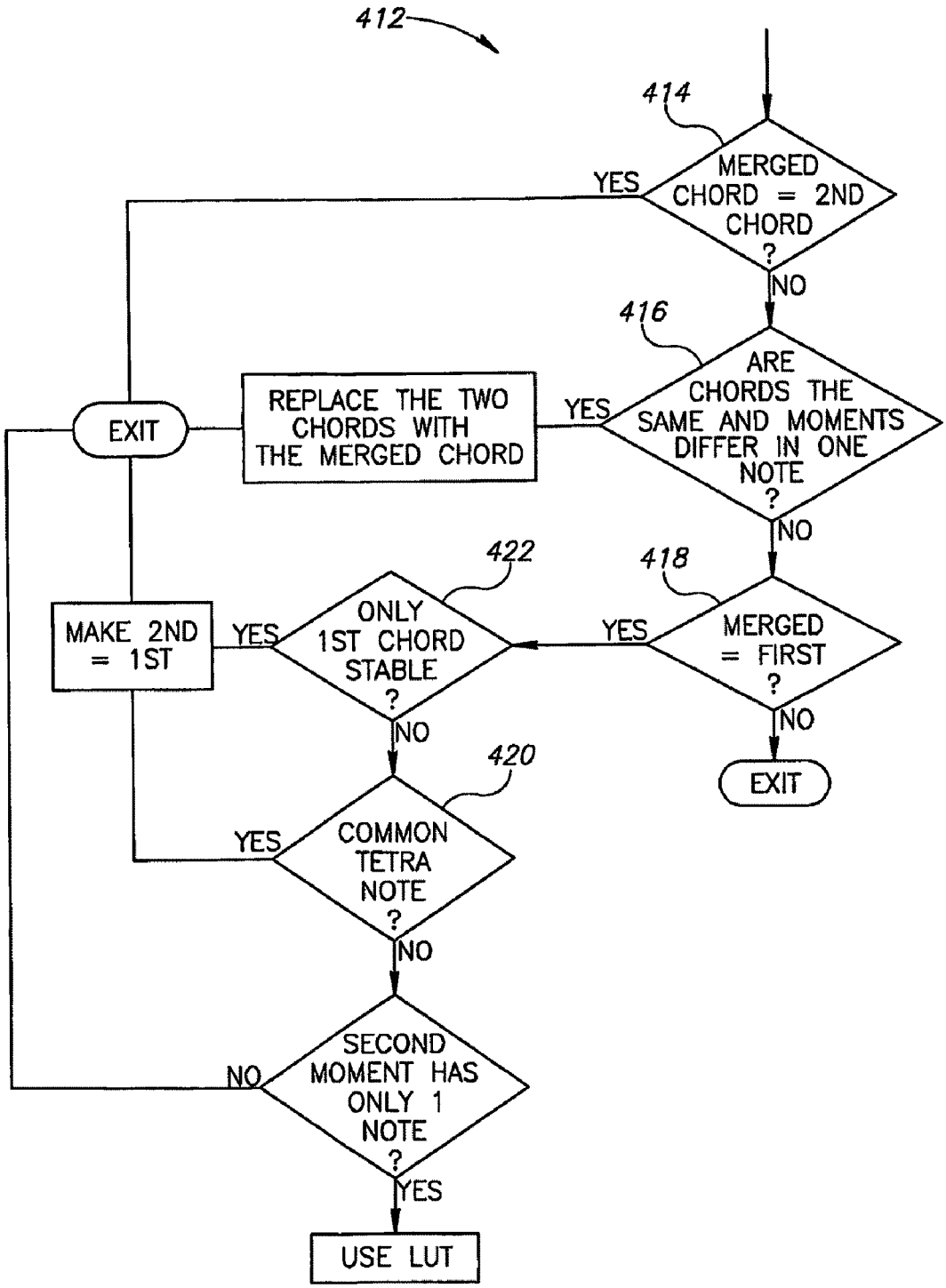

FIGS. 18A and 18B together make a flow chart of a procedure 400 of chord combination according to an exemplary embodiment of the invention.

If the notes of the two moments are exactly the same (401), the two moments are combined, and both moments receive the chord assigned to the first moment.

In FIG. 18A, blocks 402, 404, 406, and 408 define cases where the chord assignment is left unchanged. These are:

402: There is a strict Dominant-Tonic relationship (as defined above) or a non-strict Dominant-Tonic or Tonic-Dominant relationship (as defined above) between the chords of the two moments;

404: at least one of the moments has a bass, which is a dissonant over the seventh of the same moment's chord;

406: there is an HT conflict (that is, two notes that differ in the Half-Tone values, as for example, G and G 'sharp' or G and G 'flat') between a note in the second moment and a note of the first tetra; and

408: there are at least two notes in the second moment that are not part of the first chord's tetra.

If the chords are the same and 402-408 are all negative (409) the chords are merged; if the chords are not the same, then—Exit In all other cases, the notes of the two consecutive moments are merged (410) to obtain a "merged moment", and the chord that best fits the merged moment is determined in accordance with the chord determination procedure, to define a merged chord (412).

In FIG. 18B, if the merged chord is the same as the second chord (414), the chord assignment is not changed.

Otherwise, it should be decided if each one of the chords assigned to the two moments should be left unchanged, replaced with the chord assigned to the first moment, or replaced with the merged chord.

If the two chords are the same (416) and the second moment has only one new note (e.g. that was not present in the first moment), the two moments are combined, and the chords of both moments are replaced with the merged chord.

If the merged chord is the same as the chord assigned to the first moment (418), and there is more than one new note in the second moment, there are two conditions (420 and 422), under both of which the moments are combined and the second chord is replaced with the first one. In all other cases chord assignment is left unchanged. The conditions are:

420: the first and second moments have at least one note in common, and this note is part of the tetras of the two chords.

422: the first chord passes the threshold stability test (as defined above), and the second chord does not.

The Special Case of Moments Having a Single Note

Figure 19:
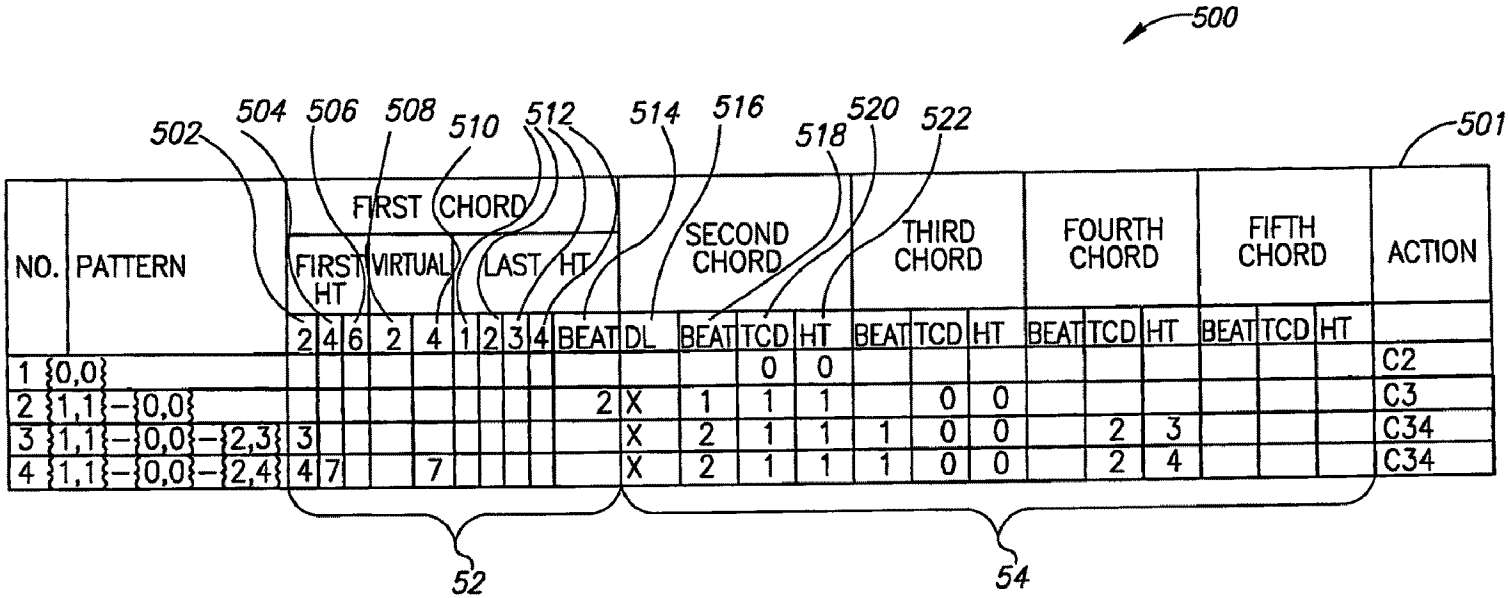
FIG. 19 is an excerpt from an exemplary look-up-table for use with the procedure of FIGS. 18A and 18B, according to an embodiment of the invention.

In an embodiment of the invention, if the second moment has only one note, the decision whether or not to combine it with the first, is taken by somewhat different rules, summarized in a look-up-table (500) such as that appearing in FIG. 19. A main difference between the rules summarized in the table and those summarized above is that in accordance with the table it is possible to disregard a moment having a single note. The above rules do not provide the possibility to disregard a moment. When a single note is disregarded, it is not assigned a chord of its own (so it appears as if it was part of the moment preceding it); but in any further reference to a moment that includes a disregarded note, the disregarded note is not considered part of the moment.

Another difference between the table and the general rules is that the combined super-moment is always assigned the chord that was assigned to the first moment by the chord determination procedure.

Some examples of lines that are part of the single-note LUT in use by the inventors are shown in FIG. 19.

The full table, which is currently used by the inventors, is annexed to U.S. provisional patent application No. 60/821,744, incorporated herein by reference, as Annex I.

The Notation Used in the LUT of FIG. 19

Action Column and Numbering of Moments

The action that the LUT allows is combining single notes into the preceding, non-single-note moment. The serial numbers of the single notes to be combined into the first, non-single-note, moment are listed as indexes of the letter C (Combine) in the action column (501) in the LUT. The combination means that the moments of all the combined notes together with the first moment, become part of one super-moment. The first, non-single-note, moment is numbered 1, therefore, the indexes of the single notes that may be combined are always larger than 1. The LUT considers up to 4 single notes at a time; therefore, the largest index may be 5.

If the action is C24, for instance, the second and fourth moments (which are the first and third single notes) are combined into the first moment, and the third moment (which is the second single note) is disregarded.

If the score contains a sequence of up to 4 single notes, the LUT is used once for this sequence. If the score contains a sequence with 5 or more single notes, the LUT is used again, this time, the $5^{th}$ single note is considered as if it was the first, and the moment, into which single notes have been combined in the previous use of the table, is considered the first, non-single-note, moment.

If the last single note in a sequence is disregarded by the action column, and the following moment contains more than one note, the chord assignment of that last single note remains unchanged, and it is not disregarded.

In the chord combination stage, single notes are combined only with a preceding moment. Combining single notes with a following moment may occur in the chord reduction stage, described below.

Headings of Columns in the Table

The factors considered while deciding whether to combine single notes into a preceding moment are listed in the headings of the columns of the table of FIG. 19. The first 10 columns (52) relate to factors characterizing the chord assigned to first, non-single-note moment, this moment is also referred to as "the first chord"; and the following 13 columns (54) relate to factors characterizing the single notes, which are also referred to as a second chord, third chord, etc. up to the fifth chord. The factors characterizing the single notes are the same for each of the single notes, and are explained below only in relation to the first single note (also called the second chord).

The factors are as follows:

Characteristics of the First Chord:

The HT of a note of TCD 2 (502), 4 (504), and 6 (506), which is present in the first moment. A letter "N" in one of these columns means that the respective note must NOT be present in the first moment, in order for the action in the same line to be taken.

The HT of the third (508) and fifth (510) of the first chord, if they are NOT present.

The HT's (512) of the tetra's notes that must be present in the last moment of the first chord.

The beat grade (514) of the last moment of the first chord. Beats are graded by the amount of accent applied to them in accordance with the meter and their position in the measure. A LUT with beat grades for various meters is provided in U.S. provisional patent application No. 60/821,744, incorporated herein by reference, as annex III. To illustrate beat grades, FIG. 5A contain also the beat grade of each of the moments.

Characteristics of the Second Chord

Duration relationship (516) between the first moment, and if it is a super-moment, the last single-moment thereof, and the second moment (that is, the first single note). A flag appearing in this column in the table indicates that the last moment of the first chord must NOT have shorter duration than the first single note.

The beat grade (518) hierarchy between the second chord and the last moment of the first chord. The term hierarchy means here that a beat that must be stronger is indicated with a larger number. For instance, in row 2 of the LUT, the beat of the last moment in the first chord must have higher grade than the beat of the first single note, and in lines 3 and 4, the beat of the second single note must have higher grade than the beat of the first single note.

The TCD (520) and HT (522) of the single notes are listed in relation to the root of the first chord.

The column headed "Pattern" does not contain any additional information, but is a summary of the columns headed "TCD" and "HT" in the second to fifth chord columns.

Application Examples of the Single-Note LUT

Figure 20:
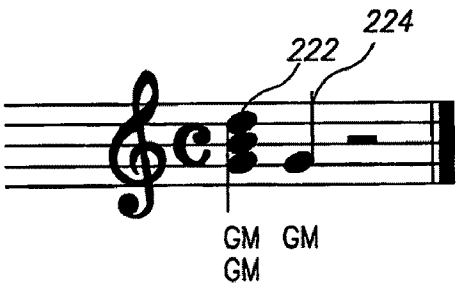

FIG. 20 is a short score including a non-single-note moment (222) and a single note moment (224), each of which was assigned in the chord determination stage the chord of G major. As all the requirements of the first line of the LUT are fulfilled, (that is, the TCD and the HT of the single note are the same as the root of the chord assigned to the first moment), the single note is combined with the first moment to give a super-moment, with G major assigned to it.

Figure 21:
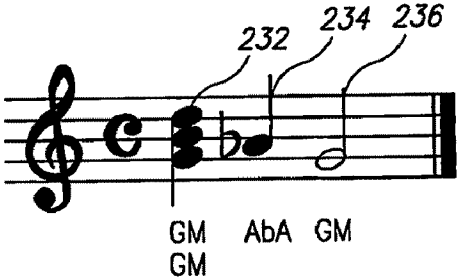
FIGS. 20 and 21 are short scores used to illustrate the use of two lines appearing in the table of FIG. 19.

FIG. 21 is a short score including a non-single-note moment (232), and two single notes (234 and 236). The chords assigned to them by the chord determination procedure are G major, A flat augmented and G major, respectively. As all the requirements of the second line of the LUT are fulfilled, the first single note is disregarded, and the second single note is combined with the first moment to give a super-moment, with G major assigned to it. Thus, for further analysis (if required), this score is treated as if it included one super-moment with the notes G, B, and D. The A flat, which appears in the score, is disregarded in further analysis of the harmony flow change.

Chord Reduction

In the above-described chord combination procedure, chords that were assigned to moments in the chord determination procedure are optionally changed to better fit to the chord(s) assigned to the preceding moment. In the chord reduction procedure, groups of moments (including super-moments) are optionally combined together with following and/or preceding moment(s) to produce a super-moment with one chord assigned to it.

The chord reduction procedure allows for disregarding non-single-note moments. The procedure may be run once and again until further reduction of the number of chord changes along the score is not obtained. As in the description of the chord combination procedure, the term moment is used herein to denote both single-moment and super-moment.

In a preferred embodiment, the chord reduction procedure is carried out in accordance with a LUT.

Figure 22:
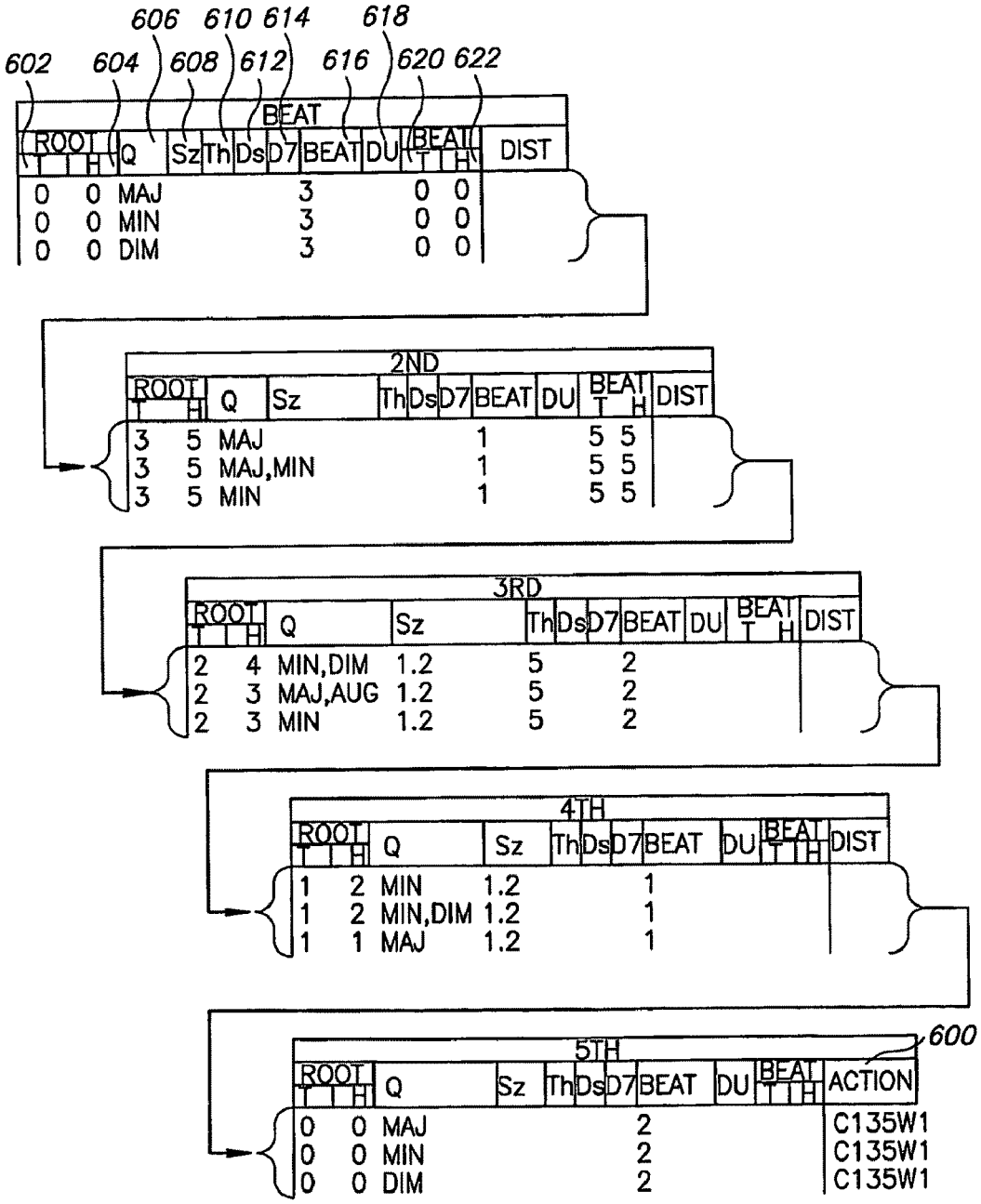
FIG. 22 is an excerpt from an exemplary look-up-table used for carrying out the chord reduction procedure of the embodiment of FIG. 3.

FIG. 22 is a portion of a look-up-table for chord reduction according to an exemplary embodiment of the present invention. The full table, which is currently used by the inventors, is annexed to U.S. provisional patent application No. 60/821,744, incorporated herein by reference, as annex II.

Other tables may be used as well, for instance, when different kinds of musical scores (classical, Jazz, ancient, etc.) are handled. It is also possible that some musicians would find another table to better suit their preferences. The table is provided to show one way to carry out chord reduction. In other embodiments, the chord reduction stage may be embodied in algorithm, rather than a LUT.

The LUT of FIG. 22 and annex II of U.S. provisional patent application No. 60/821,744, incorporated herein by reference, teaches to improve the chord assignments by lengthening the super-moments on account of transient appearance of chords. Optionally, the chord reduction is applied on the super-moments created in the chord combination procedure.

The action taken during the reduction process is indicated in the table of FIG. 22 in the 'action' column (600). The action may or may not specify a Winning chord (W), which is one of the chords being combined. For example, C12W1 means combine the first and second moments into one super moment, and assign to this super-moment the chord that was assigned to the first moment before the combining. C12 means combine all the notes present in the first and second moments, and assign to the combined moment a chord in accordance with the chord determination procedure. The reduction LUT allows disregarding the dissonants present in a disregarded moment, (indicated in the action column by omitting an index of a moment between two combined moments), but merges the triad chords of the disregarded moment provided there is a Winner specified in the action column.

The exemplary reduction LUT considers the reduction of a sequence of up to 5 chords at a time. The following factors, regarding each of the five chords, are considered.

TCD (602) and HT (604) of the chord root;

Quality (606) of the chord assigned to the moment, as this was defined above;

The number (608) of tetra notes (from a minimum of 1 to a maximum of 4) present in the moment;

Triad members (610) that must NOT be present in the moment;

Presence in the moment of dissonant notes other than the $7^{th}$ (612). If the column is empty, the presence of dissonant notes is irrelevant, if the digit 1 appears in the table: at least one dissonant note must be present, if 0: a dissonant note must not be present;

Presence in the moment of dissonant $7^{th}$ (614). If the column is empty, the presence of the $7^{th}$ is irrelevant, if the digit 1 appears in the table: a $7^{th}$ must be present, if 0: a $7^{th}$ must not be present;

The beat grade (616) of a moment in the sequence as compared with a neighboring moment; in the case of a super-moment the beat grade corresponds to the moment (within those comprising the super moment) that has the highest grade; for instance, if the digit 2 appears in the beat grade column of a moment and the digit 1 appears in the beat grade column of a subsequent moment, the beat grade of the first moment must be higher than the beat grade of the second moment;

The duration (618) of a moment as compared with the duration of a neighboring moment; for instance, if the digit 2 appears in the duration column of a first moment and the digit 1 appears in the duration column of a subsequent moment, the duration of the first moment must be higher than or equal to the duration of the second moment; but if the digit 1 appears in the duration column of a first moment and the digit 2 appears in the duration column of a subsequent moment, the duration of the second moment must be higher than the duration of the first;

The TCD (620) and HT (622) of the lowest note appearing in the moment (e.g. the bass) in relation to the root of the first chord; and The interval (in HT) between the bass and the note closest (in pitch) to the bass in the moment.

As may be seen in the table, the columns relating to the interval are always empty, as the inventors have not yet found a case where this factor has to be considered.

The inventors found that the above-described chord assignment method provides flow of harmonic changes of high musical correctness for all tonal musical scores that were tested. One example to such high musical correctness chord assignment is provided in FIG. 4.

Exemplary Result of an Exemplary Method

FIG. 4 shows a portion 130 of a musical score of a three-part Invention by J. S. Bach, with the chords assigned to it in methods according to embodiments of the present invention. The first line (132) shows chords assigned by the chord determination and the chord combination procedure. The results of the chord determination procedure are not shown, as the method applied in preparing FIG. 4 ran a chord combination procedure after each moment is assigned a chord in the chord determination procedure.

The second line (134) shows chords assigned by a method that also includes one run of a chord reduction process; and the third line (136) shows chords assigned by a method that includes two consecutive runs of the chord reduction procedure. Further repetitions of the chord reduction procedure do not change the chords assigned to the shown score-portion. The procedures used for the preparation of the chord assignments are those described in detail above. The chord notation used in the lines 132, 134, and 136 is that the first letter designates the root of the assigned chord (with ♯ representing a sharp and ♭ representing a flat), and the second letter designates its quality as follows: M=Major, m=minor, d=diminished, and A=augmented. Chords of other qualities, such as diminished-diminished, Augmented-Augmented, minor-Augmented, Major-diminished, and diminished-Augmented may be assigned by the method, but do not appear in the shown score-portion.

Options and Alternatives

In the preceding sections, preferred embodiments were referred to. Nevertheless, the invention is not limited to these embodiments, and alternatives and options do exist. Some such options and alternatives are described in the following sections.

Time segmentation: In some embodiments of the present invention the score is segmented along the timeline not by moments, as these were described above, but to other kinds of time segments, for instance time segments of constant duration. However, if the analysis relates only to time segments that are longer than moments, musical events that occur during the time segment might be ignored, and this might lead to analysis of lower musical correctness than is achieved with moments. Using time segments shorter than a moment seems not to improve the musical correctness of the analysis. Also the end of a moment can be defined as the disappearance of a note.

Determining accidentals of virtual notes: In some embodiments of the invention, each virtual note is assigned the accidental the same note had last time it existed in the score, or, if it never existed before in the score, in accordance with the key signature. In other embodiments, each virtual note is assigned the accidental the same note had last time it existed in the bar, or, if it never existed before in the bar, in accordance with the key signature. While these embodiments allow for easier determination of accidentals, the musical correctness achieved with them is often lower than when the accidentals are determined as in the preferred embodiment.

Chord determination rules: While the inventors have found that the rules described above provide the most satisfactory musical analysis, of all rules they have attempted to apply, additional sets of rules may exist. Some modifications that may be made are: it is possible to consider all trial triads that have notes in the time segment, not necessarily the root. The various terms may be positioned in other places in the hierarchy, or completely ignored; lower quality dissonant resolutions may be treated as non-resolutions; resolutions of various qualities may be defined to dissonants other than the seventh, etc. Dissonant resolutions may be looked for up to a certain time of moments after the appearance of the dissonant, or certain duration after its appearance, etc. Also chords other than triads may be defined as allowed chords.

Chord combination: The stage of chord combination may be omitted, and the chords assigned by the chord determination process may be treated directly with a chord reduction process. However, this might require a much larger look-up-table for the reduction stage.

Chord reduction: The stage of chord reduction may be omitted, but in complex musical scores this might result in chord assignment characterized by too frequent chord changes along the score, and thus to lower the musical correctness of the chord assignment.

The Optimization Process

The preferred embodiment was described above as utilizing a "mount climbing" optimization process, however, every optimization method known in the art may be useful to find the chord sequence of optimal musical fitness.

Defining Trial Chords

The above described preferred embodiment, is one of a broad family of embodiments, where optimization is carried out by first assigning a best fitting chord to each time segment (in the preferred embodiment: by the chord determination procedure), and then amending the chord assigned to each segment is considered, responsive to chords assigned to its neighboring segments (by the chord combination and chord reduction procedures).

In other members of this embodiment family, the best fitting chord for a single time segment is determined by computing the musical fitness of all the allowed chords, and choosing the one that gives the highest value.

Alternatively, the musical fitness is computed only for some trial chords selected from the allowed chords. Optionally, the trial chords are selected responsive to the notes of the time segment. Additionally or alternatively, the trial chords are selected responsive to the notes of preceding time segments. Optionally, the trial chords are chosen such that each trial chord is a triad having its root in the time segment. Optionally, the accidentals of virtual notes in a trial chord are determined responsive to accidentals that appeared earlier in the score, including in the key-signature.

Alternatively or additionally, the trial chords are selected responsive to chords assigned to neighboring time segments.

Optionally, a first time segment is considered a neighbor of a second time segment if the number of time segments separating them is not larger than a defined number. In one example, only adjacent segments are considered neighbors (in which case the defined number is 0). Alternatively, segments that are further along the timeline, separated by 1, 2, 3, 4, 5, 10, or any other number of segments are considered neighbors. Alternatively or additionally, neighborhood relationships between time-segments end when a minimal number of new notes appear in the score; for instance, when two or more new notes appear.

Optionally, the optimization process accepts only changes associated with increase of the musical fitness. Alternatively, the process includes random acceptance of changes that result in decrease of the musical fitness, with a probability depending on the amount of decrease.

The above described methodology is an example of optimizing, in which a cost function (musical fitness) is used to select an optimal or near-optimal matching of chords to music. The above description relates generally to local optimization method; however, other optimization methods are known in the art and may be used, including, for example, hill climbing, simulated annealing, quantum annealing, tabu search, genetic algorithms, ant colony optimization, evolution strategy, differential evolution, and particle swarm optimization. The optimization methods may use various types of cost functions, including local functions (that depend on the relationships between a moment and a chord assigned to it), contextual components, that depend on the relationships between a chord assigned to a moment and the notes and/or chords of neighboring moments, and global functions, that depend on the chords assigned to the entire score.

Rhythmic Flow

Overview

Automatic Tempo Assignment

In an embodiment of the invention, the duration of a moment of a lower beat, which precedes a moment of a higher beat, is longer than the explicit duration as defined in the score. For instance, the beat of the last moment in a measure is lower than the beat of the first moment in the following measure. Accordingly, in an embodiment of the invention, a moment that appears at the end of a measure is assigned a tempo that is slower than the tempo assigned to it by the tempo marking in the score.

In an embodiment of the invention, a similar rule applies to moments of lower beat grade that precede moments of higher beat grade inside a measure. For instance, in a score written in 4/4 time, the moment preceding the moment that appears at the beginning of the third quarter is optionally assigned slower tempo.

A look-up-table with beat grades for various time signatures is provided in application 60/821,744 as annex III, which is incorporated herein by reference.

In an embodiment of the invention a tempo is "slow" if it is slower than the tempo indicated in the score. Alternatively or additionally, a moment is referred to as having a slower tempo when its tempo is slower than that of the preceding moment.

More generally, it is in accordance with embodiments of the invention to assign to each moment a tempo responsive to the time signature and the moment's position in the measure. Optionally, this is done by grading the beat of each moment in the measure, and assigning to each moment a tempo responsive to the moment's beat-grade.

The terms beat and time signature are explained in the glossary above.

Generally, there is no one correspondence rules-set governing the correspondence between beat-grade and tempo, and different rule-sets may be applicable to different kinds of music or different performance styles. Nevertheless, the following correspondence guidelines may be helpful in assigning tempi to moments in a manner that would result in a performance that in most cases will sound "rhythmically correct":

(a) Generally, the tempo of a weak beat should not be higher (faster) than that of a strong beat that follows it. The importance of this guideline may decrease as the subdivisions become smaller, or in specially identified rhythmic pattern. For instance, in a sequence of three moments of short subdivisions, or in specially identified rhythmic pattern, having the beat sequence "strong, weak, very strong" or "very strong, weak, strong" it is possible to assign to the last moment slower tempo than that assigned to the second moment, provided the second moment is slower than the first moment. In this context, short subdivision is a subdivision smaller than the time-signature unit.

(b) The average Tempo of an entire measure should not significantly vary between measures divided to subdivisions of different sizes. Even a deviation of less than 1% is noticeable, but a small deviation of no more than 2% may be acceptable to most listeners. Following this guideline ensures that the general tempo of a score-portion, in which the shortest subdivision is a sixteenth, for instance, will be the same as that of another portion of the same score, in which the shortest subdivision is a quarter.

(c) Tempi of subdivisions smaller than the time-signature unit should be such, that when averaged over subdivision units, the averages obey guideline (a).

Automatic Velocity Assignment

In an embodiment of the invention, the velocity assigned to a moment of a lower beat, which precedes a moment of a higher beat, is lower than the velocity assigned to the moment of the higher beat. For instance, in an embodiment of the invention, a moment that appears at the end of a measure is assigned a velocity that is lower than the velocity assigned to the moment appearing in the beginning of the following measure.

In an embodiment of the invention, a similar rule applies to moments of lower beat grade that precede moments of higher beat grade inside a measure. For instance, in a score written in 4/4 time, the moment preceding the moment that appears at the beginning of the third quarter is assigned a lower intensity.

In an embodiment of the invention a velocity is "low" if it is lower than the velocity of the note that follows it. Alternatively or additionally, a moment is referred to as having a lower velocity when its velocity is lower than the velocity assigned to it by a specific dynamic marking in the score or default intensity.

It should be noted that music notation usually does not assign velocity values to each and every note in the score, such velocity assignment being left to the discretion of the performer. In an embodiment of the invention the performer is an apparatus, which assigns intensities to notes in accordance with the time signature and the position of the note in the measure.

More generally, it is in accordance with embodiments of the invention to assign to each note a velocity responsive to the time signature and the note's position in the measure. Optionally, this is done by grading the beat of each note in the measure, and assigning to each note a velocity responsive to the note's beat-grade.

The following correspondence guidelines may be helpful in assigning intensities to notes in a manner that would result in a performance that in most cases will sound "rhythmically correct":

(a) Generally, the velocity of a strong beat should not be lower (softer) than that of a weaker beat that precedes it.

(b) Intensities of subdivisions smaller than the time-signature unit should be such, that when averaged over subdivision units, the averages obey guideline (a).

(c) Intensities of adjacent notes should not be too different from each other. "Too different" intensities of adjacent moments result, for example, in introduction of an accent (a "too loud" note) after the "too soft" note. If, for instance, most velocity differences along a score are around 2%-3%, a velocity difference larger than 5% might be perceived by listeners as "too different". If such a difference is not desired, a 5% difference may be too big. If most velocity differences are around 5-6% the ear may adjust itself to these differences, and interpret as "too different" mainly velocity differences of 10% or higher. Special care should be taken not to inadvertently create accents at beginnings of measures, as they have much higher beat-level than the end of the preceding measure.

These guidelines may be followed with many different pre-sets, and they are all in accordance with embodiments of the invention. Specific numbers that provide most appropriate pre-sets for a specific musical score or performance style may be found by a skilled person in a trial and error process, and the pre-sets reproduced herewith provide good starting points.

An Automatic Music Performer

Figure 23:
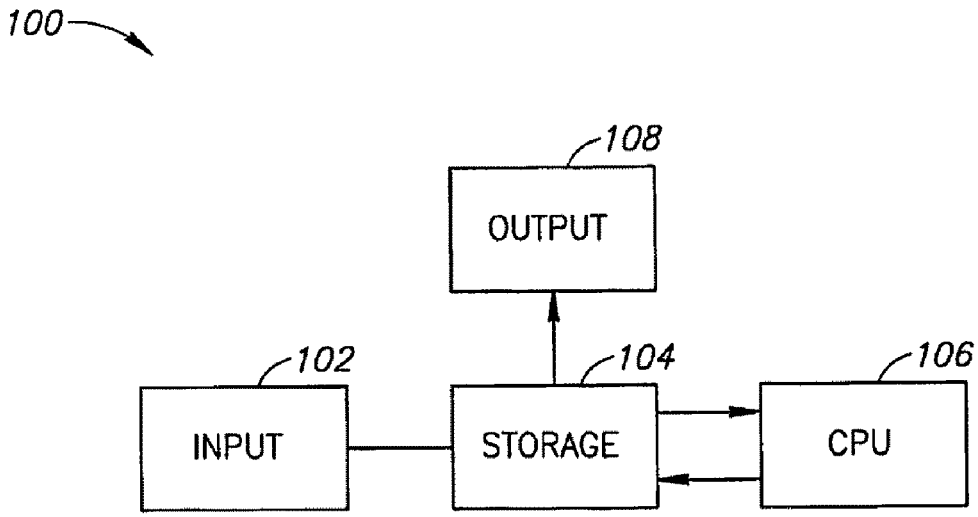
FIG. 23 is a box-diagram of a music performer according to an embodiment of the invention.

FIG. 23 is a block diagram of an automatic music performer 100 according to an embodiment of the invention. The performer (100) is shown to include an input (102), a storage unit (104) a processing unit (106), and an output (108).

Optionally, input 102 is a notation application (that is a 'word processor' for writing music notes rather than alphabet letters), which allows a user to input music as notes and get a printable score as an output. Such notation applications are commercially available, for instance, from MakeMusic! by the trade name Finale™ or from Sibelius by the trade name Sibelius™. Symbolic music notation file is any computer-readable music representation file, such as a MIDI list or Music XML.

Additionally or alternatively, input 102 is configured to receive a music notation file created outside of performer 100.

Additionally or alternatively, input 102 is configured to receive a score in standard notation, and includes an optical reader for reading the score, and software for translating it into a music notation file. Such a system is described, for instance, in U.S. patent application Publication No. 2006-254407, the entire contents thereof is incorporated herein by reference.

Additionally or alternatively, input 102 is configured to receive a score in any other format that includes the information conventionally included in a standard musical score.

Input 102 may also include a user interface, configured to allow a user to input performance preferences.

Storage 104 is configured to store the input music notation file. Additionally, storage 104 stores a software applications and data files for use by processor 106.

In an embodiment of the invention, processor 106 is configured to create a second music notation file, based on the file received through input 102 and the software application and/or data files stored on storage 104. Generally, processor 106 extracts at least one rhythmic characteristic of a moment, and assigns a tempo parameter to the moment, in accordance with the rules saved on storage 104 regarding tempo parameter of moments with the at least one parameter extracted. Some details of actions preformed by such software in an exemplary embodiment of the invention are provided below, under the title 'assigning tempo and/or velocity parameters'.

In an embodiment of the invention, output 108 is a display, displaying the music notation file prepared by processor 106. Optionally, the display is visual, and the music notation file is displayed in a human-readable format. Optionally, the display has an audio output for playing back the music notation file as music performance. Preferably, such music performance sounds more "rhythmically correct" than performance of the input file.

Exemplary User Interfaces

In an exemplary embodiment of the invention, the user interface allows a user to choose among several different tempo pre-sets and several different velocity pre-sets. Optionally, the pre-sets are conjugated, such that each tempo pre-set is chosen by default with its conjugated velocity pre-set. Optionally, this default may be overridden.

In an embodiment of the invention, the user interface allows choosing different pre-sets to different portions of the score. For instance, the user is allowed to mark portions of the score with the mouse, and select for the marked portion a pre-set from a pre-set menu.

In an exemplary embodiment of the invention, the user interface allows for changing, creating, and saving pre-sets.

In an embodiment of the invention a pre-set may be graphically amended. Optionally, a graph such as that presented in FIG. 25 is displayed, and the user can independently "stretch" or "squeeze" each bar by "dragging" its edge with the mouse. Optionally, when such dragging is against a guideline, an alert is displayed, visually and/or audibly. In an embodiment of the invention the user interface does not allow departing from one or more of the guidelines. In an embodiment of the invention, the user is allowed to depart from one or more of the guidelines, optionally after being alerted.

In an embodiment of the invention, the pre-sets are provided variable-dependent. For instance, a tempo parameter is provided as 1+0.1a, 1−0.1a and the like (rather than 1.1, 0.9, etc.). Optionally, the user is allowed setting the value of the variable. In the above example, setting a=1 would result in parameters 1.1, 0.9; while setting a=0.4 would result in 1.04, 0.96. Optionally, the user interface allows a user to set values of variables, on which pre-sets depend, with a slider.

Assigning 'Rhythmically Correct' Tempo and/or Velocity Parameters

Optionally, processor 106 reads from storage 104 tempo and/or velocity parameters associated with different measure-portions, and assigns to each moment the tempo and/or velocity parameters associated with the measure-portion occupied by the moment. A moment that occupies more than one measure-portion is optionally associated with tempo and/or velocity parameters, each being the average of the values assigned to the measure-portions occupied by the moment.

It is convenient to assign tempo and/or velocity parameters to measure portions corresponding to the shortest subdivision in the measure. This way, each moment occupies a whole number of measure-portions. Thus, in an embodiment of the invention, a list of beat-grades is prepared for each subdivision and a tempo and/or a velocity is assigned to each subdivision responsive to the subdivision's beat-grade. The lists of beat-grades and corresponding tempo and/or velocity parameters may be prepared in advance, and used for many different scores, as they are not score-specific. In performing a specific score, each moment is assigned a tempo and a velocity, where applicable (or an average of tempi and intensities, as the case may be) from the lists of tempi and velocities. Optionally tempo and/or velocity may be expressed in these lists as percentages of fixed tempo and/or velocity value.

Optionally, lists of tempo and/or velocity parameters are prepared for the shortest subdivision, and parameters of all moments in the score are assigned based on this list. Preferably, lists of tempo and/or velocity parameters are prepared for each subdivision, and each moment is assigned a parameter from the list prepared for the shortest subdivision appearing in the measure (that is, the shortest moment appearing in the measure).

EXAMPLE

Figure 24:
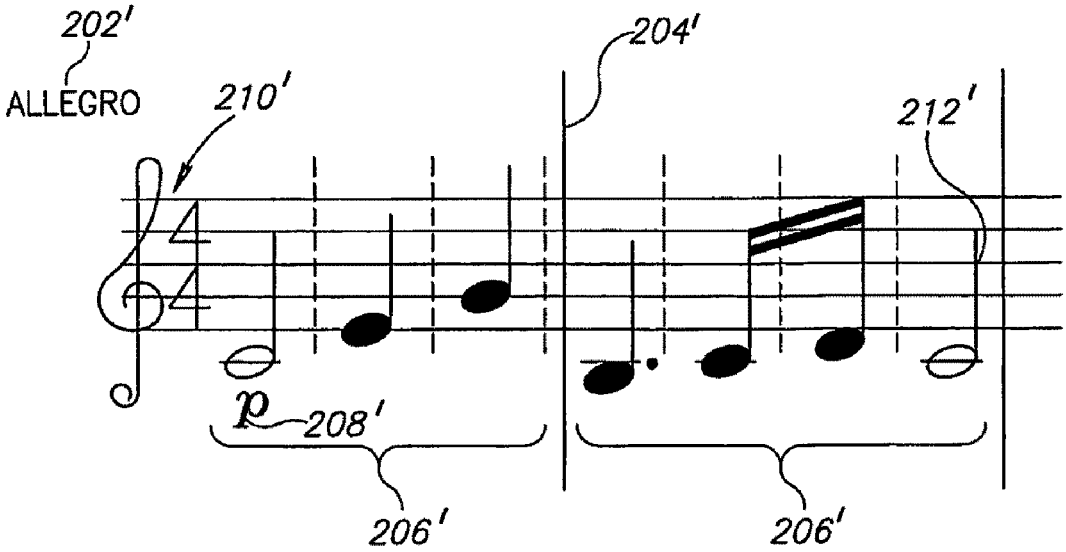
FIG. 24 is a reproduction of a score portion.

FIG. 24 is a reproduction of a short musical score represented in standard notation. The score includes a tempo indication (202'), bar lines (204'), which define measures (206') in the score, velocity indication (208'), time signature (210') and notes (212'). Each note indicates the pitch and subdivision. For illustration, dashed lines separate moments from each other.

In an embodiment of the invention, processor 106 assigns tempo parameters to each moment and/or velocity to each note in accordance with the explicit performance indications in the score (202', 208'), time signature (210') indicated in the input music notation file and the position of the moment/note in the measure.

Table III provides tempo and velocity parameters according to an exemplary embodiment of the invention, for time-signature 4/4, with the smallest subdivision being 1/4.

TABLE III

| Moment # | Tempo parameter | Note # | Velocity paraeter |
|---|---|---|---|
| 1 | 1.000 | 1 | 1.000 |
| 2 | 0.950 | 2 | 0.950 |
| 3 | 0.950 | 3 | 0.950 |
| 4 | 0.900 | 4 | 0.900 |

Table IV provides tempo and velocity parameters according to an exemplary embodiment of the invention, for time-signature 4/4, with the smallest subdivision being 1/16.

TABLE IV

| Moment # | Tempo parameter | Note # | Velocity parameter |
|---|---|---|---|
| 1 | 0.950 | 1 | 1.000 |
| 2 | 1.025 | 2 | 0.950 |
| 3 | 1.025 | 3 | 0.950 |
| 4 | 0.975 | 4 | 0.925 |
| 5 | 0.975 | 5 | 0.950 |
| 6 | 0.950 | 6 | 0.925 |
| 7 | 0.950 | 7 | 0.925 |
| 8 | 0.925 | 8 | 0.900 |
| 9 | 0.950 | 9 | 0.950 |
| 10 | 0.975 | 10 | 0.925 |
| 11 | 0.975 | 11 | 0.925 |
| 12 | 0.925 | 12 | 0.900 |
| 13 | 0.925 | 13 | 0.900 |
| 14 | 0.900 | 14 | 0.875 |
| 15 | 0.900 | 15 | 0.900 |
| 16 | 0.875 | 16 | 0.925 |

In operation, processor 106 identifies the shortest subdivision in each bar, and accordingly extracts parameters from table II (if the shortest subdivision is 1/4, such as in the first measure in FIG. 24) or II (if the shortest subdivision is 1/16, such as in the second measure in FIG. 24).

Similar tables may be provided for use in performing scores written in other time signatures and having measures with other shortest subdivisions. The values appearing in such tables in some exemplary embodiments of the invention are provided in FIGS. 25-29.

FIGS. 25A, 25B, 25C and 25D show bar-charts with exemplary tempo parameters useful for 4/4 time signature and subdivisions of 1/4, 1/8, 1/16, and 1/32, respectively.

FIGS. 26A-26D show bar-charts with exemplary velocity parameters useful in the same cases.

Figure 27A:
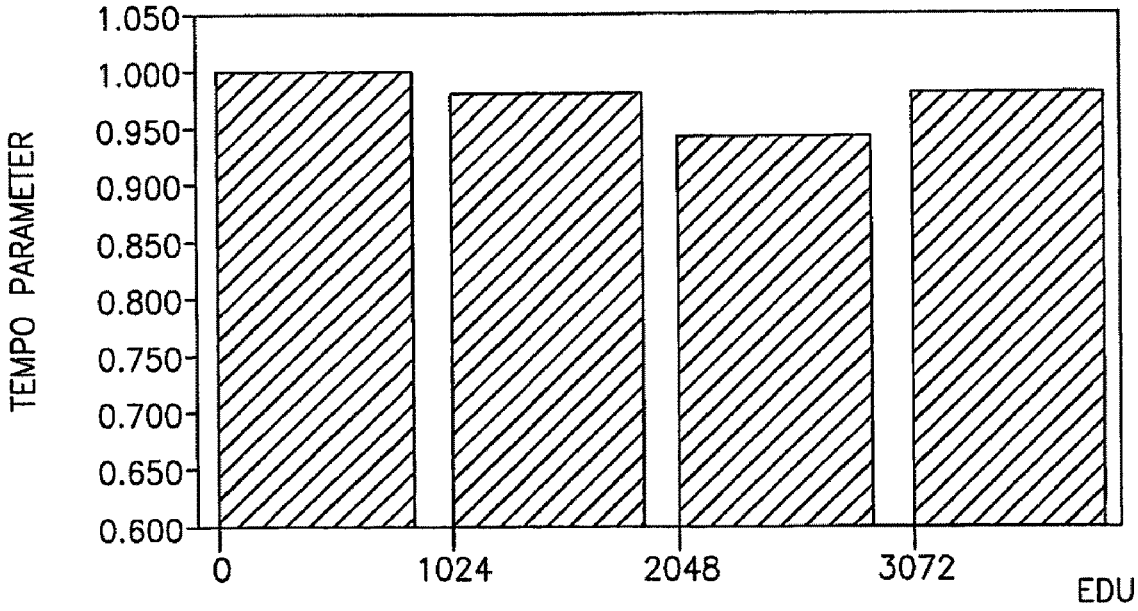
FIGS. 27A-27C are bar chart representations of another tempo pre-set for a score written in 4/4 time signature according to an embodiment of the invention.
Figure 27B:
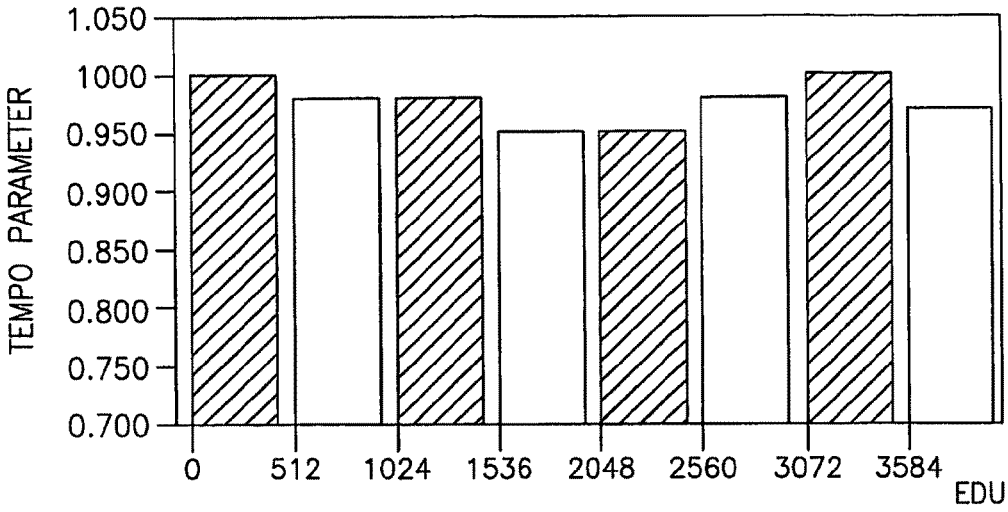
Figure 27C:
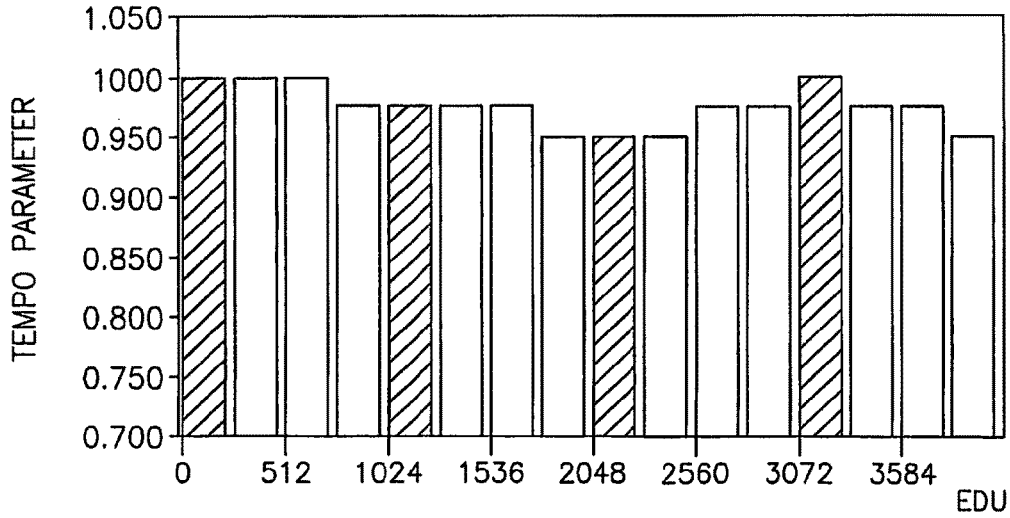
Figure 28A:
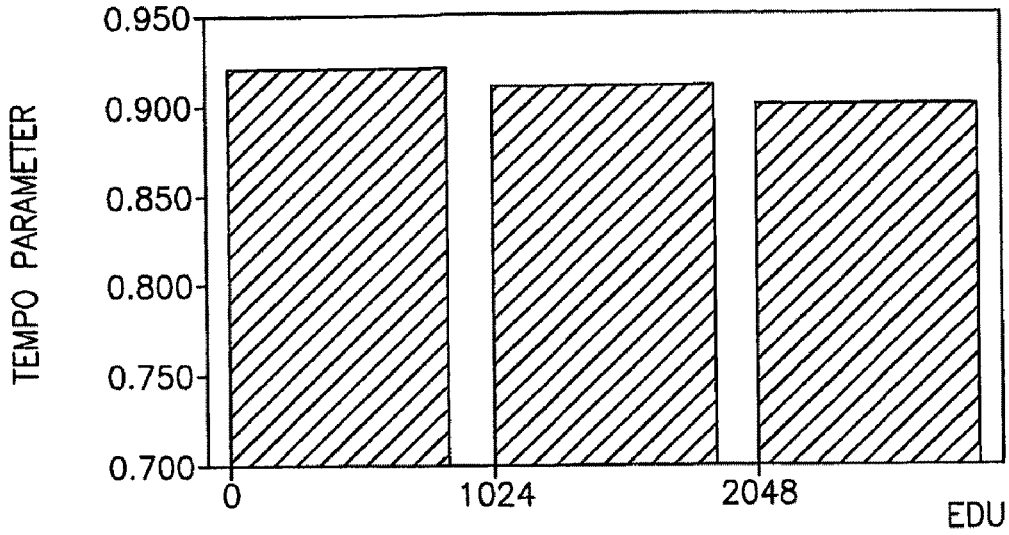
FIGS. 28A-28E are bar-chart representations of tempo pre-sets for scores written in 3/4 time signature, according to embodiments of the invention.
Figure 28B:
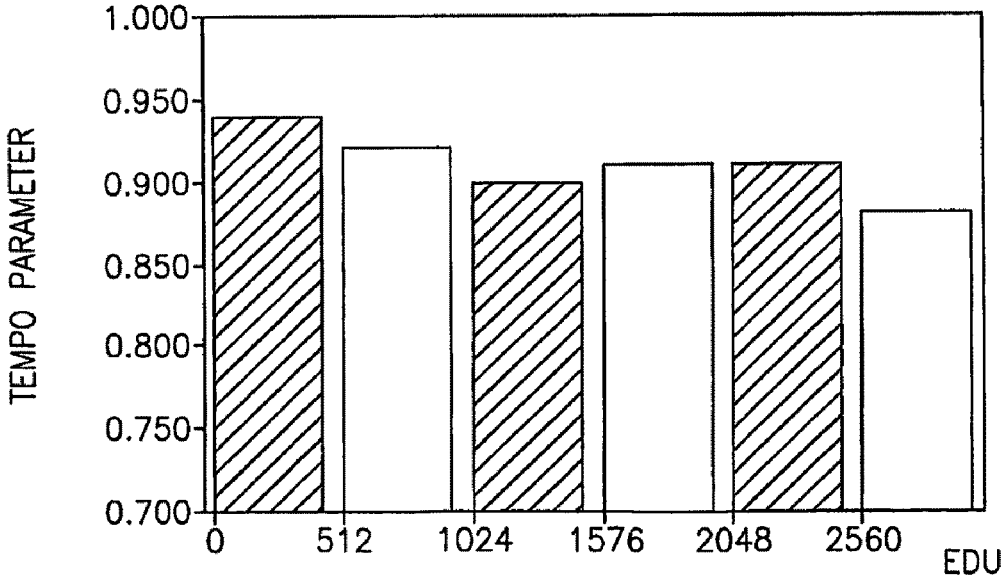
Figure 28C:
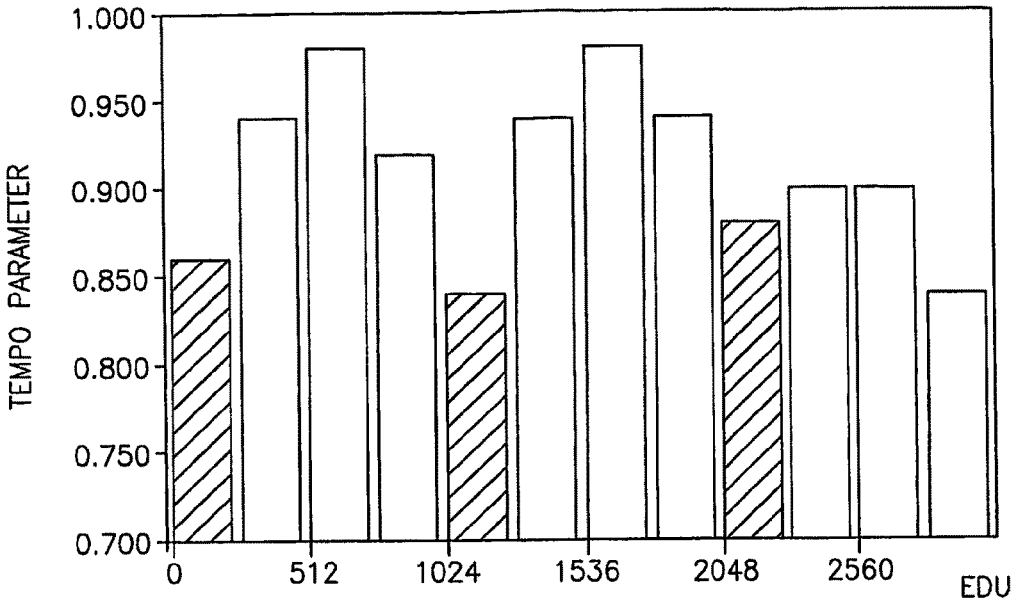
Figure 28D:
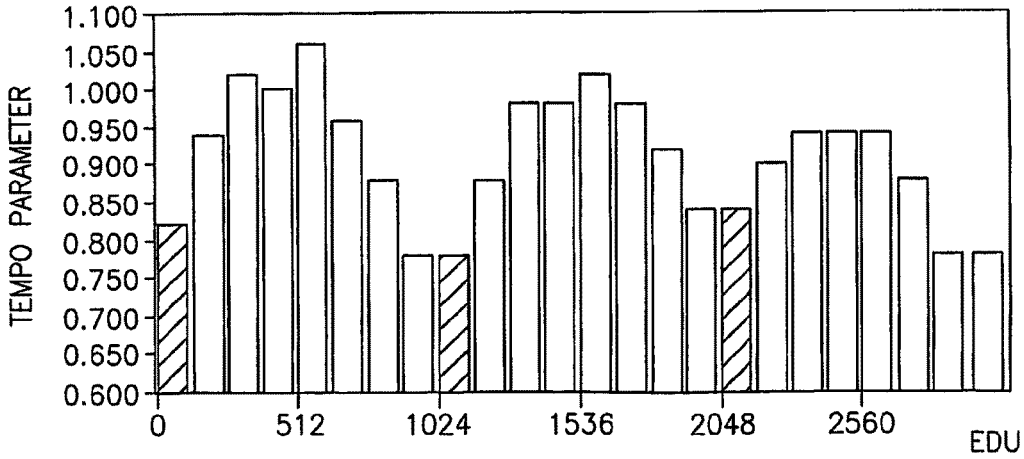
Figure 28E:
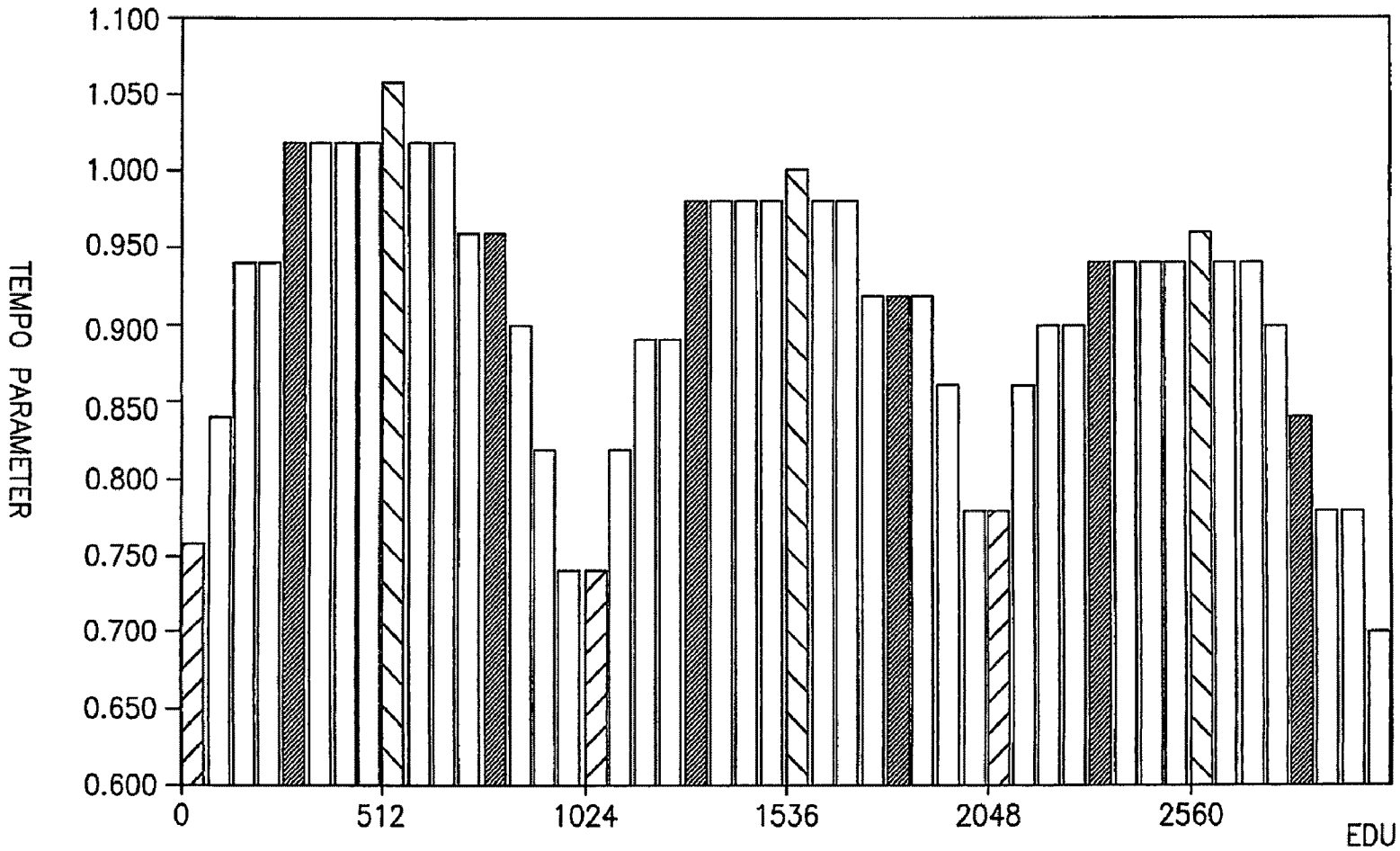
Figure 29A:
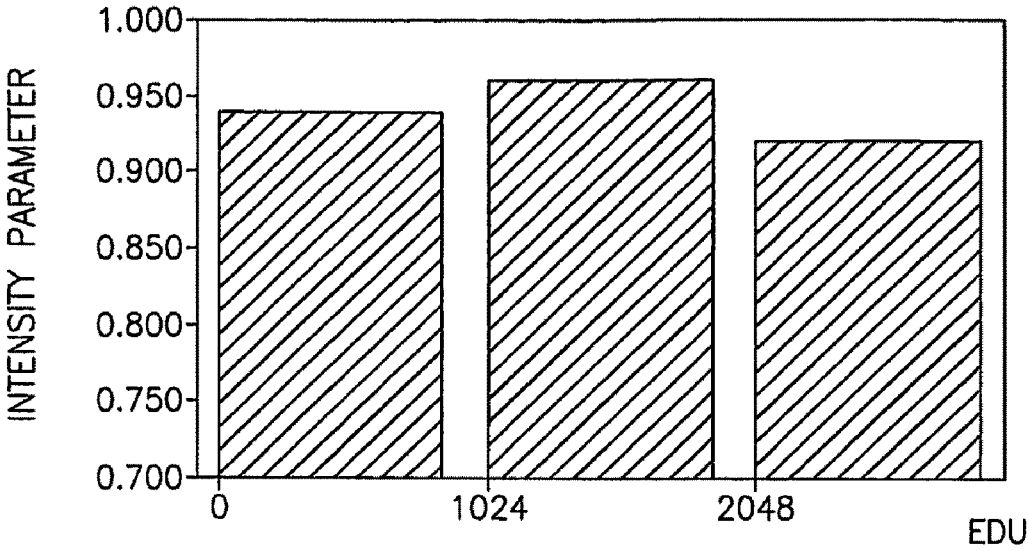
FIGS. 29A-29E are bar-chart representations of velocity pre-sets for scores written in 3/4 time signature according to an embodiment of the invention.
Figure 29B:
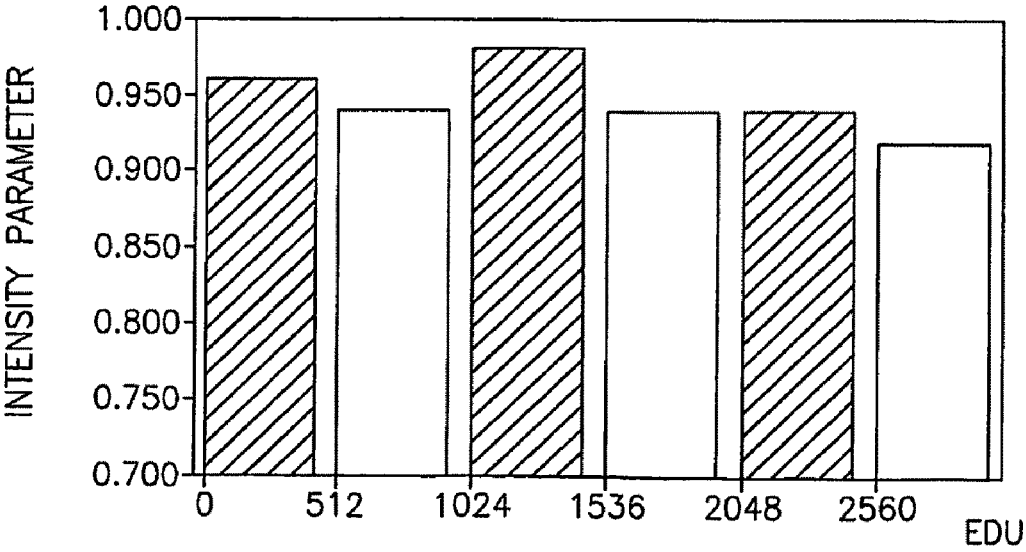
Figure 29C:
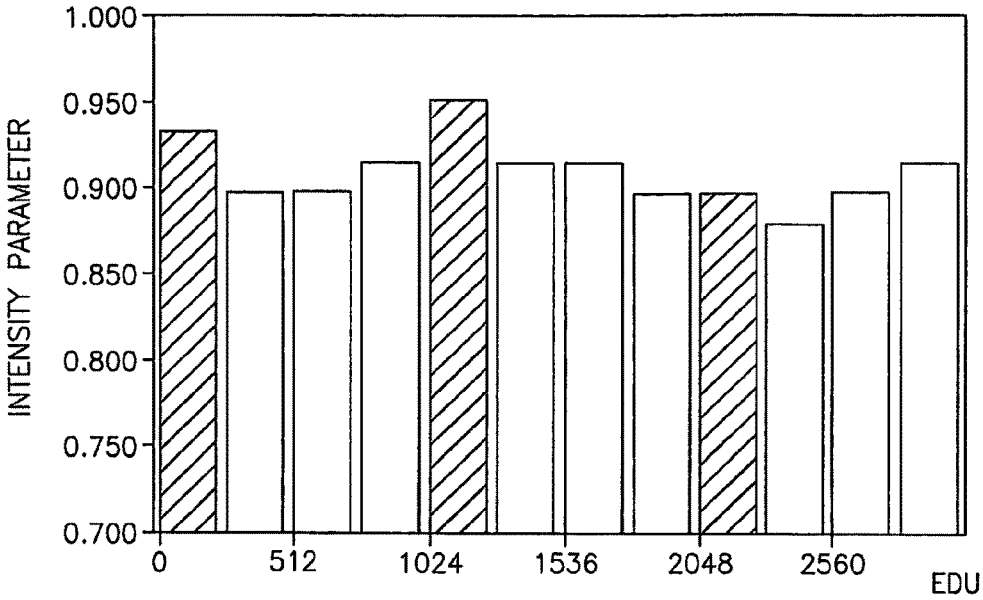
Figure 29D:
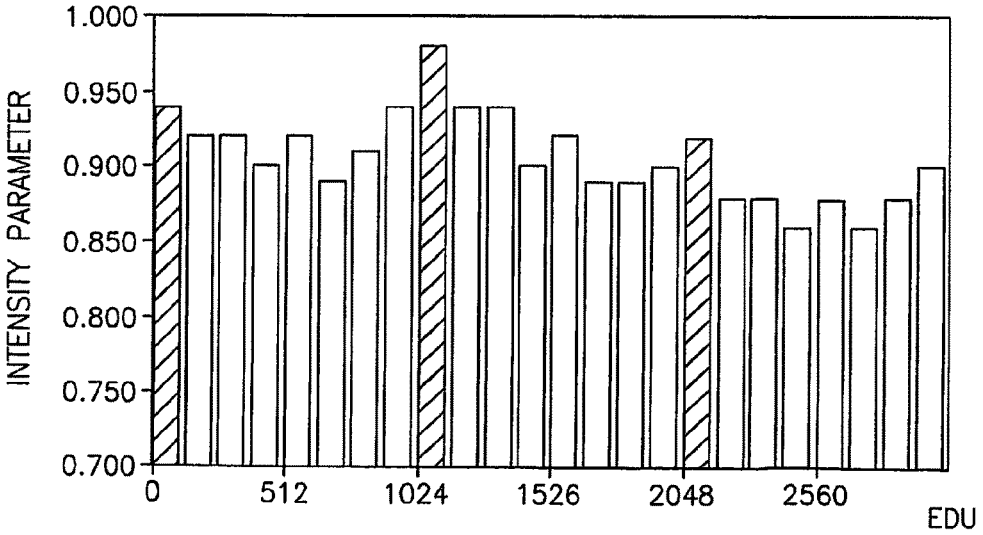
Figure 29E:
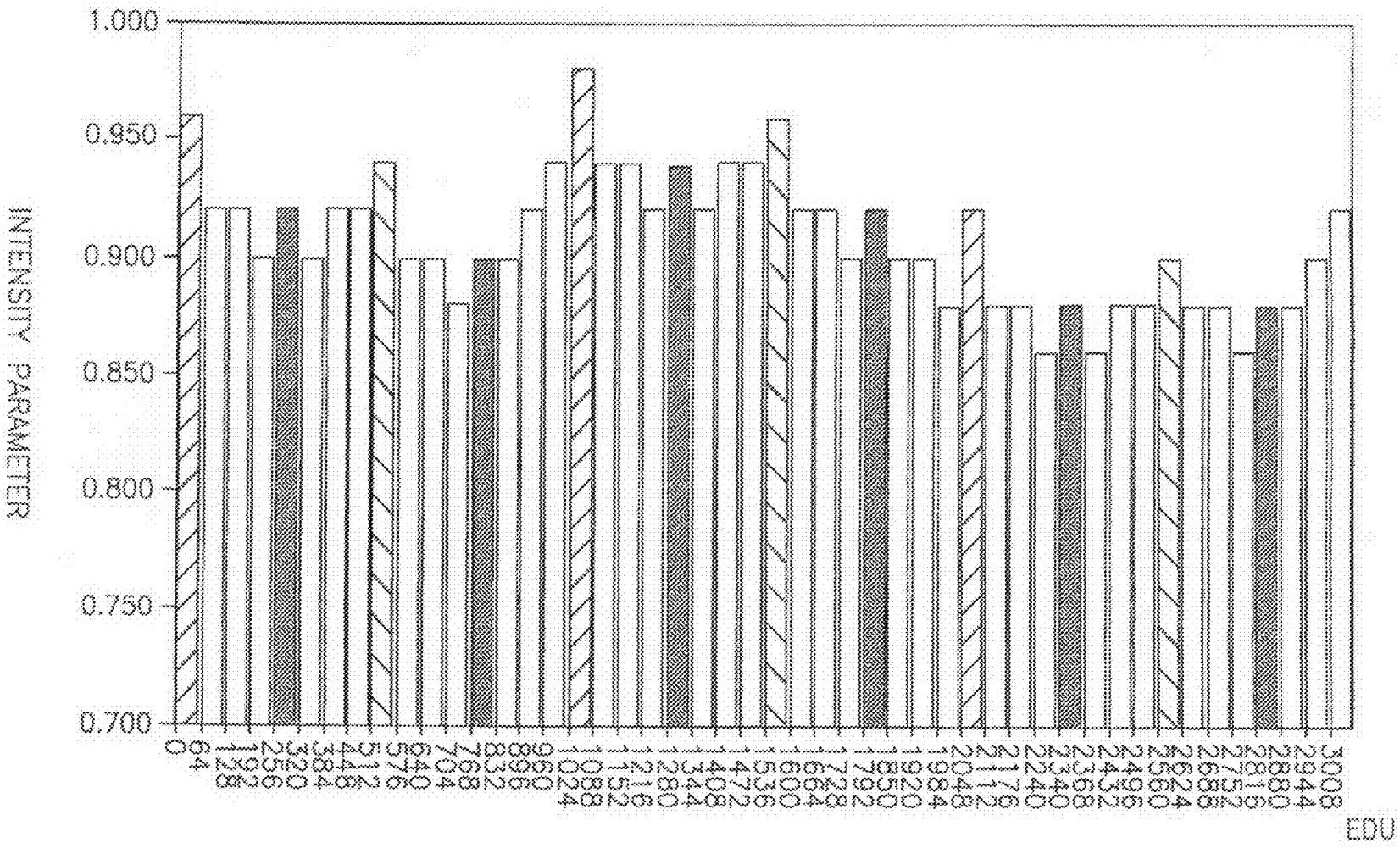

FIGS. 27A-27C represent another set of tempo parameters according to an exemplary embodiment of the invention.

FIGS. 28A-28E and 29A-29E are bar-charts showing exemplary tempo and velocity parameters in a time signature of 3/4.

In all the figures, the horizontal axis show EDU (elapsed duration units) at which a subdivision begins. EDU is a measure of the nominal time-length of a score-portion, namely, the time-length between two points in a score, if played exactly as indicated by the subdivisions.

As the score of FIG. 24 is written in 4/4, the pre-set of FIGS. 28 and 29 is not applicable thereto. Optionally, a user is allowed choosing between different tempo and/or velocity parameters, for example, tempo parameters of FIG. 25C or 27C and velocity parameters of FIG. 26C or without any deviation from nominal velocities at all (as, for instance in the case of a score for harpsichord, which does not allow a performer to control the intensity). Optionally, a large variety of pre-sets are provided in storage 104, and the user is allowed to choose amongst them. Optionally, one of the pre-sets is used as a default for each time signature, with which music is performed by performer 100 in case a user does not indicate a preference. Optionally, a tempo pre-set provided with one velocity pre-set may be used with another.

Processor 106 reads the subdivision of each moment from the first music notation file stored in storage 104. If the subdivision is the shortest in the measure (such as in moments #2 or 3 in the first measure and 2 or 3 in the second measure in FIG. 24 (see also Table V), the subdivision is divided by the tempo parameter to obtain a corrected subdivision, and this corrected subdivision is written by processor 106 into the second music notation file. Alternatively, in the music notation file each moment has its own tempo, and the tempo indicated in the score (202') is multiplied by the parameter found in the table and written in the second music notation file.

If the moment is longer than the shortest subdivision (such as in moments #1, 4 or 7 in FIG. 24) processor 106 averages tempo parameters associated with the subdivisions occupied by the moment, and then manipulates the tempo of the subdivision as explained above.

Table V provides subdivisions of each moment appearing in the score reproduced in FIG. 24, tempo and velocity relationships according to tables III and IV. Table V is shown separately for each measure.

TABLE V

| # of moment | subdivision | Tempo Percentage | Velocity Percentage |
|---|---|---|---|
| 1 | ½ | (1.00 + 0.95)/2 = 0.975 | (1.00 + 0.95)/2 = 0.975 |
| 2 | ¼ | 0.95 | 0.95 |
| 3 | ¼ | 0.90 | 0.90 |
| 4 | ⅜ | (0.95 + 1.025 + 1.025 + 0.975 + 0.975 + 0.95)/6 = 0.983 | (1.00 + 0.95 + 0.95 + 0.925 + 0.950 + 0.925)/6 = 0.95 |
| 5 | 1/16 | 0.95 | 0.925 |
| 6 | 1/16 | 0.925 | 0.900 |
| 7 | ½ | (0.950 + 0.975 + 0.975 + 0.925 + 0.925 + 0.900 + 0.900 + 0.875)/8 = 0.928 | (0.950 + 0.925 + 0.925 + 0.900 + 0.900 + 0.875 + 0.900 + 0.925)/8 = 0.912 |

Pre-Sets of Full Correspondence with Beat-Grade

In an embodiment of the invention, the tempo and optionally also the velocity parameters are set in full correspondence with the beat-grade, such that a moment (or note) having a higher beat-grade is associated with a higher velocity and faster tempo than a moment or note with a lower beat-grade.

Optionally, a maximal range is set for each parameter, and each beat-grade unit is associated with tempo parameter that corresponds to the maximal range, divided by the number of subdivisions in the measure. For instance, for time-signature 4/4, subdivision 1/32, and maximal range of velocity 16%, each beat-grade unit corresponds to 0.5% in the velocity parameters. For instance, if the beat-grades of the four first subdivisions are 32, 30, 31, 29 the corresponding velocity parameters may be 1.08, 1,07, 1.075, and 1.065 etc. Alternatively, the first subdivision may have another value and the differences remain the same, for instance: 1.00, 0.99, 0.995, and 0.985.

The full correspondence is easy to establish directly from the beat-grade tables, and provides improved musical correctness, however, the pre-sets described below provide even better results, as they suggest more variety between different measures.

Exemplary Tempo Pre-Sets

The bar-charts of FIG. 25 represent an exemplary pre-set of tempi for assignment to moments in a score written in 4/4 meter.

In the upper bar-chart (3A), tempo parameters are provided for quarters, and the quarters have the pattern: fast, intermediate, intermediate, slow. This is not in full correspondence with the beat-grade (4, 2, 3, 1, see appendix III in 60/821,744, which is incorporated herein by reference), however, it obeys guideline (a) above, as the tempo of the weak beats (34, 36) are not higher (faster) than that of the strong beats that follow them (38 and 40, respectively).

In the third bar-chart 3C, providing tempo parameters for $1/16^{th}$, guideline (a) is obeyed, as all the weaker beats (62) have the same tempo parameter as the stronger beats that follow them, except for the last one in the second quarter (62'), and the last one in the forth quarter (62"), which are slower than the strong beat following them.

In the fourth bar-chart 3D, providing tempo parameters for $1/32^{nd}$, guideline (a) is strictly obeyed. It may be note-worthy that this does not stand in the way of providing a general slow-down beginning at the middle of the third quarter (72) and ending at the end of the measure.

Guideline (b) is kept all along the bar-charts of FIG. 25, as the average tempo parameter in the charts is 0.9500, 0.9500, 0.9506, and 0.9502: nowhere does the average tempo deviate in more than 1%.

Compliance with guideline (c) is illustrated in the $1/8^{th}$ bar-chart, with the dashed lines showing that the average value over each of the quarters obeys the same general rule (fast, intermediate, intermediate, slow) as the time-signature unit.

These guidelines may be followed with many different pre-sets, and they are all in accordance with embodiments of the invention. Specific numbers that provide most appropriate pre-sets for a specific musical score or performance style may be found by a skilled person in a trial and error process or based on knowledge of certain styles (primarily dance forms), and the pre-sets reproduced herewith provide good starting points.

Exemplary Velocity Pre-Sets

The bar-charts of FIG. 26 represent an exemplary pre-set of velocities for assignment to moments in a score written in 4/4 time signature. It is optionally used together with the tempo pre-set provided in FIG. 25.

Figure 25A:
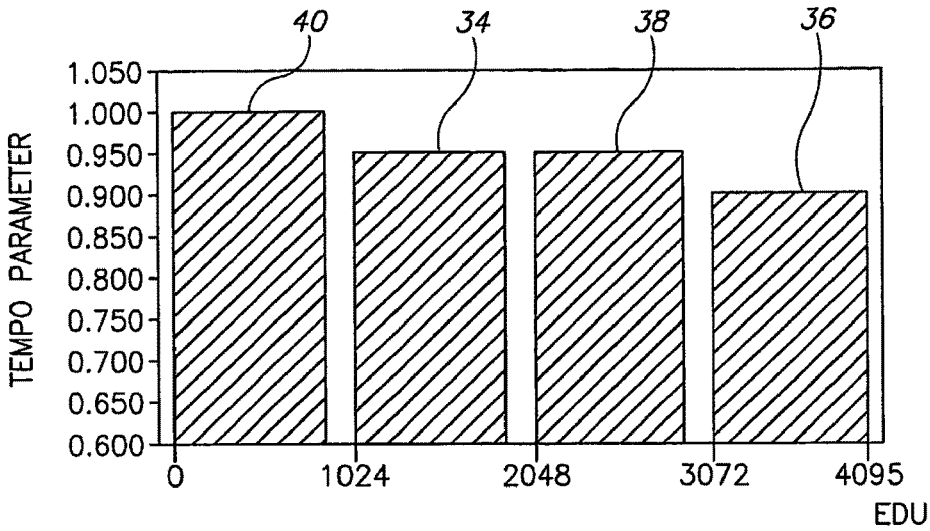
FIGS. 25A-25D are bar-chart representations of a tempo pre-set for scores written in 4/4 time signature according to an embodiment of the invention.
Figure 25B:
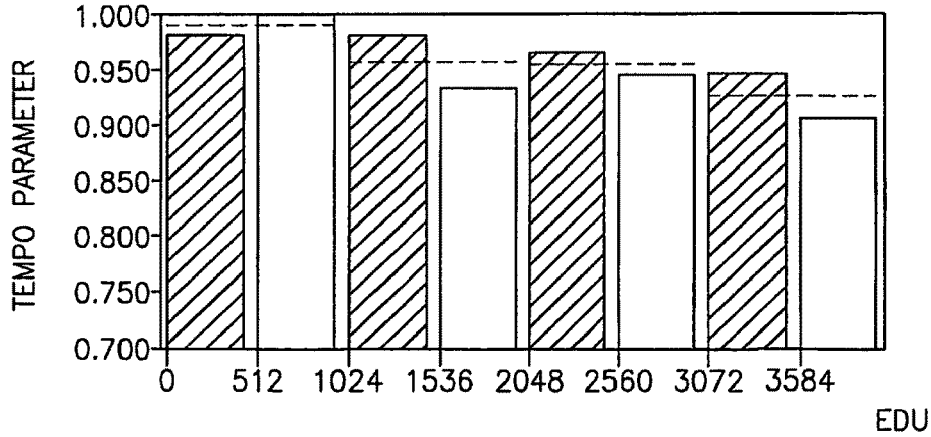
Figure 25C:
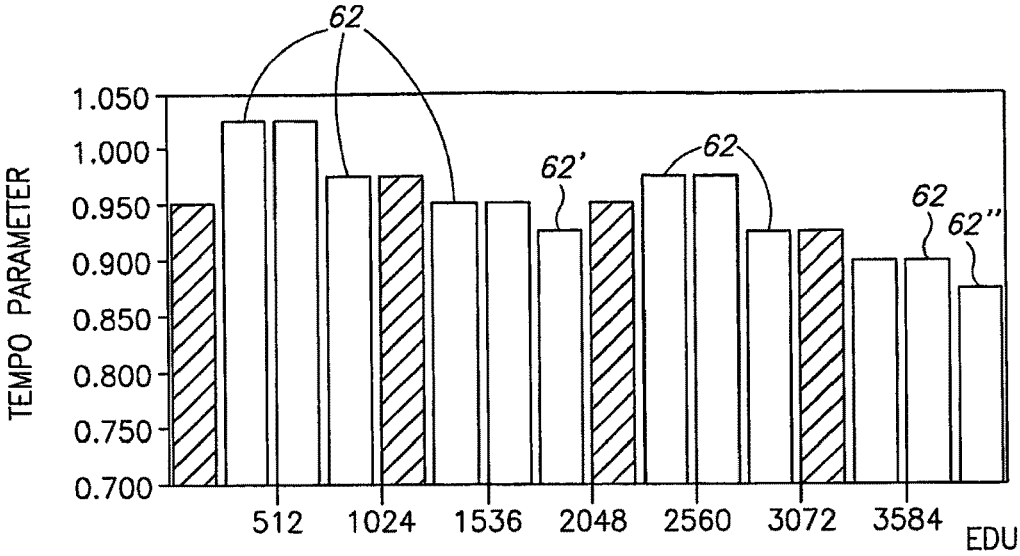
Figure 25D:
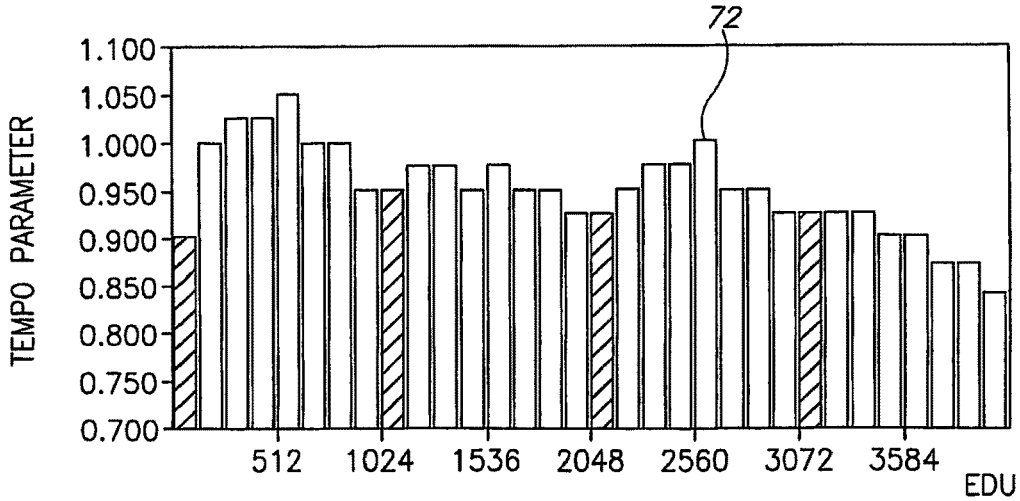
Figure 26A:
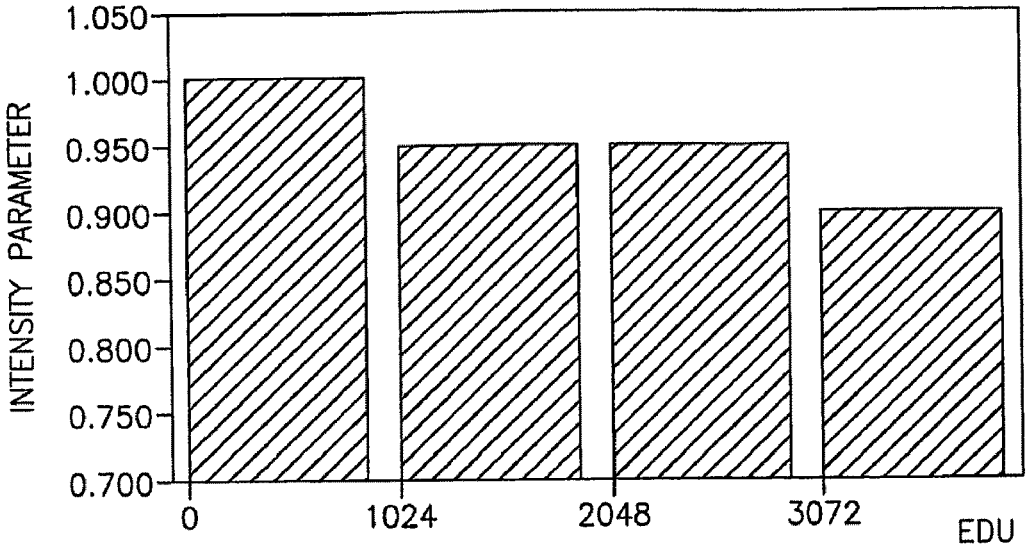
FIGS. 26A-26D are bar-chart representations of velocity pre-set for scores written in 4/4 time signature according to an embodiment of the invention.
Figure 26B:
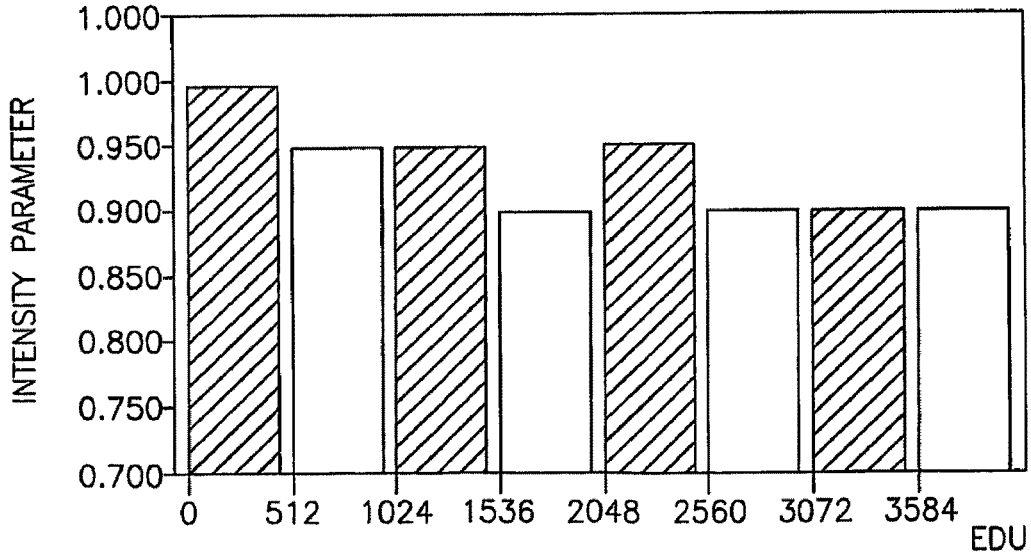
Figure 26C:
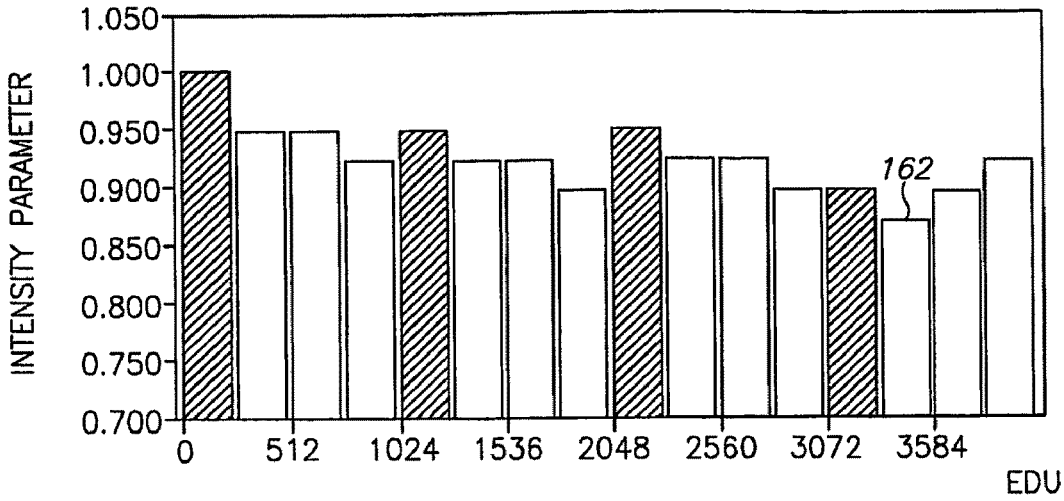
Figure 26D:
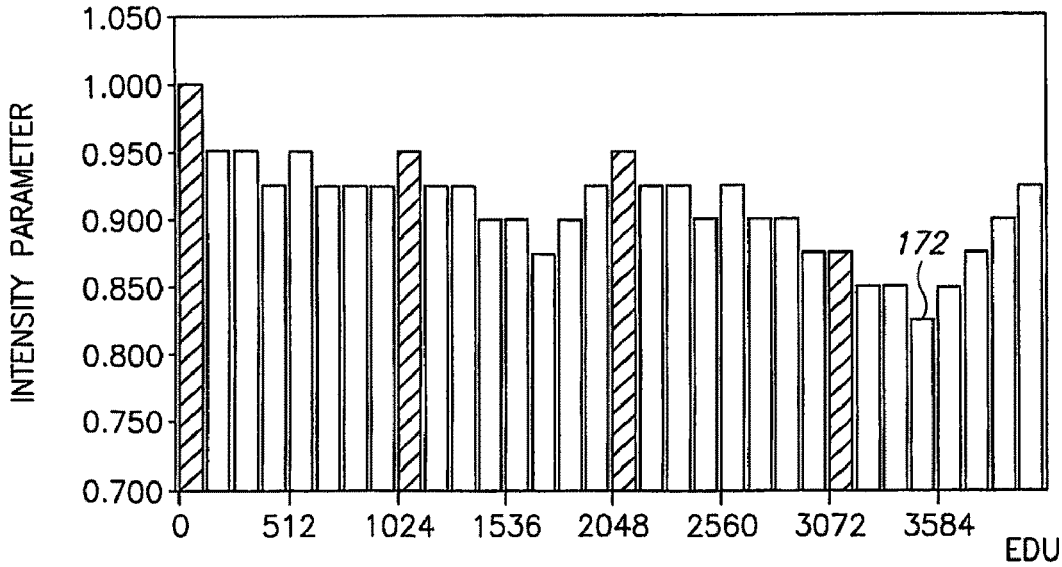

In FIG. 26A, velocity parameters are provided for quarters, and the quarters have the pattern: strong, intermediate, intermediate, weak, which, is optionally in correspondence with the tempo parameters of quarters in FIG. 25A. Nevertheless, velocity parameters as illustrated in FIG. 26A may also be used together with tempo parameters that lack such correspondence.

In the velocity pre-set of FIGS. 26A-26D guideline (a) above is strictly obeyed in all the four charts, as the velocity of the strong beats are never lower (softer) than that of a weaker beat that precedes it.

It is note-worthy that in the charts of 1/16s (FIG. 26C) and 1/32(FIG. 26D) there is a slight crescendo starting at subdivision 162 and 172 respectively. This kind of crescendo may be useful in preparing velocity pre-sets that obey guideline (c) above, as it helps preventing the velocity of the last note from being too weak in comparison with the velocity of the first note in the next measure.

The inventors found that such crescendo makes the performance sound more rhythmically correct than many other arrangements, in particular when it is combined with a slow-down shown in the corresponding tempo charts, as discussed above.

Additional Pre-Sets

In an embodiment of the invention, music performer 100 may have additional pre-sets of tempo and/or velocity parameters. For instance, storage 104 may store pre-sets for phrase-endings. Such a pre-set may include, for instance, a slow down accompanied with a gradual reduction of velocity towards the end of a phrase, and gradual speed up accompanied with a gradual increase of velocity in the beginning of a new phrase. Borders between phrases may be assigned arbitrarily, say, each four measures; manually by a user through a user interface, or by any other means, such as thematic analysis.

In an embodiment of the invention, the processor is configured to identify phrase ends from the flow of harmonic changes in the musical score. The harmonic flow changes may be deduced from the music notation file by the musical performer, for instance, as described herein. Alternatively or additionally, the harmonic flow change may be provided to music performer 100 with the input music notation file, or in any other input means. In this embodiment, the processor identifies phrase ends automatically, whenever harmonic flow patterns corresponding to 'authentic cadence', 'half cadence', 'incomplete cadence' or any other cadence is found in the score.

In an embodiment of the invention, music performer 100 also includes a pre-set for dissonants and their resolutions. This may include, for instance, a slow tempo on the dissonant moment and a faster tempo on the resolution moment both being slower than the general tempo as well as lower velocity on the resolution note.

In an embodiment of the invention, music performer 100 also includes pre-sets for rhythmic events such as syncopation, melodic events such as melodic repetition or 'sequence' (meaning a repetition in a higher or lower pitch)

In an embodiment of the invention, music performer 100 also includes pre-sets for carrying out explicit performance indication that appear in scores. For instance, there may be a "crescendo" and "diminuendo" pre-sets for performing score-portions marked with crescendo or diminuendo marks. Such pre-sets may include, for instance a tempo slow down towards the end of the crescendo or the diminuendo, or a slow down before a "sforzando" or a "Fermata", etc.

Pre-sets may be applied to articulation (duration), controllers such as the sustaining pedal of the piano, vibrato, pitch bend, instrument specific options such as bow direction in bowed string instrument, tonguing in woodwinds, etc.

Similarly to the pre-sets that are of pure rhythmic origin, also the punctuation pre-sets, the dissonant-resolution pre-sets, as well as any other pre-set is score-independent, and may be useful with practically any score, where using a specific pre-set for a specific score is mainly dependent on user preferences.

When more than one pre-set is in use, the deviations appearing in each of them optionally occumulate. For instance, if a certain moment has a tempo parameter of 110% in the rhythmic pre-set and tempo parameter of 110% in the end-of-phrase pre-set, and these are the only two active pre-sets, this moment will be played with a tempo parameter of 121%.

Optionally, pre-sets values may be modified to avoid exaggerated effects of multiple pre-sets working together. For instance, in an embodiment of the invention, the slow down associated with a cadence is reduced by 50% if the moments to be slowed down due to the cadence are also marked in the score with an explicit slow-down marking.

Optionally, when more than one pre-set is in use, the user-interface allows controlling the pre-sets in groups. For instance, there may be one control for all tempo pre-sets, which allows a user to set all tempo-changes dictated by the pre-sets to the same level, for instance, to maximal level. Additionally or alternatively, a single control may affect several pre-sets of similar origin, for instance, there may be one control for punctuation pre-sets, another for explicit performance indications, and another to pre-sets of purely rhythmic origin. This way a user may decide to make punctuation more (or less) pronounced than in the default, while keeping the rhythm at default, etc.

In an embodiment of the invention, many layers of pre-sets are provided, wherein each layer allows a different degree of control, where the deeper layer allows controlling each pre-set individually, and the upper layer has only small number of controls, for instance, 1, 2, 3, or 4, each controlling a large number of pre-sets.

Exemplary Uses of Automatic Music Performers

An automatic music performer as described above may be used by professional musicians wishing to automatically perform music with a good rhythmic sense. This may help a musician evaluate in advance how a certain piece of music is going to sound when performed. If sufficient pre-sets are provided, for instance, as described above under the heading of 'additional pre-sets', the music performance may be good enough to allow replacing a human performance. In such a case, the musician may use the automatic music performer for preparing low cost high quality performances of freshly composed music.

Another use of an automatic music performer according to some embodiments of the present invention is in musical education. Music students (in the university, high school, or even kindergarten), may play around with the pre-sets to learn about the effect of rhythm (or any other factor for which pre-sets are provided) on the general impression made by a musical performance.

General

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the invention and which are described as examples. Structure and acts described herein are replaceable by equivalents, which perform the same function, even if the structure or acts are different, as known in the art. Therefore, the scope of the invention is limited only by the elements and limitations as used in the claims.

The invention claimed is:

1. A method for assigning chords to a musical score indicative of a sequence of time segments, each time segment comprising at least one note, the method comprising:

assigning a trial chord to a plurality of notes in each time segment;

scoring said chords in each time segment based on a value of a music fitness function, said scoring associated with a dissonance relationship between the assigned chord and said plurality of notes; and assigning the chord with the highest score to each time segment.

2. A method according to claim 1, wherein each of the time segments is a moment that begins with the appearing of a note and ends with the appearing of another note.

3. A method according to claim 1, wherein the score comprises monophonic music with accompaniment.

4. A method according to claim 1, wherein the score comprises polyphonic music.

5. A method according to claim 1, wherein said chord with the highest score is further associated with a dissonance relationship between the assigned chord and notes of one or more time segments neighboring the first time segment.

6. A method according to claim 1, wherein the value of the function is responsive to the number of notes common to the trial chord and to the moment.

7. A method according to claim 1, wherein the value of the function is responsive to existence in the moment of a note that is a dissonant $7^{th}$ of the trial chord.

8. A method according to claim 1, wherein the value of the function is responsive to the number of times that the chord's root note appears in the moment.

9. A method according to claim 1, wherein the value of the function is responsive to the resolution of the bass dissonant over the $7^{th}$.

10. A method according to claim 1, comprising assigning tempo parameters to moments in said musical score, by a method comprising:

providing a first set of rules for assigning the tempo parameters to moments, a rule of said first set of rules being responsive to at least one rhythmical characteristic of said moments, extracting from the musical score said at least one rhythmical characteristic of at least one moment of said moments; and assigning to each of said at least one moment a tempo parameter according to said first set of rules.

11. A method according to claim 10, wherein at least said rule of said first set of rules is responsive to a time signature of the musical score.

12. A method according to claim 10, comprising:

providing a second set of rules for assigning a velocity parameter to a note, a rule of said second set of rules being responsive to at least one rhythmical characteristic of said note;

extracting from the musical score said at least one rhythmical characteristic of at least one note; and assigning to said at least one note a velocity parameter according to said second set of rules.

13. A method according to claim 12, wherein at least said rule of said second set of rules is responsive to a time signature of the musical score.

14. A method according to any claim 10, wherein said at least one rhythmical characteristic, to which rules of said second set of rules are responsive, comprises a smallest subdivision in a measure that comprises the note.

15. A method according to claim 1, further comprising assigning velocity parameters to moments in said musical score, by a method comprising:

providing a set of rules for assigning a velocity parameter to a note, a rule of said set of rules being responsive to at least one rhythmical characteristic of said note, extracting from the musical score said at least one rhythmical characteristic of at least one note; and assigning to said at least one note a velocity parameter according to said set of rules.

16. The method according to claim 1 wherein said trial cords are triads.

17. The method according to claim 1 wherein said music fitness function comprises up to 9 values.

18. The method according to claim 1 comprising assigning said highest score randomly.

19. The method according to claim 1 further comprising assigning a chord to each time segment having a note with a root of said chord.

20. A method for assigning chords to a musical score indicative of a sequence of moments, each moment beginning with an appearance of a note and ending with the appearance of another note, the method comprising assigning a chord to each moment; and amending the chord assignment to reduce the number of changes of chords along the score by merging adjacent moments in said sequence of moments.

21. A method according to claim 20, wherein amending the chord assignment is to improve musical correctness of the chord assignment.

22. A method according to claim 20, wherein the assigning of a chord to a moment is responsive to predefined dissonance/consonance relationships between the chord assigned to the moment and notes of the moment and of following moments.

23. An apparatus for automatically performing music or writing a computer readable music file, the apparatus comprising:

an input for receiving a music notation file, indicative of a sequence of time segments, each time segment comprising at least one note;

a processor for processing the input music notation file;

an output for writing the computer readable music file or for performing the music; and a user interface;

wherein the processor is configured to assign tempo parameters to moments, in a method that comprises extracting from the score at least one rhythmical characteristic of at least one moment, and assigning to the at least one moment tempo parameter according to a rule of a first set of rules, said rule being responsive to the at least one rhythmical characteristic; the user interface allows affecting the rule by a user; and the processor is configured to assign a chord to a plurality of notes in each time segment, to score the chords in each time segment based on a value of a music fitness function said scoring associated with a dissonance relationship between said assigned cord and said plurality of notes, and to assign the chord with the highest score to each time segment.

24. An apparatus according to claim 23, wherein the processor is configured to assign velocity parameters to notes, in a method that comprises extracting from the score at least one rhythmical characteristic of at least one note, and assigning to the at least one note a velocity parameter according to a rule of a second set of rules, said rule being responsive to the at least one rhythmical characteristic, and the user interface allows affecting the second set of rules by a user.

25. An apparatus according to claim 23, wherein affecting a set of rules comprises selecting a set of rules out of at least two sets of rules.

26. An apparatus according to claim 23, wherein at least one rule of said first set of rules is provided to the processor dependent on at least one variable, and affecting said at least one rule comprises determining the parameter of said at least one variable.

* * * * *